US011607091B1

(12) United States Patent
Harlan et al.

(10) Patent No.: US 11,607,091 B1
(45) Date of Patent: Mar. 21, 2023

(54) DEPLOYABLE HANDLE DEVICES

(71) Applicant: NuWhirl Systems Corporation, Corona, CA (US)

(72) Inventors: Jeff Harlan, Corona, CA (US); Yves Grandmaitre, Merrickville (CA)

(73) Assignee: Nuwhirl Systems Corporation, Corona, CA (US)

( * ) Notice: Subject to any disclaimer, the term of this patent is extended or adjusted under 35 U.S.C. 154(b) by 213 days.

(21) Appl. No.: 17/094,490

(22) Filed: Nov. 10, 2020

Related U.S. Application Data

(60) Provisional application No. 62/933,866, filed on Nov. 11, 2019.

(51) Int. Cl.
*A47K 17/02* (2006.01)
*A47K 3/00* (2006.01)

(52) U.S. Cl.
CPC ..... *A47K 17/024* (2013.01); *A47K 3/003* (2013.01)

(58) Field of Classification Search
CPC ..... A47K 17/024
USPC ..... 248/205.7, 205.6, 206.1
See application file for complete search history.

(56) References Cited

U.S. PATENT DOCUMENTS 5,690,237 A * 11/1997 Marzec ..... A47K 3/003 211/105.1
9,968,226 B1 * 5/2018 Anderson ..... A47K 3/38
2016/0143494 A1 * 5/2016 Thomas ..... G08B 3/1008 4/254

* cited by examiner

*Primary Examiner* — Lori L Baker
(74) *Attorney, Agent, or Firm* — Knobbe Martens Olson & Bear, LLP

(57) ABSTRACT

Handle devices for building, including bathing, environments that can be stored in and deployed from recesses in the walls of the environments. The handle devices may include emergency contact capabilities to enable a user to contact an emergency contact. Universal handle devices can be mounted to the contoured walls of a free standing tub. Handle devices may have a handle, a handle housing, a gear shaft connected to the handle, a spring and a lock housing. Other handle devices have housings with a gear rod and a guide channel. Some handle devices have a plurality of links rotatably coupled to the housing and the handle, and a stowage locking lever housed within the handle.

20 Claims, 52 Drawing Sheets

1014

DEPLOYABLE HANDLE DEVICES

INCORPORATION BY REFERENCE TO ANY PRIORITY AND RELATED APPLICATIONS

This application claims the priority benefit of U.S. Application No. 62/933,866, filed Nov. 11, 2019, which is hereby incorporated by reference in its entirety herein and made a part of this specification. Any and all applications for which a foreign or domestic priority claim is identified in the Application Data Sheet as filed with the present application are hereby incorporated by reference under 37 CFR 1.57.

FIELD

This disclosure relates to components for improved safety devices such as handle devices, handle assemblies, devices for alerting emergency services, and systems and methods of manufacture and use.

BACKGROUND

Household or other building structure environments can often be hazardous without handle supports being available. For example, bathing environments are often slippery due to wet conditions, which can result in injury of a person. Due to the private nature of household or bathing environments, injuries can become more dangerous than would otherwise be the case because help from individuals is not readily available. This can be especially hazardous for older or disabled users.

SUMMARY

It is desirable to improve the safety in building structures, including household and bathing environments. Handles are common to improve the safety of, for example, bathing environments but handles are not aesthetic and can disrupt the walls of a bathing environment. This disclosure provides handle devices or grab bars that can be stored in the walls of a building, household, bathing, or other environment and can be selectively deployed when the environment is in use, improving the aesthetic of the environment. The handle devices can be used in any environment where a stowable/deployable handle device may be desired, in particular for safety. This disclosure provides handle devices that can include emergency contact capabilities such that a user can contact emergency contacts (e.g., services) if injured or in need of assistance. In some variants, this disclosure provides a universal handle device that can attached to the contoured surfaces of a free standing tub, improving safety despite the inability to attach handles to the walls of a bathing environment.

In some embodiments, a handle device that can be movable from a stowed configuration to a deployed configuration for grasping by a user is disclosed herein. The handle device can include a handle that can be grasped by a user. The handle can move between a stowed configuration and a deployed configuration. In the stowed configuration, the handle can be substantially flush with a surrounding wall, and in the deployed configuration, the handle can protrude from the surrounding wall for the user to grasp the handle. The handle device can include a handle housing that can be positioned in the surrounding wall with the handle at least partially positioned in the handle housing. The handle housing can include a first gear track, a second gear track, and an elongate protrusion on one or more walls of the handle housing. The first gear track can be positioned on a same wall of the one or more walls as the second gear track. The first gear track can be spaced from the second gear track on the same wall. The handle can move relative to the handle housing between the stowed and deployed configurations. The first and second gear tracks can extend on the same wall of the handle housing along a travel direction of the handle between the stowed and deployed configurations. The elongate protrusion can extend along the travel direction on the one or more walls. The handle device can include a gear shaft connected to the handle. The gear shaft can include a first gear fixed to the gear shaft and a second gear fixed to the gear shaft. The first gear can be spaced from the second gear on the gear shaft. The first gear can engage the first gear track. The second gear can engage the second gear track. The handle moving relative to the handle housing between the stowed and deployed configurations can rotate the first and second gears via the first and second gear tracks moving along the travel direction and engaging the first and second gears. The first and second gears can rotate together a same arc length by being fixed to the gear shaft such that the first and second gears move the first and second gear tracks a same linear distance along the travel direction between the stowed and deployed configurations by the first and second gears rotating the same arc length to mitigate movement of the handle in directions other than along the travel direction relative to the handle housing. The handle device can include a spring connected to the handle housing that can bias the handle to the deployed configuration. The handle device can include a lock housing connected to the handle that can move with the handle between the stowed and deployed configurations. The lock housing can include a groove extending in the travel direction. The groove can receive the elongate protrusion of the handle housing in the stowed configuration. The lock housing can include a cavity having a locking mechanism positioned in the cavity. The locking mechanism can include an engagement body that can move in the cavity and an arm connected to the engagement body extending out of the cavity. The arm can block the elongate protrusion from entering the groove of the lock housing to inhibit movement of the elongate protrusion into the groove to lock the handle in the deployed configuration.

In some variants, the lock housing can include an opening exposing the engagement body in the deployed configuration. The engagement body can be moved in the cavity by the user through the opening to move the arm of the locking mechanism away from the groove such that the elongate protrusion can be permitted to enter the groove, enabling the handle to be moved into the stowed configuration.

In some variants, the handle can include a front recess that can receive a panel having an appearance matching that of the surrounding wall.

In some variants, the handle device can include a lock spring arm connected to the handle that can move with movement of the handle between the deployed and stowed configurations. The handle housing can include a guide channel that can receive the lock spring arm. The guide channel can include a contour that can bias the lock spring arm in the contour to lock the handle in the stowed configuration.

In some variants, the lock spring arm can be moved from the contour of the guide channel by pushing the handle into the handle housing from the stowed configuration such that the spring biases the handle to move into the deployed configuration.

In some variants, the handle device can include a plurality of links pivotably coupled together and connected to the handle and the handle housing to support the handle relative to the handle housing. The plurality of links can expand with the handle in the deployed configuration and to collapse with the handle in the stowed configuration.

In some variants, the handle device can further comprising an emergency communication unit connected to the handle that can enable the user to contact an emergency contact.

In some variants, the handle device can be disposed between two supports in the surrounding wall.

In some variants, the spring can be a constant force spring.

In some variants, the handle can include flanges that can have openings through which the gear shaft can extend to position the gear shaft relative to the handle.

In some variants, the first gear track and the second gear track can be disposed on a first wall of the handle housing and the elongate protrusion can be disposed on a second wall of the handle housing that is opposite the first wall.

In some variants, a handle device is disclosed herein. The handle device can include a handle that can be grasped by a user. The handle can translate between a stowed configuration that is substantially flush with a surrounding wall and a deployed configuration which allows for the user to grasp the handle. The handle device can include a housing that can house the handle in the housing in the stowed configuration. The housing can include a gear rack and a guide channel. The guide channel can include a contour that can facilitate locking the handle in the stowed configuration. The handle device can include a gear rod that can include a gear that can engage with the gear rack. The gear rod can rotate with movement of the handle between the stowed and deployed configurations with the gear remaining engaged with the gear rack. The handle device can include a lock spring arm connected to the handle. The guide channel can be configured to move the lock spring arm within the guide channel with the movement of the handle between the stowed and deployed configurations. The handle device can include a spring coupled to the housing that can bias the handle to the deployed configuration outside of the housing. The guide channel can move the lock spring arm into the contour of the guide channel with the handle in the stowed configuration to lock the handle in the stowed configuration. The guide channel can move the lock spring arm from the contour of the guide channel by the handle being moved further into the housing from the stowed configuration. The spring can move the handle from within the housing with the lock spring arm moved out of the contour of the guide channel.

In some variants, the handle device can include a locking mechanism that can have an engagement cylinder and arm. The locking mechanism can releasably lock the handle in the deployed configuration and move with movement of the handle between the stowed and deployed configurations.

In some variants, the housing can include a protrusion, wherein engagement between the arm of the locking mechanism and the protrusion can lock the handle in the deployed configuration.

In some variants, the handle device can include a lock housing having a cavity that can house the locking mechanism, wherein the engagement cylinder of the locking mechanism can be accessible to the user with the handle in the deployed configuration. In some variants, a force applied to the engagement cylinder can disengage the arm from the protrusion to allow the user to push the handle to the stowed configuration.

In some variants, the lock housing can include a groove that can receive the protrusion. The arm of the locking mechanism can block the protrusion from entering the groove to lock the handle in the deployed configuration.

In some variants, the handle device can include a plurality of links that can be pivotably coupled together. The plurality of links can couple the housing to the handle. The plurality of links can expand with deployment of the handle.

In some variants, a handle device is disclosed herein. The handle device can include a handle that can swing between a stowed configuration and a deployed configuration. The handle can be grasped in the deployed configuration. The handle device can include a housing that can house the handle in a stowed configuration. The handle device can include a plurality of links rotatably coupled to the housing and the handle. The plurality of links can facilitate the handle being swung between the stowed and deployed configurations. The handle device can include a stowage locking lever housed within the handle. The stowage locking lever can include a button accessible to a user and a locking pin. The stowage locking lever can lock the handle in a stowed configuration by extending the locking pin into the one of the plurality of links. The stowage locking lever can be biased via a spring to position the locking pin into the one of the plurality of links. The locking pin can be removed from the one of the plurality of links via applying a force to the button such that the stowage locking lever moves to move the locking pin.

In some variants, the handle device can include a deployment locking mechanism that can be inserted into a cavity of the one of the plurality of links. The deployment locking mechanism can include a cylindrical body and a tab extending therefrom. The tab can engage the housing to lock the handle in the deployed configuration. The tab can be disengaged from the housing via applying a force thereto such that the tab is translated within the cavity of the one of the plurality of links.

In some variants, the handle device can include a torsion spring that can bias the handle to the deployed configuration. The torsion spring can be coupled to the one of the plurality of links.

Methods of using the system(s) disclosed herein (including device(s), apparatus(es), assembly(ies), structure(s), and/or the like) are included; the methods of use can include using or assembling any one or more of the features disclosed herein to achieve functions and/or features of the system(s) as discussed in this disclosure. Methods of manufacturing the system(s) disclosed herein are included; the methods of manufacture can include providing, making, connecting, assembling, and/or installing any one or more of the features of the system(s) disclosed herein to achieve functions and/or features of the system(s) as discussed in this disclosure.

This Summary is provided to introduce a selection of concepts in a simplified form. The concepts are further described in the Detailed Description section. Elements or steps other than those described in this Summary are possible, and no element or step is necessarily required. This Summary is not intended to identify key features or essential features of the claimed subject matter. The claimed subject matter is not limited to implementations that solve any or all disadvantages noted in any part of this disclosure.

BRIEF DESCRIPTION OF THE DRAWINGS

The abovementioned and other features of the embodiments disclosed herein are described below with reference to the drawings of the embodiments. The illustrated embodiments are intended to illustrate, but not to limit, the scope of protection. Various features of the different disclosed embodiments can be combined to form further embodiments, which are part of this disclosure.

FIGS. 18C-1 and 18C-2 illustrates ends of spring arms in guide channels in a transition configuration.

FIGS. 18F-1 and 18F-2 illustrates ends of spring arms in guide channels in the stowed configuration.

DETAILED DESCRIPTION

Although certain embodiments and examples are described below, this disclosure extends beyond the specifically disclosed embodiments and/or uses and obvious modifications and equivalents thereof. Thus, it is intended that the scope of this disclosure should not be limited by any particular embodiments described below.

Figure 1:
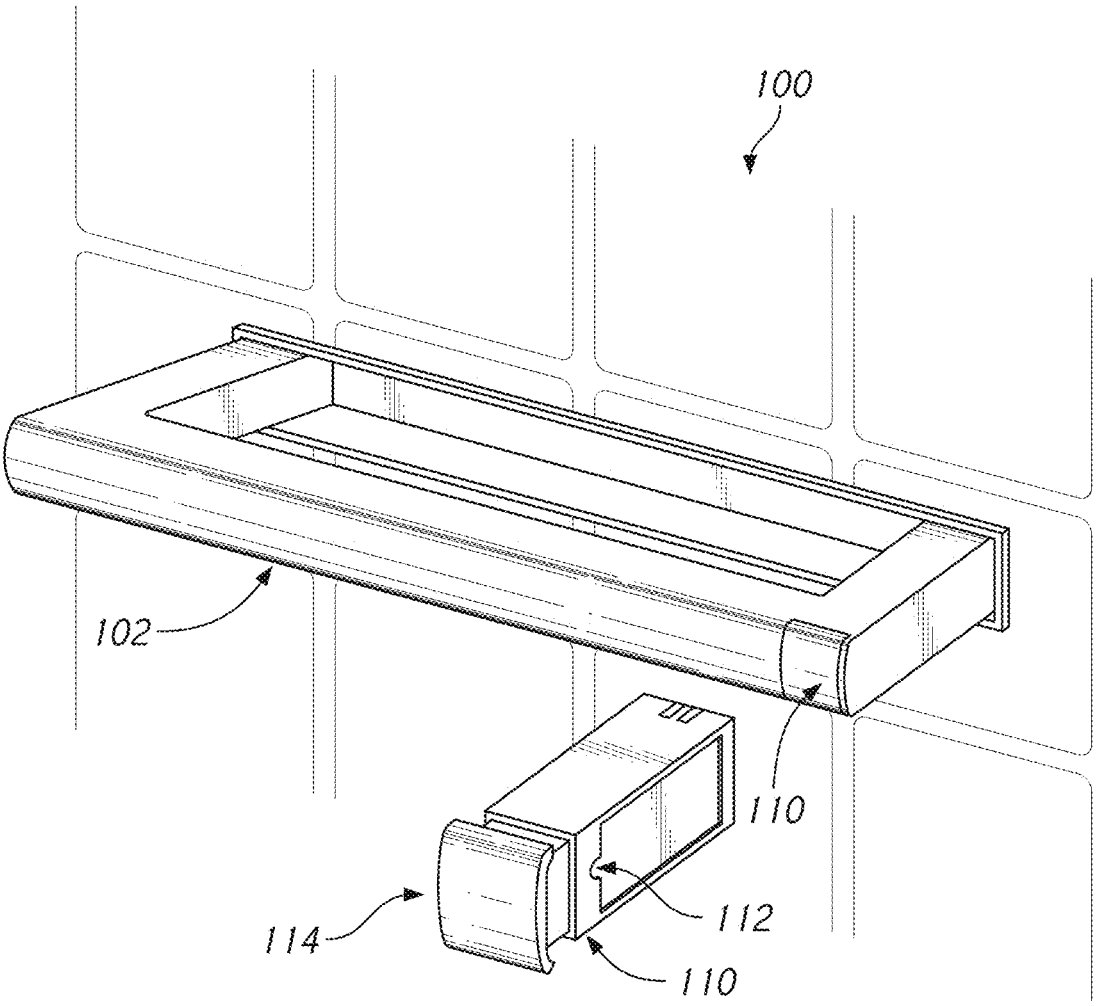
FIG. 1 illustrates an example handle device with an emergency call button.

FIG. 1 illustrates a handle device 100. The handle device 100 is coupled to and/or within the wall of a building, including bathing, environment, which can include showers, baths, bathtubs, etc. In some variants, the handle device 100, and/other devices herein, can be used in other environments, such as cooking environments. The handle device 100 has an emergency contact device 110. The emergency contact device 110 can be integrated with the handle device 100, as illustrated, or a separate feature installed in the building, including bathing, environment. The emergency contact device 110 can have an electronic package 112 that can be easily removable to facilitate the changing of batteries. The emergency contact device 110 can have an emergency contact button 114. The emergency contact device 110 can be pushed to alert a contact that the user is in need of assistance, such as emergency response services. The emergency contact button 114 can require that the button be held for a duration of time, such as several seconds, before an emergency contact is notified. The emergency contact button 114 can turn on a light, such as an LED, and/or make a sound, such as beep, when an alert has been sent to an emergency contact. The emergency contact device 110 can be an internet-of-things device. The emergency contact device 110 be connected to a network via Wi-Fi, Bluetooth, Ethernet, 3G, 4G, and/or other wireless or wired communication methods. In some embodiments, the emergency contact device 110 can have a speaker and microphone, allowing a user to speak to emergency contacts. The emergency contact device 110 can include an integrated two way voice over internet protocol (VOIP) emergency call button.

The handle 102 of the handle device 100 can be positioned in a stored or deployed position, providing improved aesthetics. The handle device 100 can have a spring (e.g., a continuous force spring and/or constant force spring) that deploys the handle 102 via a push to release latch. For example, a user can push against the handle 102 while the handle 102 is stored within a recess of the wall such that the latch releases and the spring is free to deploy the handle 102 away from the wall (e.g., place the handle device 100 in the deployed position). The handle 102 can be pushed back and retained in a recess of the wall of the bathing environment (e.g., placed in the stored positon). In some embodiments, the handle device 100 can have a hidden lock release that can be pushed, allowing the handle 102 to be collapsed by pushing the handle 102 back into the recess of the wall of the bathing environment to reload the springs. The hidden lock release can be on inner portion of the handle 102. In some embodiments, the handle 102 is pushed back into the recess, against the force of the spring, until a latch retains the handle 102. The handle 102, as explained above, can be deployed from the stored position by again pushing on the handle 102.

Figure 2:
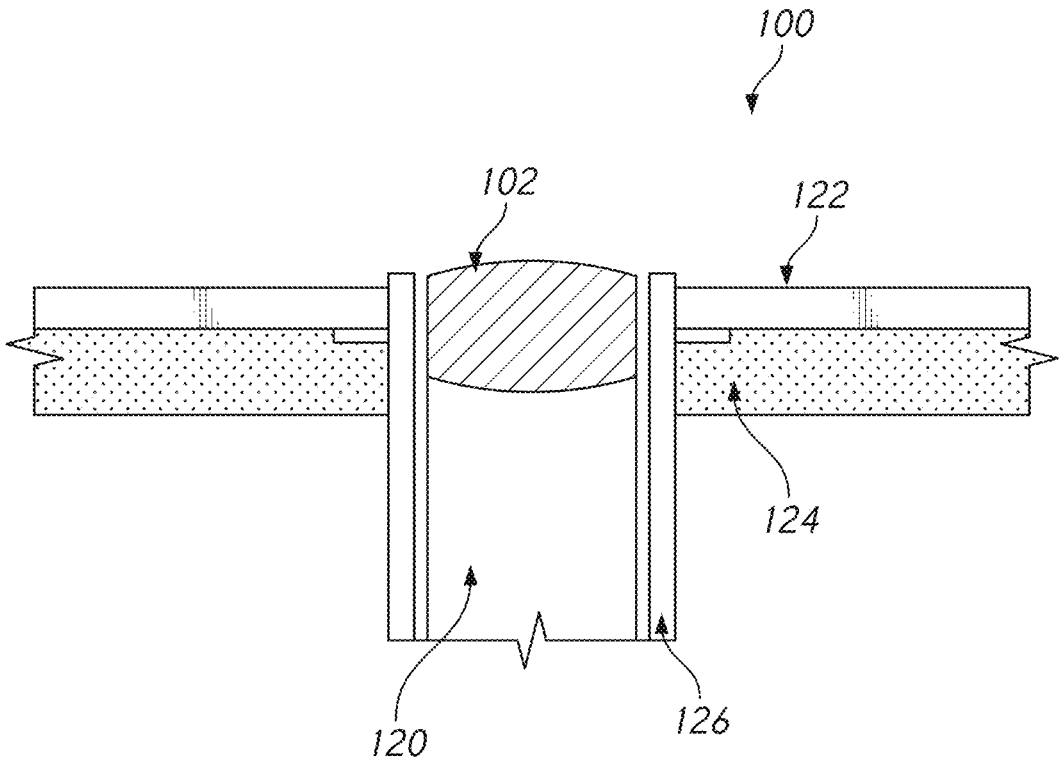
FIG. 2 illustrates a sectional view of an example handle device in a stowed position.

FIG. 2 schematically illustrates a sectional view of the handle device 100 with the handle 102 in the stored or stowed position. The handle 102 is positioned in the recess 120 of the wall of the environment. A frame or housing 126 (e.g., which can be thin) is positioned within the recess 120 to receive the handle 102. The frame 126 can have adjustable positioning elements 124 (e.g., flanges) that allow for adjustable depth mounting of the frame 126 within a recess 120 of a wall to accommodate for varying thicknesses of different wall covers 122 (e.g., tiles, stone, etc.). As shown, the handle 102 can have a curved profile, including a slight curve, which can enable a user to conveniently push against the handle 102 for deployment.

Figure 3A:
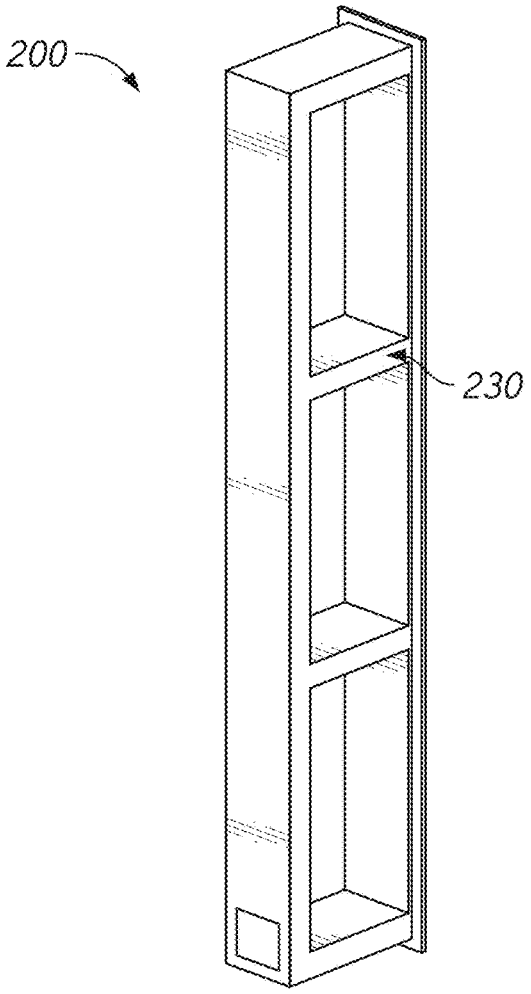
FIG. 3A illustrates an example vertically oriented handle device with multiple rungs in a deployed configuration.
Figure 3B:
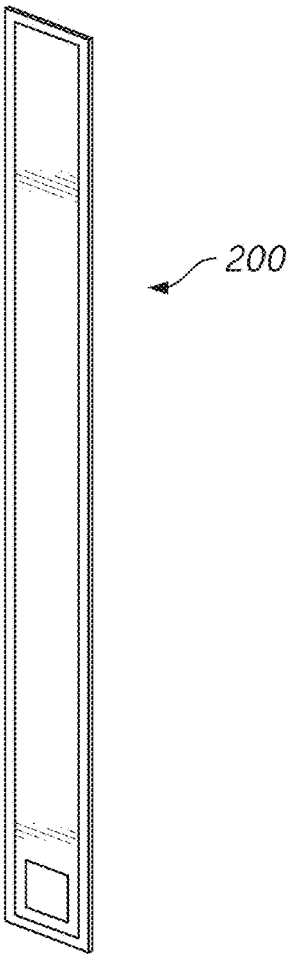
FIG. 3B illustrates the example handle device of FIG. 3A in the stowed configuration.

FIG. 3A illustrates a handle device 200 in the deployed position, and FIG. 3B illustrates the handle device 200 in the stored position. The handle device 200 is vertically oriented. The handle device 200 can be elongate (e.g., long). The handle device 200 can have multiple rungs 230 to provide additional climbing assistance to a user. In the stowed position, the front surface of the handle device can be substantially flush with the surrounding wall.

Figure 4A:
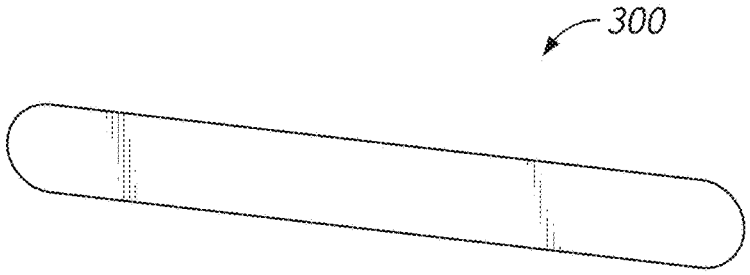
FIG. 4A illustrates another example handle device in a stowed configuration.
Figure 4B:
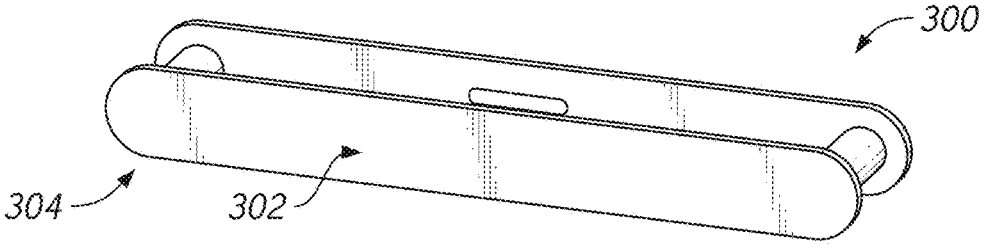
FIG. 4B illustrates the example handle device of FIG. 4A in a deployed configuration.

FIG. 4A illustrates the handle device 300 in the stowed position, and FIG. 4B illustrates the handle device 300 in the deployed position. The handle device 300 can be frameless. The handle device 300 can have a handle cover 302 that overlaps a seam, but creates a lip on the handle 304.

Figure 5:
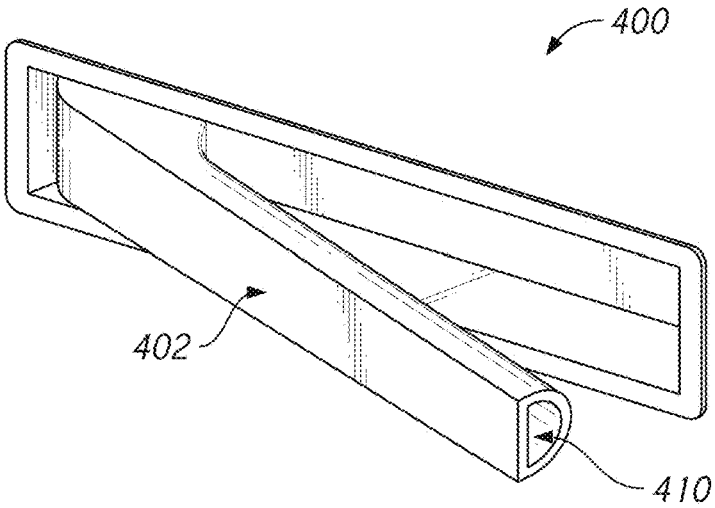
FIG. 5 illustrates an example handle device that is hinged on one side in the deployed configuration.

FIG. 5 illustrates a handle device 400 that is hinged one side, such that the handle 402 rotates between a deployed and stored position, rotating a free end towards and away from the wall of the building, including bathing, environment. The handle device 400 has an emergency contact device 410 that includes an emergency contact button on a free end of the handle, such that the button is exposed when the handle 402 is deployed. The button can be an integrated two way voice over internet protocol (VOIP) emergency call button.

Figure 6A:
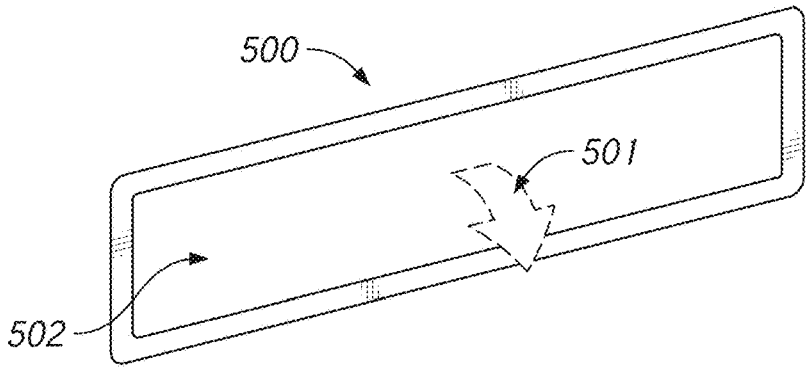
FIG. 6A illustrates an example handle device that is hinged on two sides in the stowed configuration.
Figure 6B:
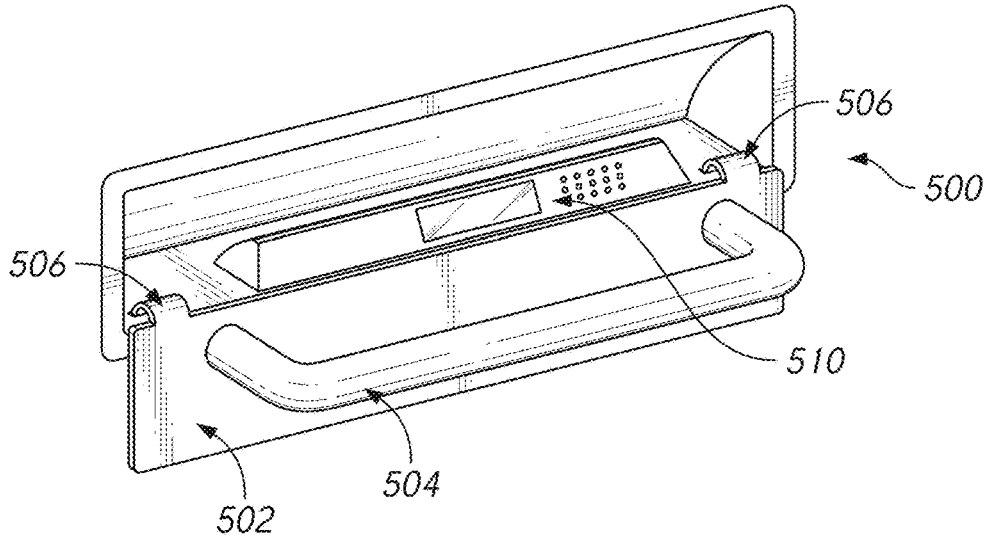
FIG. 6B illustrates the example handle device of FIG. 6A in the deployed configuration.

FIGS. 6A and 6B illustrate an example handle device 500 that is hinged on two ends. FIG. 6A illustrates the handle device 500 in a stowed position. FIG. 6B illustrates the handle device 500 in a deployed position. The cover 502 of the handle device 500 can be pushed when in the stored position to allow the cover 502 to flip down and provide access to the handle 504. In some embodiments, the hinges 506 can be goose neck hinges. The handle device 500 can have an emergency contact device 510. The emergency contact device 510 can include an emergency contact button that is exposed when the cover 502 is flipped down and the handle 504 is deployed. The button can be an integrated two way voice over internet protocol (VOIP) emergency call button. In some embodiments, the emergency contact device 510 includes a keypad to place emergency calls.

Figure 7A:
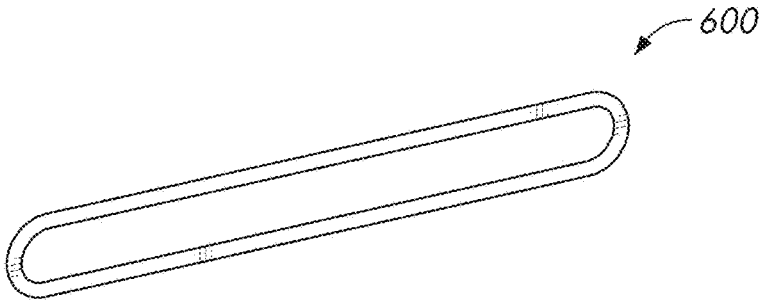
FIG. 7A illustrates an example handle device in the stowed configuration with an emergency call button that can be stored in the wall of a bathing environment such that the handle is flush with the wall.
Figure 7B:
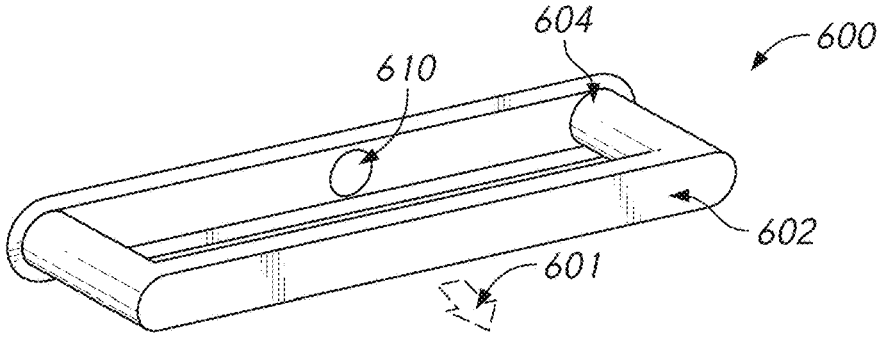
FIG. 7B illustrates the example handle device of FIG. 7A in the deployed positon.

FIGS. 7A and 7B illustrate an example handle device 600 in the stored and deployed positions, respectively. The handle device 600 can have a handle 602 and back frame 604 that slide straight out together in the direction of arrow 601 when deployed to expose an emergency contact device 610. The emergency contact device 610 can include an emergency contact button that is exposed when the handle 602 is deployed. The button can be an integrated two way voice over internet protocol (VOIP) emergency call button.

Figure 8A:
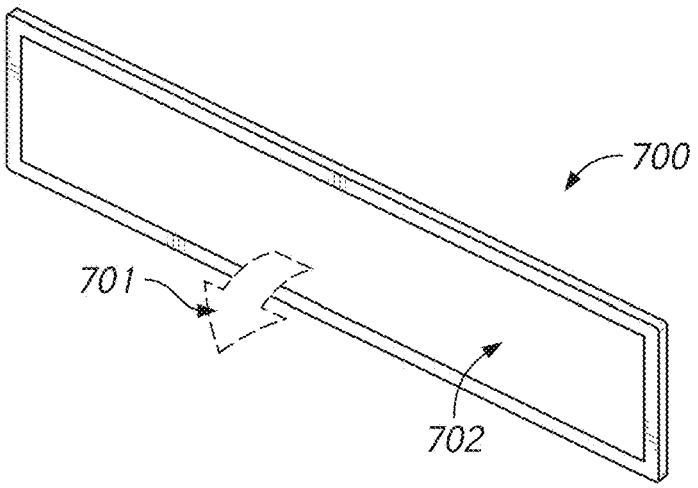
FIG. 8A illustrates an example handle device that is rotatably deployed from within the wall of a bathing environment.
Figure 8B:
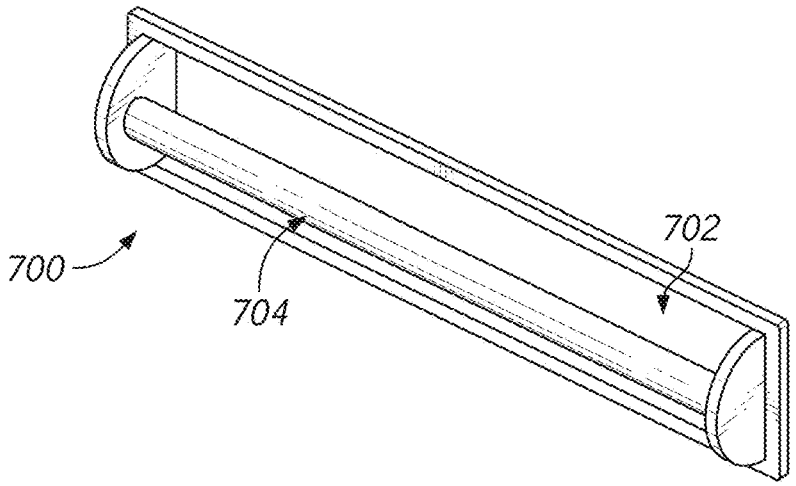
FIG. 8B illustrates the example handle device of FIG. 8A in the deployed configuration.

FIGS. 8A and 8B illustrate an example handle device 700 in the stored and deployed positions, respectively. The handle device 700 can have a hidden release button that flips the door 702 (e.g., 180 degrees) in the direction of arrow 701 to provide access to the handle 704. The handle device 700 can be closed by manually disengaging an open lock and pushing the door 702 closed to reset a release spring.

Figure 9:
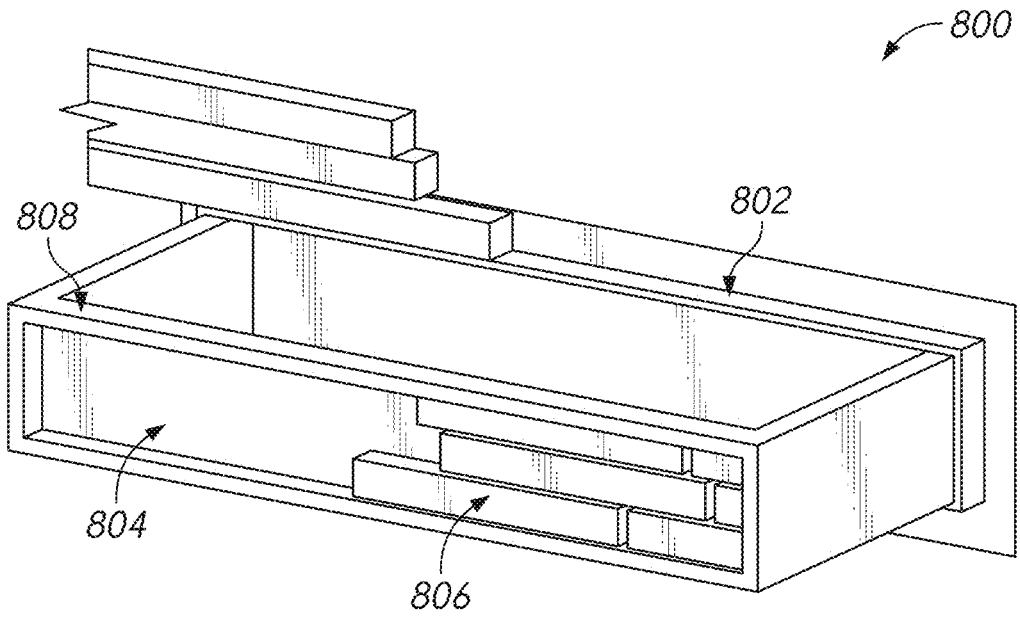
FIG. 9 illustrates an example handle device that has a customizable front and can be stored in the wall of a bathing environment such that the handle is flush with the wall of the bathing environment.

FIG. 9 illustrates an example handle device 800. The handle device 800 can include a pocketed frame 802. The handle device 800 can include a front plate or recessed plate 804 as part of the handle 808 that can accept various custom cut wall finish materials 806 (e.g., tile, stone, etc.). This can enable the front plate 804 of the handle device 800 to have the same appearance as that of the surrounding wall of the building, including bathing, environment, such that the handle device 800 is substantially concealed when in the stored position.

Figure 10:
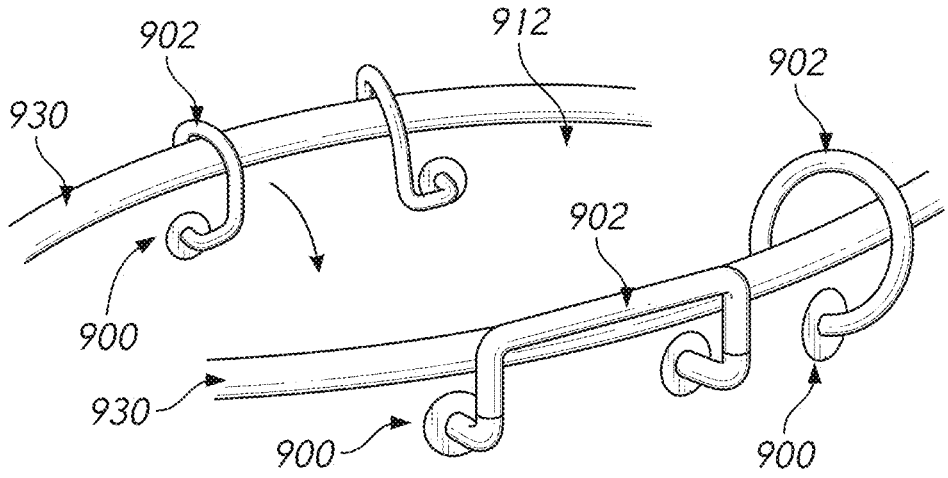
FIG. 10 illustrates example universal handle devices mounted in various positions on a free standing tub.

FIG. 10 illustrates example universal handle devices 900 mounted in various positions on the contoured walls 930 of a free standing tub 912. The universal handle devices 900 can be mounted on surfaces with different contours, enabling handles 902 of varying shapes and configurations to be coupled to one or both sides of the contoured walls 930 of free standing tubs of different configurations. In some embodiments, the universal handle devices 900 are mounted to walls of a building, including bathing, environment.

Figure 11:
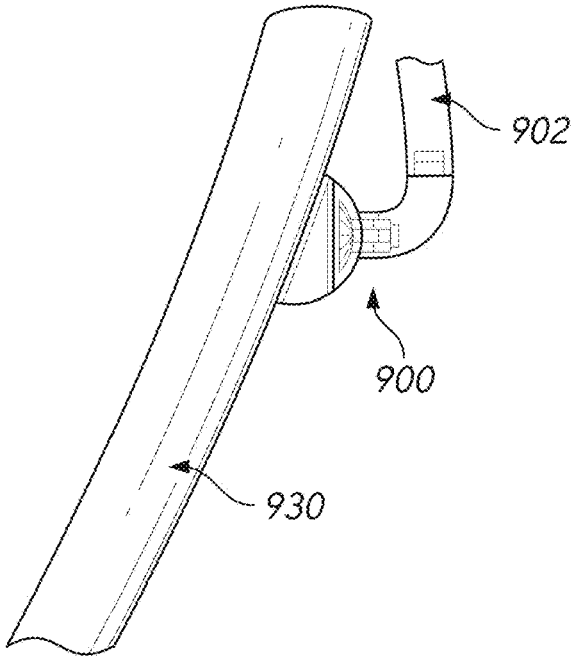
FIG. 11 illustrates an enlarged view of an example universal handle device mounted to the contoured surface of a free standing tube.

FIG. 11 illustrates an enlarged view of the universal handle device 900 mounted on the contoured walls 930 of a free standing tub. The universal handle device 900 can mount to contoured walls 930 of a free standing tub while enabling the handle 902 to extend away at different angles, depending on the desired configuration.

Figure 12:
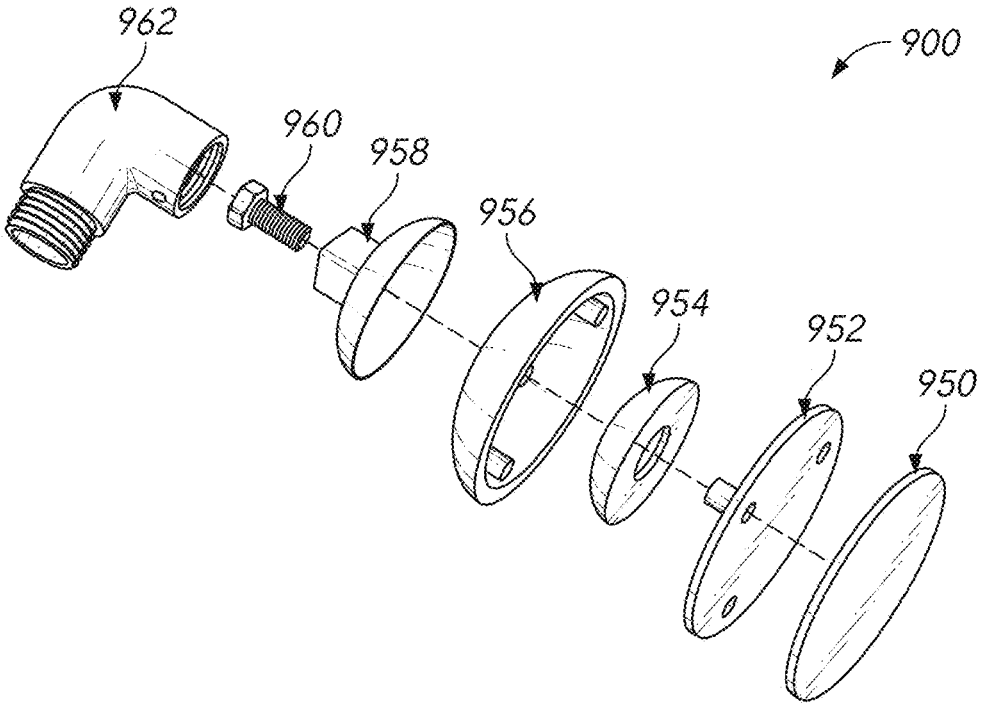
FIG. 12 illustrates an exploded view of the example universal handle device of FIG. 11.
Figure 13:
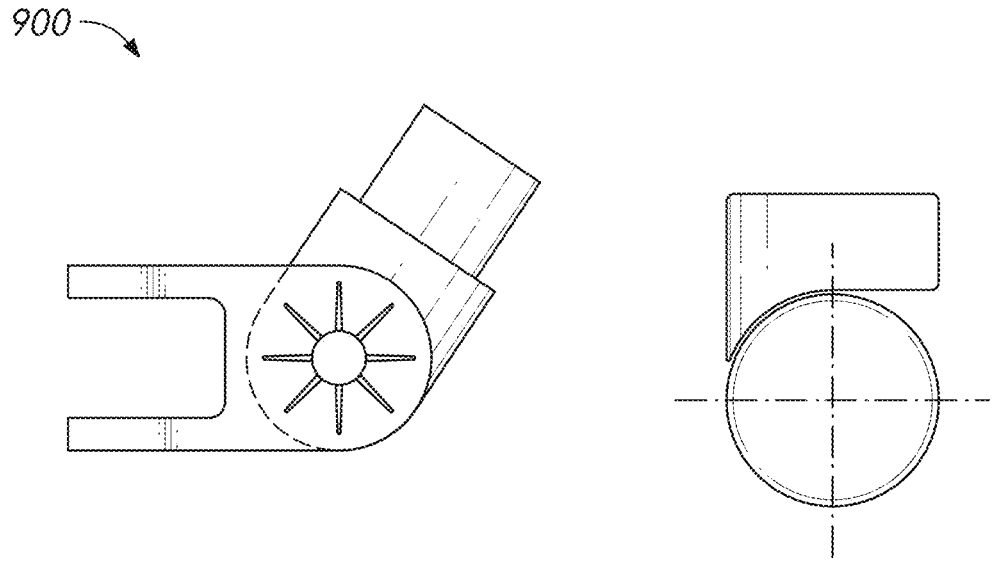
FIG. 13 schematically illustrates the example universal handle device in different configurations.

FIG. 12 illustrates an exploded view of the universal handle device 900. The universal handle device 900 can include an adhesive element 950 (e.g., tape, very high bond (VHB) tape) that enables coupling to the contoured walls 930 of a free standing tub. The universal handle device 900 can include a base plate 952, angle lock 954, top cover 956, angle lock top 958, bolt 960, elbow start 962, and/or other features. The angle lock 954, and/or other features (such as the angle lock top 958), can engage with the bolt 960 to orient the adhesive element 950 to engage the surface of a contoured wall 930 while allowing the elbow start 962 to extend away at a desired orientation. The elbow start 962 can connect to handles of various configurations. FIG. 13 schematically illustrates the universal handle device 900 at different orientations.

Figure 14A:
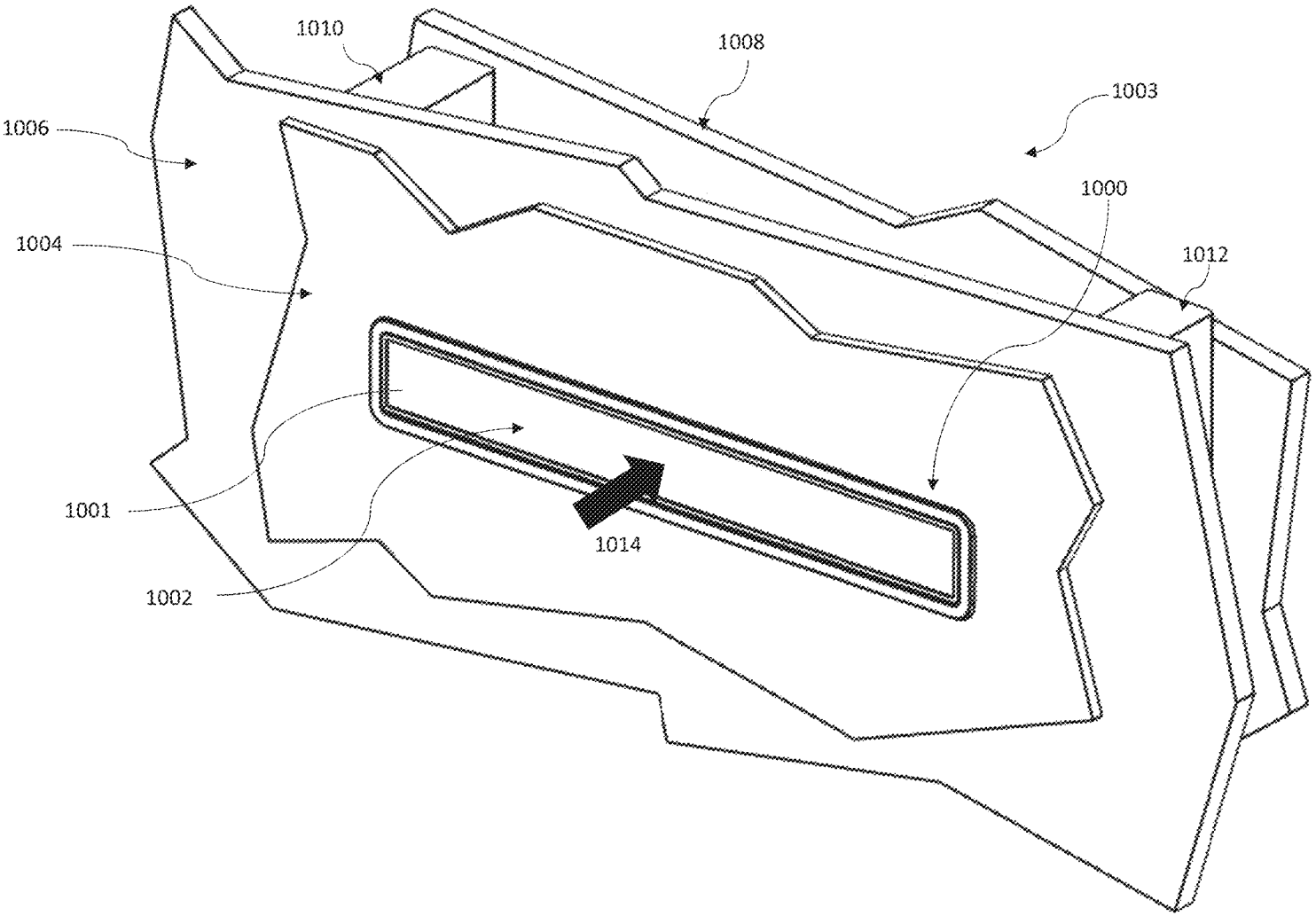
FIG. 14A illustrates an example handle device in a stowed configuration.

FIG. 14A-21C illustrate a handle device 1000, also referred to as a grab bar device, and components thereof. FIG. 14A illustrates the handle device 1000 disposed within a wall 1003. The wall 1003 may be in a building environment, including bathing (e.g., shower, bath, etc.), cooking (e.g., kitchen, etc.), or other environment. The handle device 1000 can be disposed at various orientations, such as vertically, horizontally, etc. In some variants, the handle device 1000 can be disposed with a handle 1002 thereof being perpendicular, parallel, or otherwise angled relative to a floor of the environment.

The handle device 1000 can be suspended between two supports 1010, 1012 of the wall 1003. In some variants, the handle device 1000 can be supported by a single support, such as one of support 1010 or support 1012. The two supports 1010, 1012 can be wall studs, such as a two inch by four inch wall studs.

The handle device 1000 can be disposed between a front wall 1006 and rear wall 1008 of the wall 1003. The front wall 1006 and rear wall 1008 can be drywall, also referred to as plasterboard, sheet rock, wall board, etc. The handle device 1000 can at least partially extend through the front wall 1006 such that a user may contact the handle 1002 of the handle device 1000. An outer layer 1004, such as tile, can overlay the front wall 1006 and be disposed around the handle 1002.

With the handle device 1000 in the stowed configuration, as illustrated in FIG. 14A, an exposed panel 1001, also referred to as exposed surface or front panel, of the handle 1002 can be substantially flush with the outer layer 1004, which can be aesthetically pleasing and/or at least partially disguise or conceal the presence of the handle device 1000 to an observer. For example, when the handle device 1000 is in the stowed configuration, the wall 1003 can have a substantially continuous appearance that appears to be free of handles. In some variants, the exposed panel 1001 can have a similar appearance as the surrounding outer layer 1004, further disguising or concealing the handle device 1000 from view when stowed. In some variants, the exposed panel 1001 can incorporate the same material as the outer layer 1004.

Figure 14B:
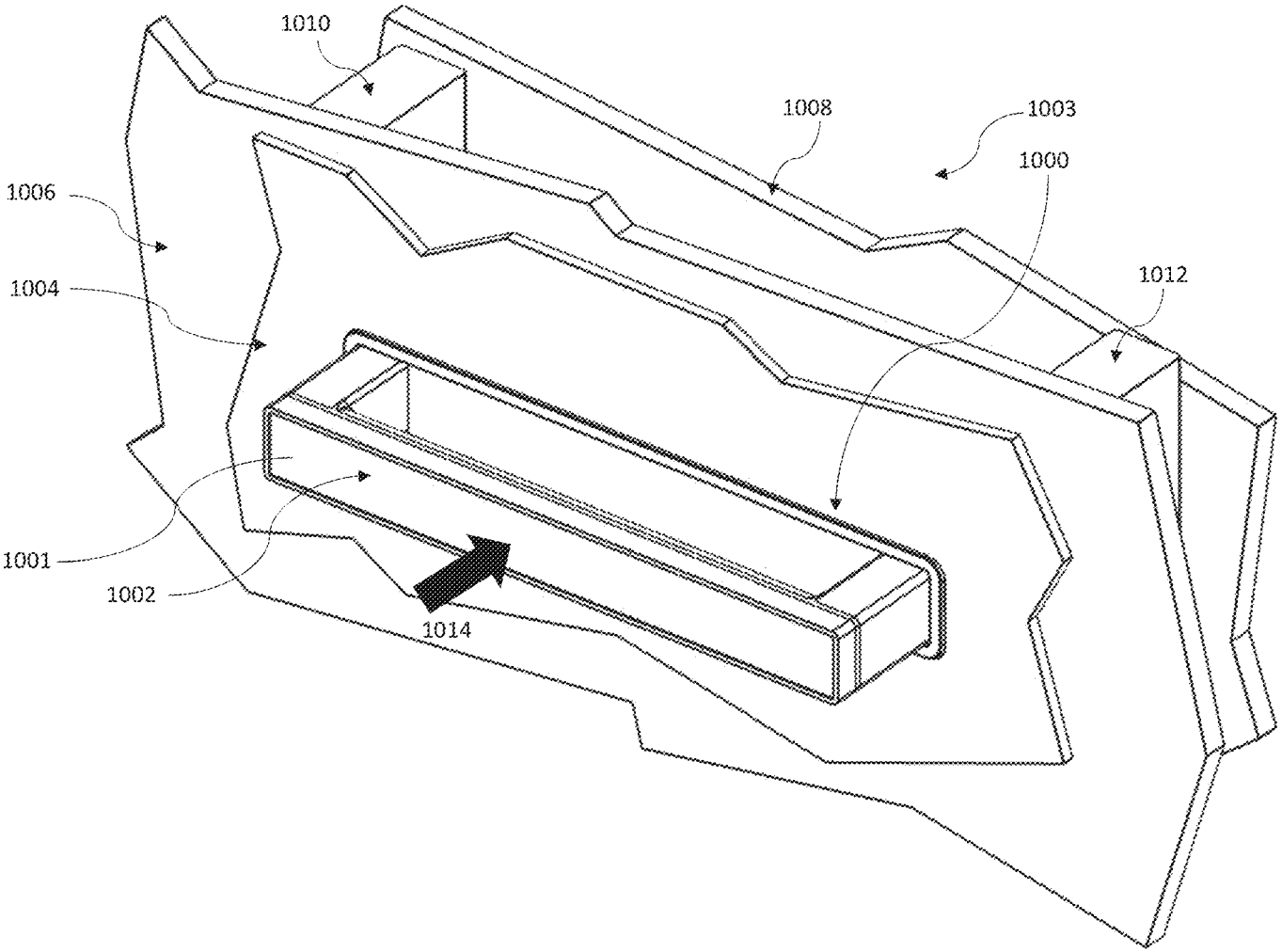
FIG. 14B illustrates the handle device of FIG. 14A in a deployed configuration.

To deploy the handle 1002, the user can push the handle 1002 (i.e., contacting the exposed panel 1001) in the direction of arrow 1014 (e.g., toward the wall 1003, rear wall 1008, etc.), which can release the handle 1002 to deploy from within a cavity, such as within a housing, of the handle device 1000, as illustrated in FIG. 14B. The handle 1002 can automatically deploy after the user pushes in the direction of arrow 1014, which can be facilitated by one or more springs (e.g., constant or continuous force springs). In the deployed configuration, the handle 1002 can be spaced away from the wall 1003, enabling the user to be able to grasp the handle 1002. In the deployed configuration, the handle 1002 can be grasped by the user for increased stability when navigating an environment, such as a slippery bathing or cooking environment. The handle device 1000 may be returned to the stowed configuration, illustrated in FIG. 14A, by pushing the handle 1002 back into the cavity, e.g., housing, of the handle device 1000 (e.g., toward the wall 1003, rear wall 1008, etc.). In some variants, the user must over disengage a locking mechanism and/or overcome the biasing force of one or more springs to move the handle 1002 into the stowed configuration. The handle device 1000 can retain the handle 1002 in the stowed configuration until the user once again pushes the handle 1002 in the direction of arrow 1014, as described in reference to FIG. 14A.

Figure 15A:
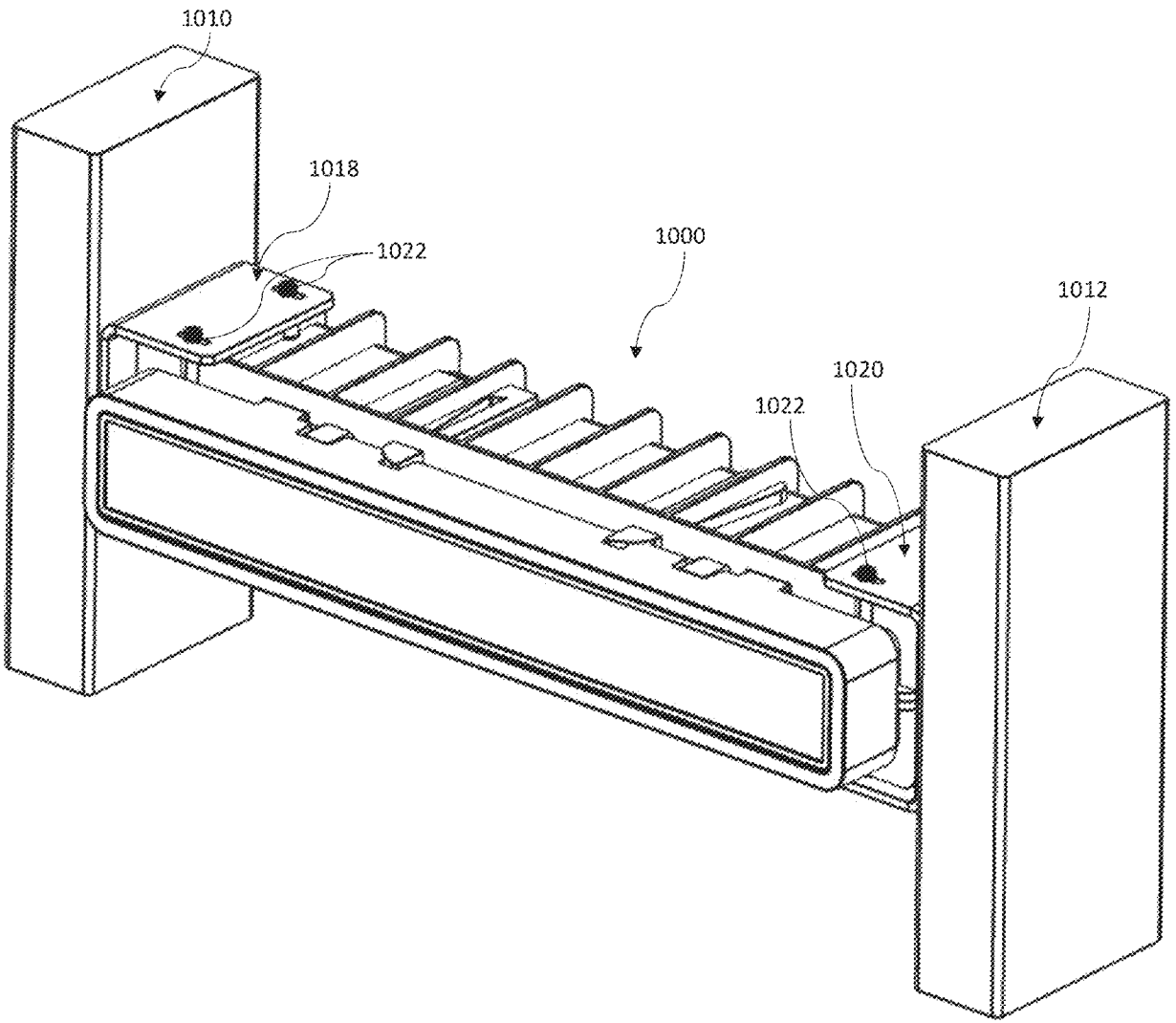
FIG. 15A illustrates the handle device suspended between two supports.

As illustrated in FIG. 15A, the handle device 1000 can be supported between the supports 1010, 1012. Brackets 1018, 1020, also referred to as mounts, can couple the handle device 1000 to the supports 1010, 1012, which can be via bolts, screws, latches, clips, fasteners, and/or other suitable devices. The brackets 1018, 1020 can be C-shaped to receive the handle device 1000 for coupling. The handle device 1000 can be coupled to the brackets 1018, 1020 with one or more bolts 1022, also referred to as screws. In some variants, the handle device 1000 can be coupled to the brackets 1018, 1020 with latches, clips, fasteners, and/or other suitable devices. In some variants, only one bracket is used to couple the handle device 1000 to a support. In some variants, the handle device 1000 can be installed in the wall of an environment, e.g., a bathing environment, with construction of the wall 1003 and/or other structure or object. In some variants, the handle device 100 can be retrofit within the wall 1003 and/or other structure or object. For example, a hole can be cut in the front wall 1006 of the wall 1003, enabling the handle device 1000 to be inserted through the hole and screwed, bolted, fastened, and/or otherwise coupled to one or both of the supports 1010, 1012.

Figure 15B:
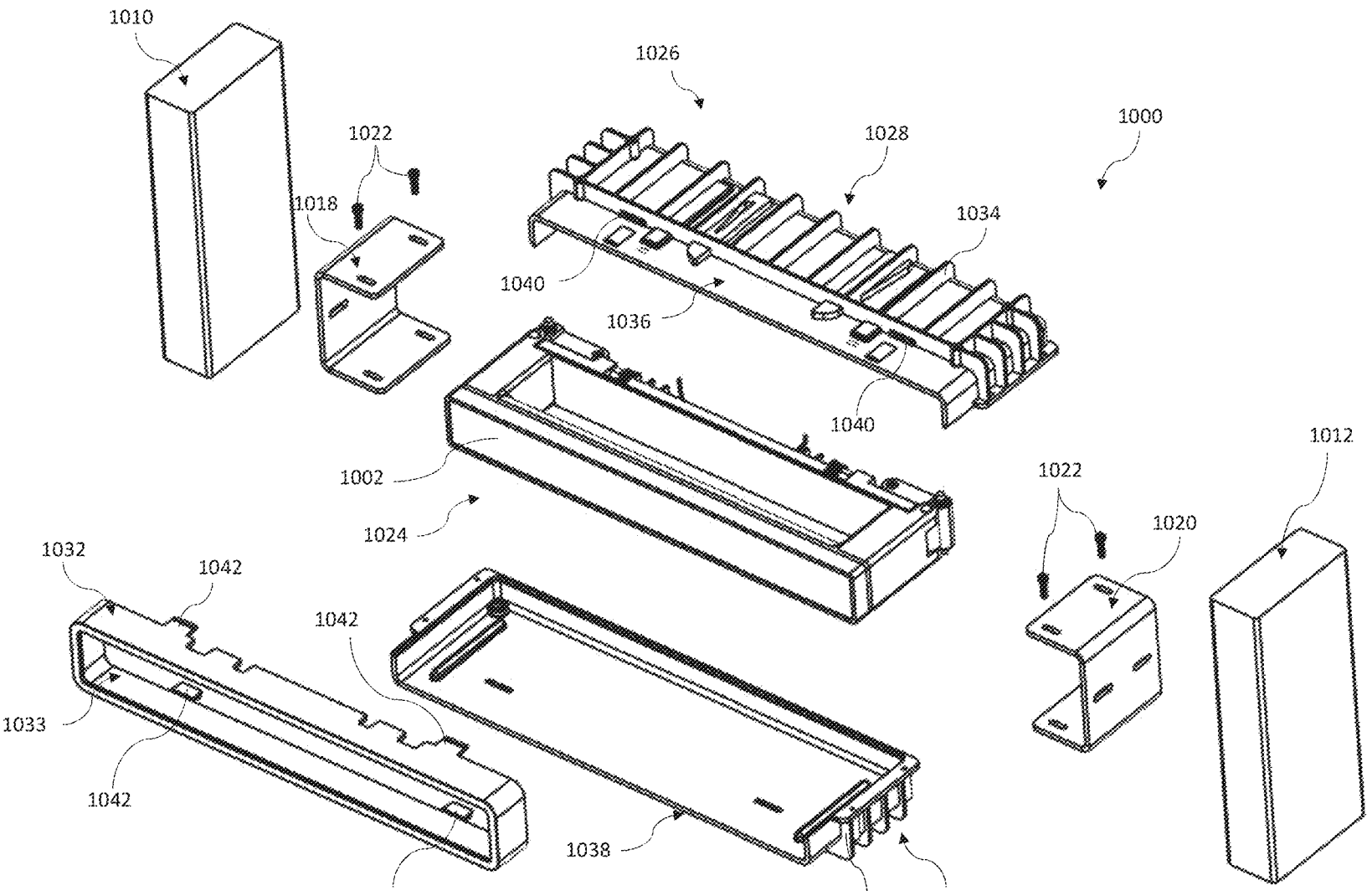
FIG. 15B illustrates an exploded view of the handle device.
Figure 15C:
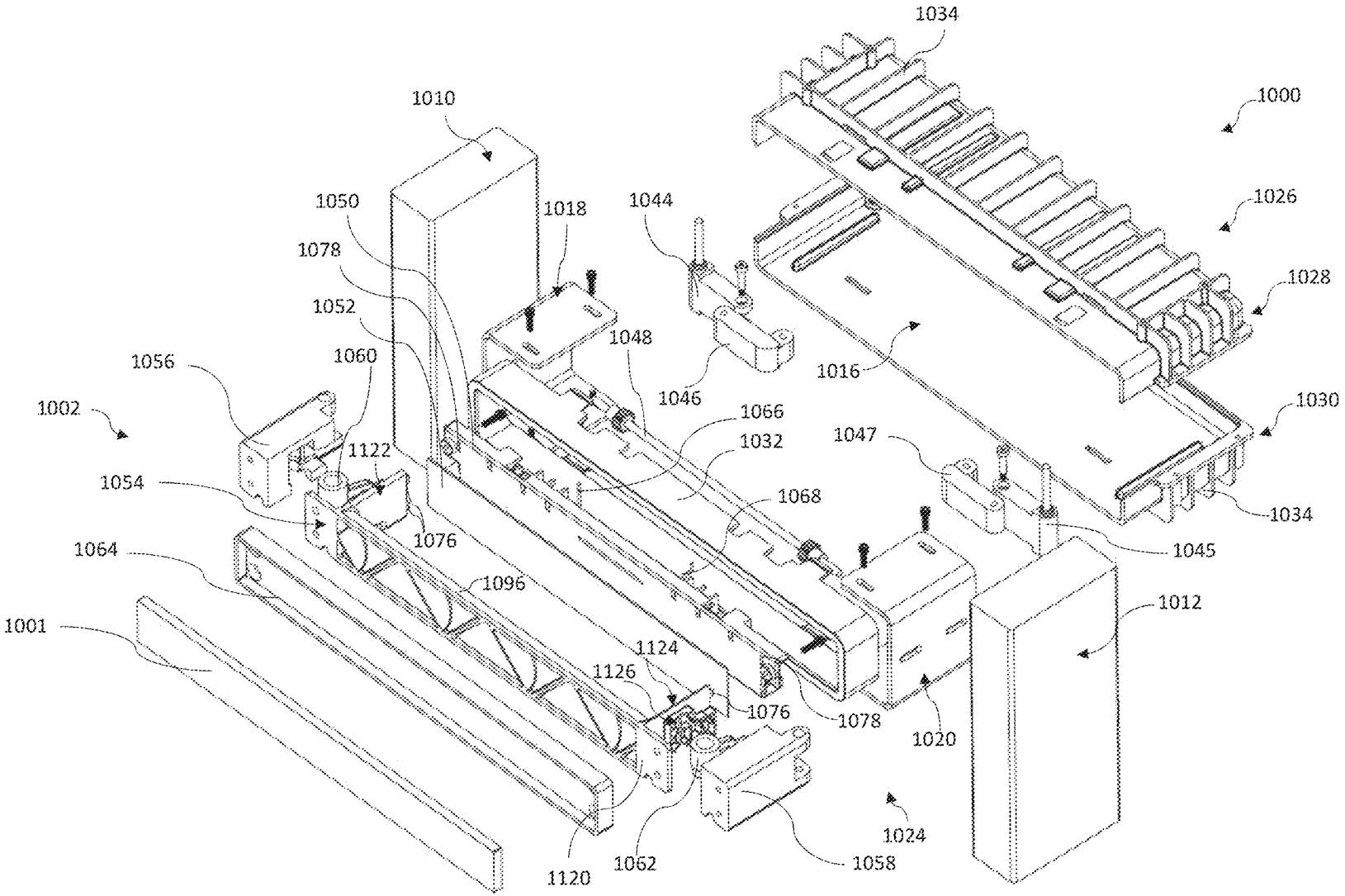
FIG. 15C illustrates an exploded view of the handle device.

FIG. 15B illustrates an exploded view of various components of the handle device 1000. The handle device 1000 can include a handle housing 1026, also referred to as an enclosure or shell. The housing 1026 can define a cavity 1016, as shown in FIG. 15C, to house a handle assembly 1024. The housing 1026 can include an upper housing portion 1028 and lower housing portion 1030 that can be coupled together to form the housing 1026 and cavity 1016. The reference to upper and lower can be used solely to facilitate description and should not be considered limiting. In some variants, the brackets 1018, 1020 can be used to couple the upper housing portion 1028 and lower housing portion 1030 together. The housing 1026 can be various shapes, such as generally a rectangular prism. The housing 1026, i.e., the upper housing portion 1028 and lower housing portion 1030, can include one or more flanges 1034, also referred to as ribs. The one or more flanges 1034 can provide rigidity to the housing 1026.

The handle device 1000 can include a collar 1032, also referred to as a border member. The collar 1032 can define an opening 1033 that provides access into the cavity 1016. The handle 1002 can extend or retract through the opening 1033 when being placed in the deployed or stowed configurations. The collar 1032 can couple to the housing 1026. The collar 1032 can couple to the upper housing portion 1028 and lower housing portion 1030. The collar 1032 can be placed over a lip 1036 of the upper housing portion 1028 and lip 1038 of the lower housing portion 1030. The collar 1032 can include one or more clips 1042, also referred to as fasteners, hooks, or hooked tabs, to couple the collar 1032 to the housing 1026. In some variants, the clips 1042 can extend through one or more openings 1040 disposed on the upper housing portion 1028 and/or lower housing portion 1030 to facilitate coupling. In some variants, the clips 1042 can couple to the upper housing portion 1028 and/or lower housing portion 1030 via a snap fit, press fit, and/or other suitable technique.

The handle device 1000 can include a handle assembly 1024. The handle assembly 1024 can translate within the housing 1026 to deploy or stow the handle 1002. A portion of the handle assembly 1024 can be disposed within the housing 1026 in the deployed configuration while the handle 1002 can extend outside the housing 1026 to be grasped by the user. The handle assembly 1024, and handle device 1000, can include various features to facilitate automatic deployment and stowage of the handle 1002, which can include gears, spring, joints, pivoting members, etc.—as described herein.

FIG. 15C illustrates an exploded view of the handle assembly 1024 with other components of the handle device 1000. The handle assembly 1024, as described herein, can have a handle 1002 (also referred to as a grab bar or bar). The handle 1002 can include a handle frame 1054 (also referred to as a handle support structure). The handle frame 1054 can include a front portion 1120. The front portion 1120 can be substantially flat and/or include features that are substantially flat on a front side. The front portion 1120 can couple to a front panel support 1064, which can be via bolts, screws, fasteners, adhesive, and the like. The front panel support 1064 can receive, which can include couple to, the exposed panel 1001. As described above, the exposed panel 1001 can be similar in appearance and/or material to the surrounding outer layer 1004. In some variants, different exposed panels 1001 can be received within a recess of the front panel support 1064 to match the surrounding outer layer 1004. In some variants, the exposed panel 1001 can be retained, which can include being coupled to, the front panel support 1064 via an adhesive, bonding agent, clips, screws, fasteners, and/or other suitable techniques.

The handle frame 1054 can include a curved surface 1096, which can be on an opposing surface of the handle frame 1054 relative to the front portion 1120. The curved surface 1096 can improve user comfort when grasping the handle 1002. The handle 1002 can include other ergonomic contours to improve user comfort.

The handle frame 1054 can include arms 1122, 1124. The arms 1122, 1124 can extend in a direction away from the front portion 1120. The arms 1122, 1124 can space the handle 1002 away from the housing 1026 in the deployed configuration such that the user can grasp the handle 1002. The arms 1122, 1124 can include one or more tabs 1076 that can be inserted into one or more holes 1078 of a support panel 1050, which can be a press fit, interference fit, etc., as described in more detail elsewhere herein for coupling. The arms 1122, 1124 can respectively include cavities 1126 to at least partially receive lock mechanisms 1060, 1062 in conjunction with lock housing 1056 and/or lock housing 1058, described below. The arms 1122, 1124 can enclose the lock mechanisms 1060, 1062, respectively, in the lock housings 1056, 1058.

The handle 1002 can include a lock housing 1056 and/or lock housing 1058. In some variants, the handle 1002 only includes one lock housing. The lock housing 1056 and/or lock housing 1058 can be coupled to the handle frame 1054, which can include the arms 1122, 1124 of the handle frame 1054. The lock housings 1056, 1058 can define sides of the handle 1002. The lock housings 1056, 1058 can respectively receive a lock mechanism 1060 and lock mechanism 1062, which can be in conjunction with the cavities 1126 of the arms 1122, 1124. The locking mechanisms 1060, 1062 can selectively retain the handle 1002 in the deployed position, as described herein. The lock mechanisms 1060, 1062 can automatically retain the handle 1002 in the deployed position and be selectively actuated to enable the handle 1002 to be placed in the stowed position, as described herein.

The handle assembly 1024 can include a support panel 1050. The support panel 1050, also referred to as the support structure, back member, or back wall, can couple to the handle frame 1054 and/or lock housings 1056, 1058. For example, the handle frame 1054 can include one or more tabs 1076 that can be inserted into one or more holes 1078 of the support panel 1050, which can be a press fit, interference fit, etc. The support panel 1050 can be coupled to the lock housings 1056, 1058 via bolts, screws, fasteners, or the like. This can enable translation of the handle 1002 and support panel 1050 together.

The support panel 1050 can support a gear rod 1048, also referred to as a shaft or axle, which can assist the handle 1002 in proper deployment (e.g., deploy substantially straight out of the housing 1026 and/or smooth deployment as well a straight and smooth movement into the stowed position), as described herein. The gear rod 1048 can help the handle 1002 to smoothly deploy from the housing 1026, which can include deploying substantially straight. The gear rod 1048 can include gears that can engage with features of the upper housing portion 1028, such as gear racks, to facilitate smooth, straight, and/or even deployment or stowage, as described herein.

The support panel 1050 can include a lock spring that enables the handle 1002 to be stowed upon the user pushing the handle 1002 into the housing 1026 from the deployed position and free to deploy upon pushing the handle 1002 into the housing 1026 from the stowed position, as described herein. The lock spring can include a lock spring arm 1066 and/or lock spring arm 1068, also referred to as spring arms. In some variants, the lock spring arm 1066 and lock spring arm 1068 are joined or separate. The lock spring arm 1066 and lock spring arm 1068 can engage with features of the upper housing portion 1028, e.g., guide channels, to facilitate the push-to-lock and push-to-release functions described herein.

A back panel 1052 can be coupled to the support panel 1050. The panel 1052 can be exposed when the handle device 1000 is in the deployed configuration. In some variants, the panel 1052 can have an appearance similar to the exposed panel 1001 or outer layer 1004. The panel 1052 can protect the support panel 1050. In some variants, the panel 1052 can be flush with the surrounding outer layer 1004 when the handle device 1000 is in the deployed configuration.

The handle assembly 1024 can include links, also referred to as scissor links, members, supports, struts, etc., that can expand or collapse upon deployment or stowage of the handle 1002. The links can include a first link 1044, second link 1046, first link 1045, and second link 1047. The first link 1044 and first link 1045 can be rotatably coupled to the housing 1026, such as the upper housing portion 1028 and the lower housing portion 1030. The second link 1046 can be rotatably coupled to the first link 1044 and the lock housing 1056. The second link 1047 can be rotatably coupled to the first link 1045 and the lock housing 1058. As described herein, movement of the handle 1002 can correspond to the collapsing and expansion of the first link 1044, second link 1046, first link 1045, and second link 1047. The links can increase structural stability of the handle assembly 1024 with deployment and stowage.

Figure 15D:
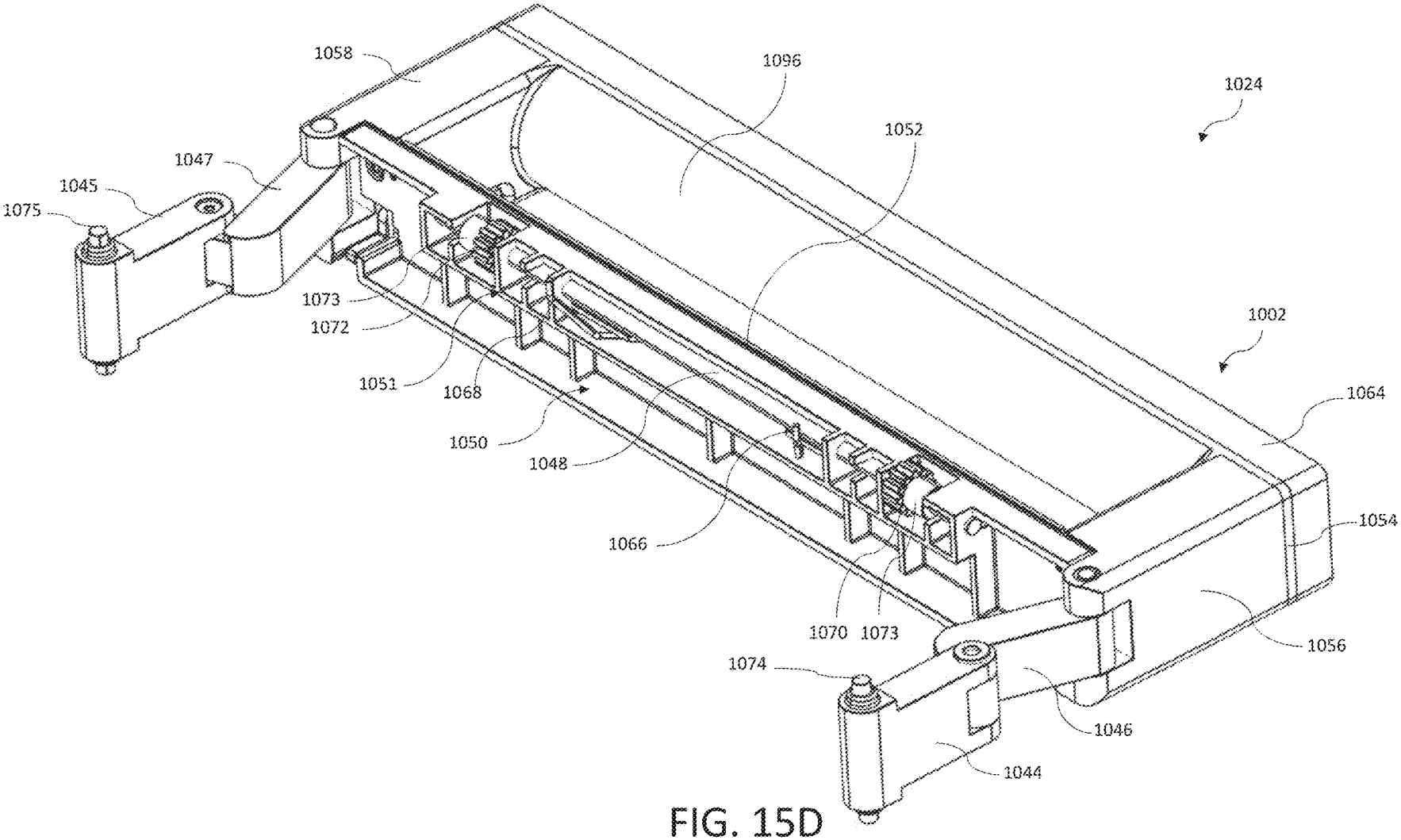
FIG. 15D illustrates an example handle assembly.

FIG. 15D illustrates an assembled handle assembly 1024. The support panel 1050 can support the gear rod 1048 via one or more support flanges 1051 connected to, integrated, or formed with the support panel 1050; the support flanges can also be referred to as walls or structures. The gear rod 1048 can include one or more gears, such as the gears 1070, 1072. In some variants, the one or more support flanges 1051 can maintain the position of the gear rod 1048 and/or gears 1070, 1072. In some variants, the gear rod 1048 is rotatably fixed and the gears 1070, 1072 rotate independently thereon (e.g., the gears 1070, 1072 rotate about the gear rod 1048 with the gear rod 1048 being a central axis of rotation as the gear rod 1048 remains relatively fixed while the gears 1070, 1072 rotate). In some variants, the gear rod 1048 rotates with the gears 1070, 1072 such that the rotation of the gears 1070, 1072 is the same. In some variants, the gears 1070, 1072 can be formed with and/or be integral with the gear rod 1048 (e.g., the gears 1070, 1072 and gear rod 1048 can be formed from a monolithic piece of material). In some variants, the gears 1070, 1072 can be fixed to, connect with, mate with, and/or engage with the gear rod 1048. The gears 1070, 1072 can be slid and/or positioned onto the gear rod 1048. The gear rod 1048 can have one or more engagement features such flat, concave, and/or convex surfaces with the gears 1070, 1072 having corresponding engagement features, (e.g., corresponding surfaces) such that when the gears 1070, 1072 are positioned onto the gear rod 1048, the gears 1070, 1072 are fixed relative to the gear rod 1048 (e.g., the gears 1070, 1072 are radially fixed to fixedly rotate with the gear rod 1048). In some variants, the gears 1070, 1072 and the gear rod 1048 can have corresponding protrusion and detents that engage one another when the gears 1070, 1072 are positioned onto the gear rod 1048.

The gears 1070, 1072 can be fixed onto the gear rod 1048 via one or more washers, nuts, and/or crimpers 1073. The crimpers 1073 can be slid and/or positioned onto the gear rod 1048. The crimpers 1073 can be crimped and/or deformed onto the gear rod 1048 to fix the gears 1070, 1072 onto the gear rod 1048. The crimpers 1073 and the gear rod 1048 can have corresponding engagement features (e.g., flat surfaces and/or protrusion and detents) to axially and/or radially fix the crimpers 1073 relative to the gear rod 1048. The gears 1070, 1072 can be positioned against a relatively thicker or larger radius central portion of the gear rod 1048 against which the crimpers 1073 press and/or positioned the gears 1070, 1072 such that the gears 1070, 1072 are axially fixed onto the gear rod 1048 between the central portion of the gear rod 1048 and the crimpers 1073 while being radially fixed onto gear rod 1048 via the engagement features as discussed herein.

Figure 16A:
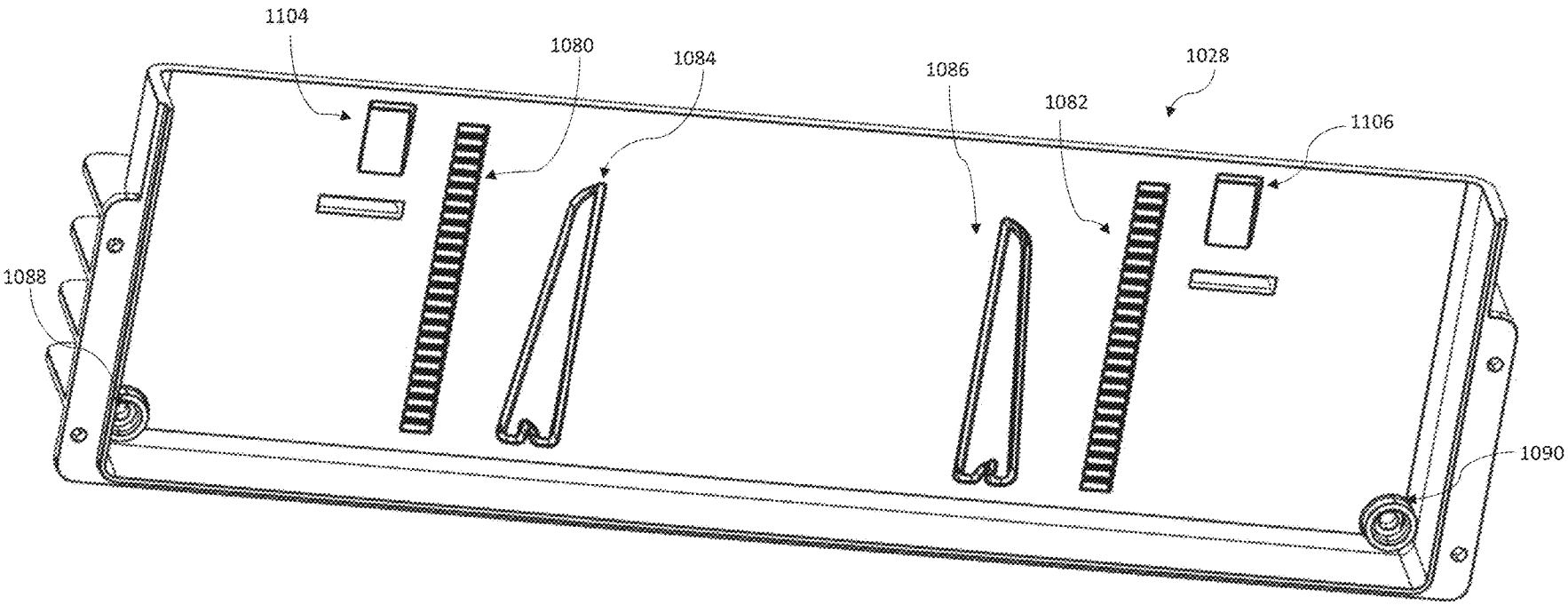
FIG. 16A illustrates an example upper housing portion.

The gears 1070, 1072 can engage with one or more gear racks 1080, 1082 (also referred to as gear tracks), as shown in FIG. 16A, disposed in the upper housing portion 1028, as described herein. The gears 1070, 1072 can rotate from engagement with the one or more gear racks 1080, 1082, respectively, as the handle assembly 1024 is translated relative to the upper housing portion 1028 during deployment or stowage of the handle 1002.

The engagement between the gears 1070, 1072 and gear racks 1080, 1082 can assist in straight and/or smooth deployment of the handle 1002. For example, if the user applies a force on the handle 1002 that is not perpendicular to the longitudinal length of the handle 1002 and/or the constant force springs 1108, 1110 (described in more detail herein) or applies a force that is not centered on the handle 1002, the user may apply unequal biasing forces on the handle assembly 1024. In stowing the handle 1002, the user can push on the handle 1002 as discussed herein. In some instances, the user may apply a force on the handle 1002 that acts on the handle 1002 to deviate the handle 1002 from translating directly and/or straightly into the housing 1026, e.g., pushing on a portion of the handle 1002 proximate to one of the lateral sides of the housing 1026 relative to the other later side of the housing 1026, which may cause forces at least partially in the direction of one of the lateral sides of the housing 1026. The application of such a force, without the engagement between the gears 1070, 1072 and gear racks 1080, 1082, can cause the handle assembly 1024 to become askew or deviate from its path of travel between the deployed and stowed configuration as discussed herein, which may cause the handle assembly 1024 to push against one of the surfaces of the housing 1026 and/or other surfaces handle device 1000 as discussed herein, which can result in increased friction and slower stowage, binding, or even break components of the handle assembly 1024.

Similarly, the biasing forces of the constant force springs 1108, 1110 may be unequal in some instances. The engagement between the gears 1070, 1072 and gear racks 1080, 1082 can prevent and/or at least reduce twisting or rotation of the handle assembly 1024 due to imbalanced biasing forces of the constant force springs 1108, 1110—helping the handle 1002 to deploy substantially straight out of the housing 1026.

The engagement between the gears 1070, 1072 and gear racks 1080, 1082 (discussed in further detail herein) can reduce such negative effects by controlling movement of the handle assembly 1024 straight in and out of the housing 1026. In some variants, the gears 1070, 1072 can be fixedly coupled to the gear rod 1048 such that the gears 1070, 1072 rotate in unison (e.g., at the same rate of rotation, together, at the same speed, etc.) to reduce and/or eliminate movement of the handle assembly 1024 in other directions other than translating straight in or out of the housing 1026 that may otherwise occur with the user pushing on the handle 1002 and/or unequal biasing forces from the constant force springs 1108, 1110. For example, as one of the gears 1070 rotates and linearly travels/translates along one of the corresponding gear rack 1080, the other gear 1072 will rotate at the same rate via the fixed connection to the gear rod 1048.

The other gear 1072 will then travel/translate along the other corresponding gear rack 1082 substantially the same distance or extent to cause the other corresponding gear rack 1082 to linearly translate or move along the direction of movement at the same rate as the corresponding gear rack 1080 to cause the handle assembly 1024 to linearly translate in a straight and/or non-skewed direction relative to the housing 1026 (e.g., sides and/or surfaces of the handle assembly 1024 remain at substantially same distances relative to corresponding sides and/or surfaces of the housing 1026 that are moving relative to the each parallel to the direction of travel of the handle assembly 1024 between the stowed and deployed configurations) for smooth and straight movement as discussed herein.

The support panel 1050 can include lock spring arms 1066, 1068. The lock spring arms 1066, 1068 can respectively engage with guide channels 1084, 1086, as shown in FIGS. 16A and 18A-18F-2. The lock spring arms 1066, 1068 can move within the guide channels 1084, 1086, also referred to as guide grooves, as the handle 1002 is moved between the stowed and deployed configurations. The lock spring arms 1066, 1068 can enable the handle 1002 to be retained in the stowed configuration from the deployed configuration by pushing the handle 1002 into the housing 1026. The lock spring arms 1066, 1068 can enable the handle 1002 to move to the deployed configuration from the stowed configuration by the user pushing the handle 1002 into the housing 1026 and releasing. Further details regarding the lock spring arms 1066, 1068 are described in reference to FIGS. and 18A-18F-2.

FIG. 15D illustrates the first link 1044, second link 1046, first link 1045, and second link 1047 in an expanded configuration. As illustrated, the first link 1044 and first link 1045 can be coupled to a pin 1074 and pin 1075, respectively. The pin 1074 and pin 1075 can engage with the housing 1026 such that the first link 1044, second link 1046, first link 1045, and second link 1047 move between an expanded and collapsed configuration upon movement of the handle 1002. Specifically, the pin 1074 can rotatably engage with retainer 1088 of the upper housing portion 1028, illustrated in FIG. 16A, and the retainer 1092 of the lower housing portion 1030, illustrated in FIG. 19 (e.g., the pin 1074 can be inserted into the retainer 1088 and retainer 1092). The pin 1075 can rotatably engage with the retainer 1090 of the upper housing portion 1028, illustrated in FIG. 16A, and the retainer 1094 of the lower housing portion 1030, illustrated in FIG. 19 (e.g., the pin 1075 can be inserted into the retainer 1090 and retainer 1094).

FIG. 16A illustrates the upper housing portion 1028. As described herein, the upper housing portion 1028 can include the guide channels 1084, 1086. The guide channel 1084 and guide channel 1086 can be in mirrored configurations relative to each other. As described, the ends of the lock spring arm 1066 and lock spring arm 1068 can, respectively, move within the guide channels 1084, 1086. The guide channels 1084, 1086 can be formed within the upper housing portion 1028. The guide channels 1084, 1086 can also be referred to as grooves. The guide channels 1084, 1086 can include one or more contours to control the stowage and deployment of the handle 1002, as described in reference to FIGS. 18A-18F-2.

The upper housing portion 1028 can include a gear rack 1080 and a gear rack 1082. The gear racks 1080, 1082 can engage with the gears 1070, 1072 during translation of the handle 1002, which can assist in smooth and/or straight deployment and stowage. The gear racks 1080, 1082 can be formed in the upper housing portion 1028. The teeth of the gear racks 1080, 1082 can correspond to (e.g., mesh with) teeth of the gears 1070, 1072. In some variants, a single gear rack and gear is included in the handled device 1000. In some variants, the gear racks 1080, 1082 and/or guide channels 1084, 1086 can be disposed on the upper housing portion 1028 to avoid and/or reduce moisture (e.g., liquid from a bathing or cooking environment) gathering therein. The gear racks 1080, 1082 and/or guide channels 1084, 1086 can be disposed on the upper housing portion 1028 to avoid and/or reduce issues with mold or mildew that may otherwise develop if positioned on the lower housing portion 1030.

The upper housing portion 1028 can include retainers 1088, 1090. As described, the retainers 1088, 1090 can receive the pins 1074, 1075—rotatably coupling the first link 1044 and first link 1045 to the upper housing portion 1028. The retainers 1088, 1090 can be annular structures protruding from the upper housing portion 1028. The retainers 1088, 1090 can be formed in the upper housing portion 1028.

Figure 16B:
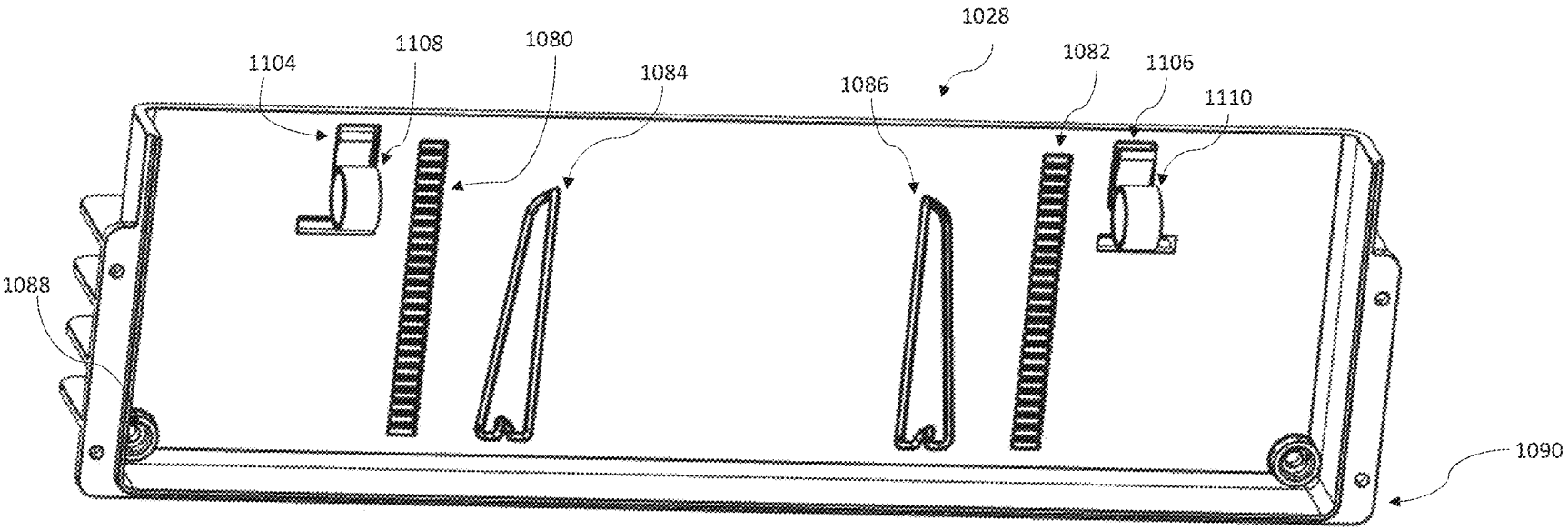
FIG. 16B illustrates an example upper housing portion with constant force springs.
Figure 16C:
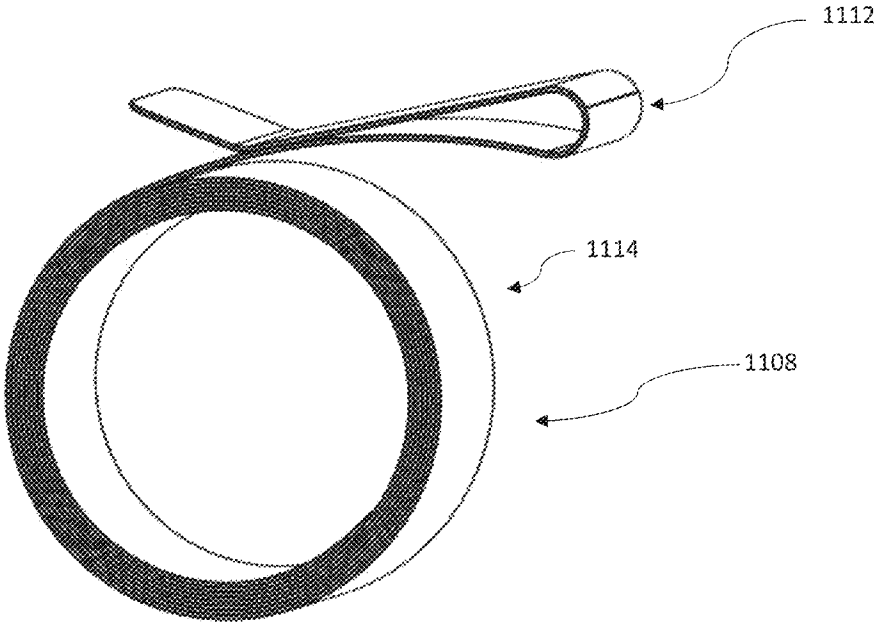
FIG. 16C illustrates an example constant force spring.

The upper housing portion 1028 can include a recessed opening 1104 and/or recessed opening 1106. The recessed openings 1104, 1106 can interface with constant force springs 1108, 1110 (also referred to as continuous force springs or springs), illustrated in FIGS. 16B and 16C, that are configured to bias the handle device 1000 to the deployed configuration. The constant force springs 1108, 1110 can apply a substantially constant force biasing the handle 1002 to the deployed position. As illustrated in FIG. 16C, the constant force spring 1108 can include a clip 1112 that enables the constant force spring 1108 to clip onto the upper housing portion 1028 via the recessed opening 1104, as illustrated in FIG. 16B. Returning to FIG. 16C, the constant force spring 1108 can include a coil 1114 that uncoils as the handle device 1000 is moved to the stowed configuration and recoils as the handle device 1000 is moved to the deployed configuration. For example, the coil 1114 can be moved by engagement with the support panel 1050, causing uncoiling and coiling. The constant force spring 1110 can be the same or similar to the constant force spring 1108. In some variants, the handle device 1000 can include a single spring (e.g., constant force spring) that biases the handle device 1000 toward the deployed configuration. The single spring can be centrally positioned on the upper housing portion 1028 (e.g., positioned equidistantly between lateral sides of the upper housing portion 1028). The central position of the single spring can apply a centrally located biasing force, which can enable the handle 1002 to smoothly (e.g., avoid binding) and straightly move to the deployed configuration.

Figure 17A:
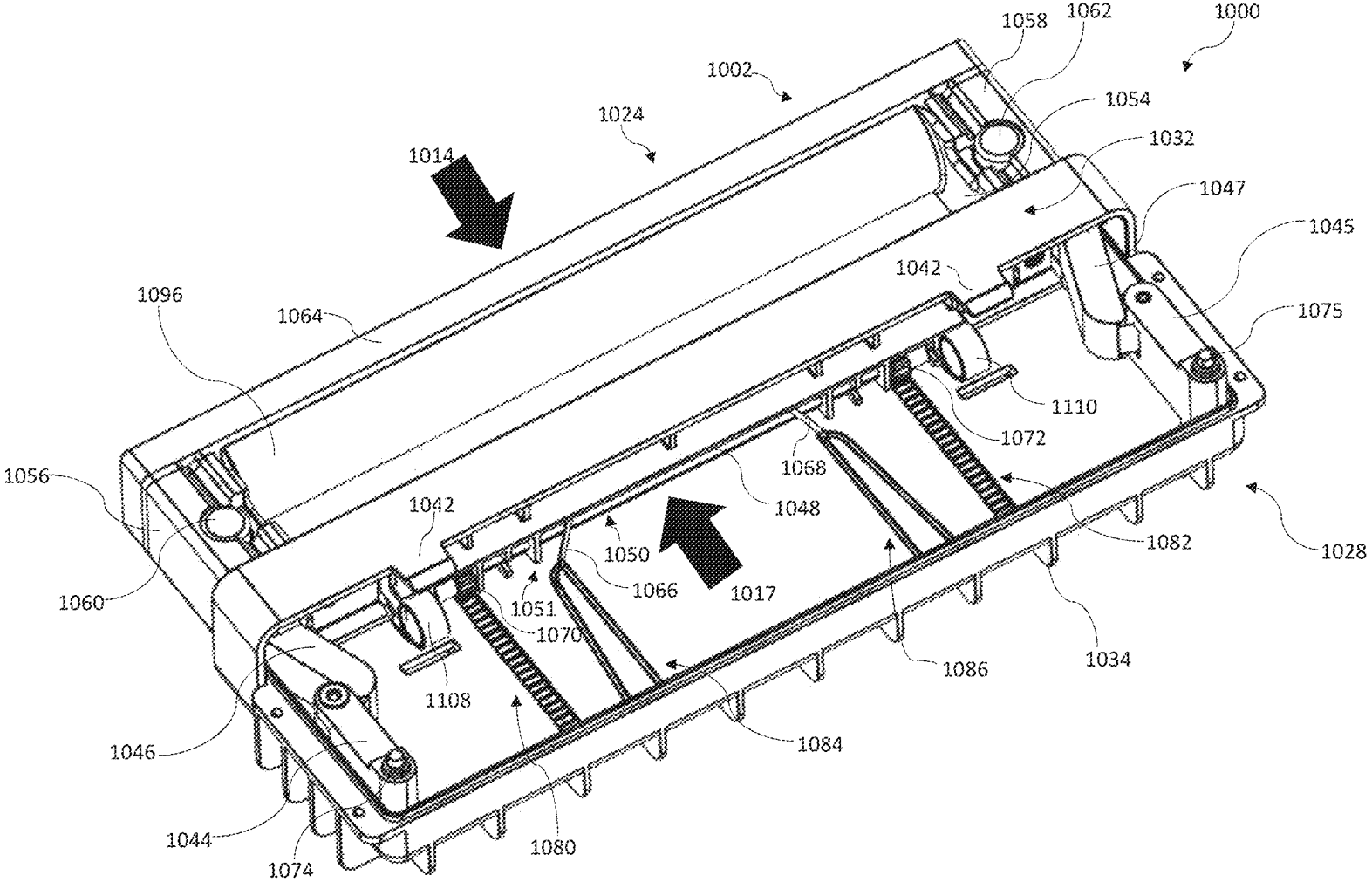
FIG. 17A illustrates the handle device in a deployed configuration.
Figure 17B:
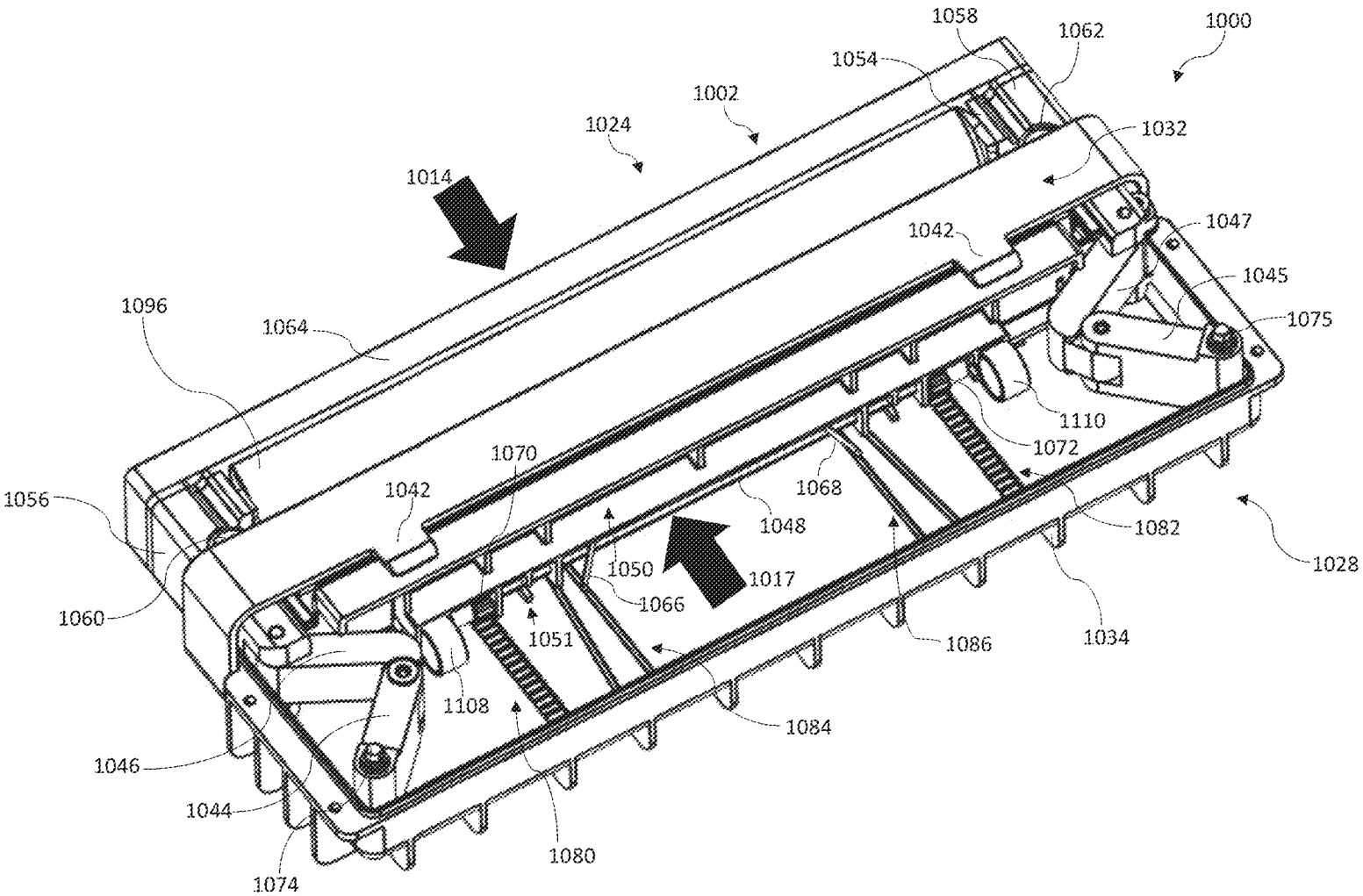
FIG. 17B illustrates the handle device in a transitional configuration.
Figure 17C:
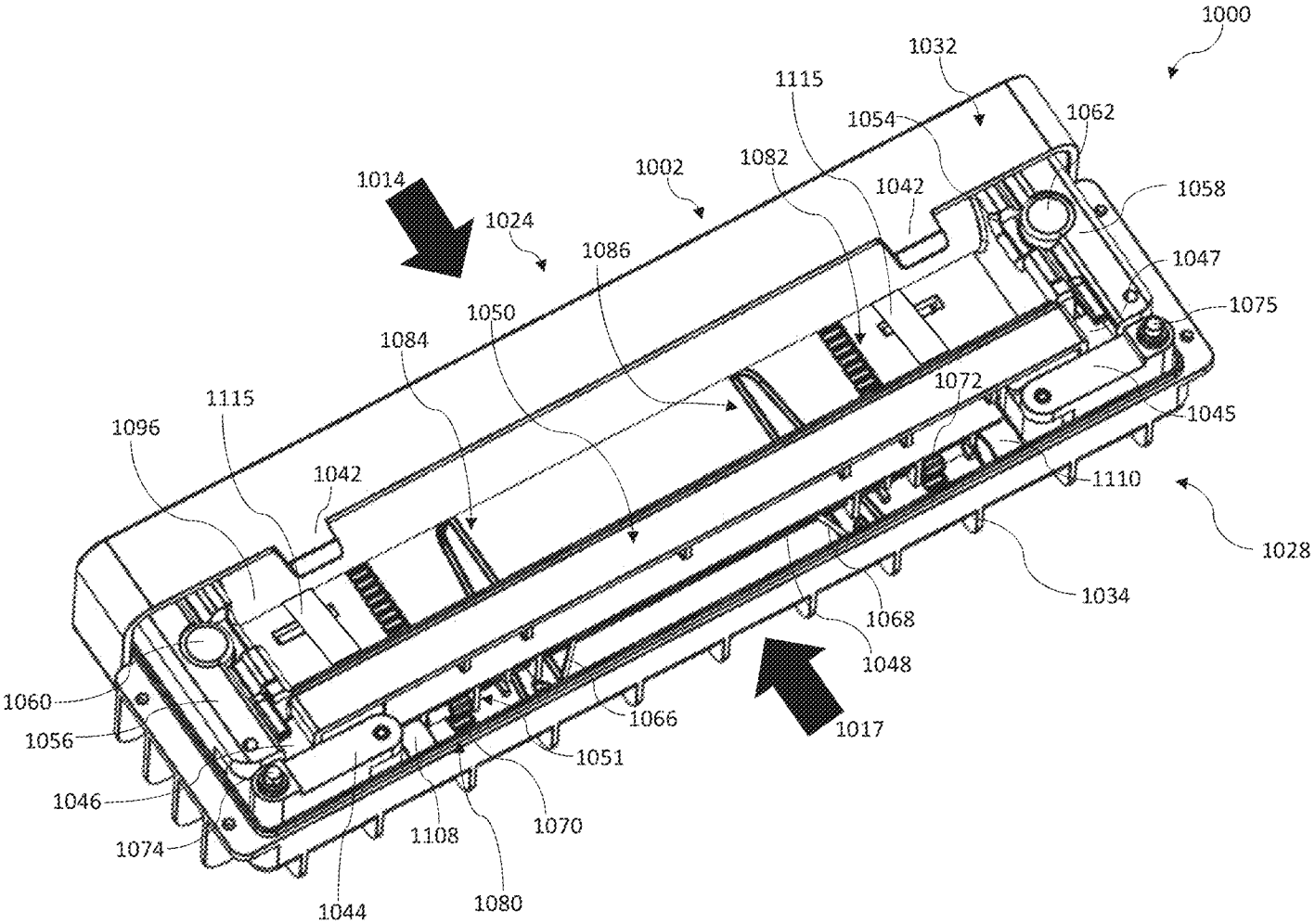
FIG. 17C illustrates the handle device in a stowed configuration.

FIGS. 17A-17C illustrate the handle device 1000 in various configurations during use. For descriptive and illustrative purposes, the lower housing portion 1030 has been removed in FIGS. 17A-17C.

FIG. 17A illustrates the handle device 1000 in the deployed configuration with the handle 1002 extending outside of the housing 1026. The coils 1114 of the constant force springs 1108, 1110 can contact the support panel 1050 to apply a force, such as a constant force, in the direction of arrow 1017 which can bias the handle device 1000 toward the deployed configuration. The first link 1044, second link 1046, first link 1045, and second link 1047 can be in an extended position to provide structural support to the handle 1002.

To stow the handle 1002, the user can actuate the lock mechanisms 1060, 1062, described in detail in reference to FIGS. 20A-21C, freeing movement of the handle 1002 in the direction of arrow 101, and apply a force, e.g., push force, to the handle 1002 in the direction of arrow 1014, which can include overcoming the force applied by the constant force springs 1108, 1110 in the direction of arrow 1017. The application of the force in the direction of arrow 1014 can cause movement of the handle 1002 and handle assembly 1024 in the direction of arrow 1014.

Figure 17D:
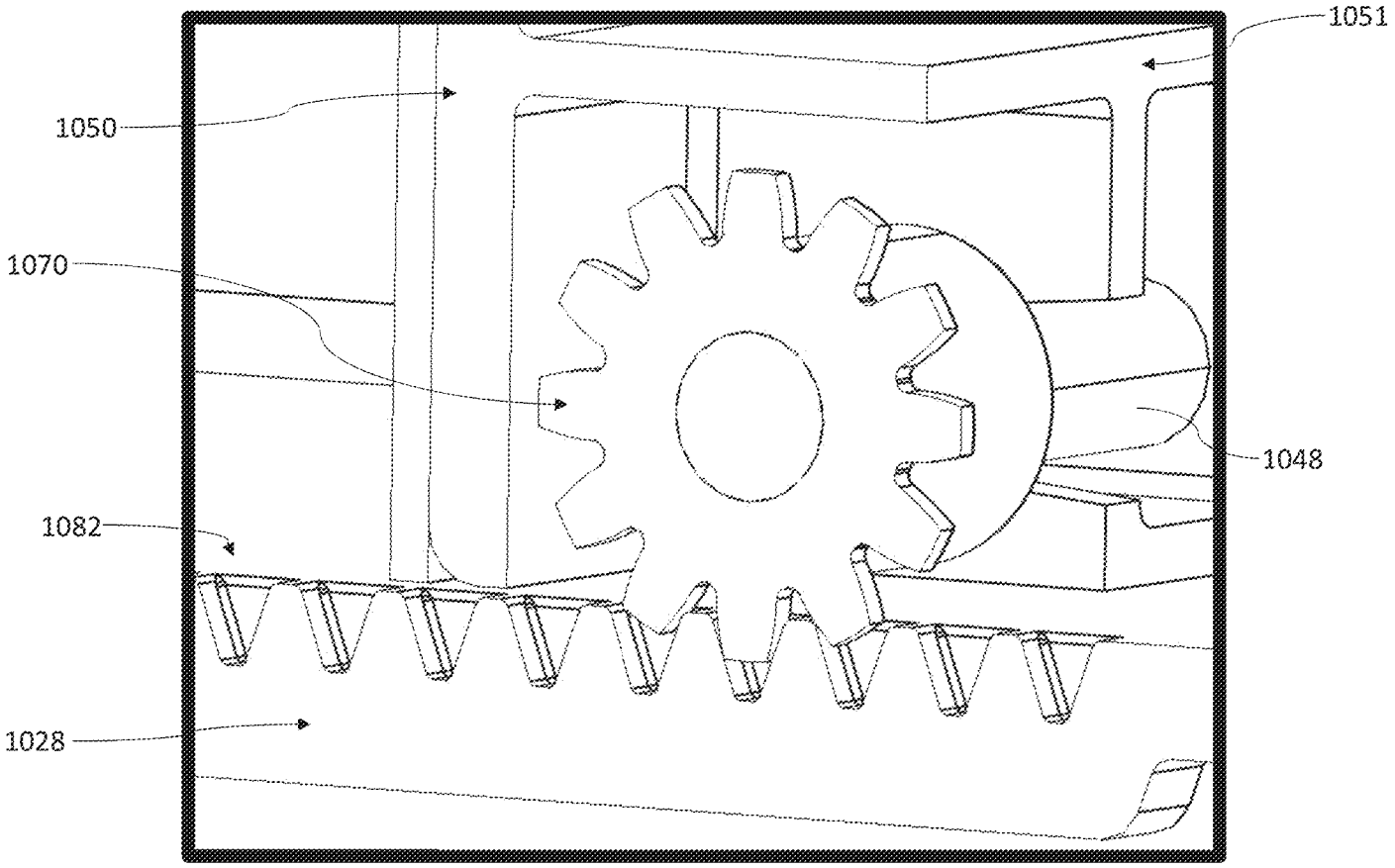
FIG. 17D illustrates a gear and gear rack.

FIG. 17B illustrates the handle device 1000 in a transitional configuration between the deployed configuration, illustrated in FIG. 17A, and the stowed configuration, illustrated in FIG. 17C. As illustrated in FIG. 17B, the gears 1070, 1072 can be meshed with the gear racks 1080, 1082 during translation of the handle 1002 and handle assembly 1024 as shown in FIG. 17D, which can assist in providing smooth and/or straight deployment and stowage of the handle 1002 as described herein. The engagement between the gears 1070, 1072 and gear racks 1080, 1082 can prevent or at least reduce twisting or rotation of the handle assembly 1024 that may otherwise occur if the user applies a force that deviates from directly into the housing 1026, e.g., pushing the handle 1002 at least partially in the direction of one of the lateral sides of the housing 1026. As described herein, the gears 1070, 1072 can rotate in unison, which may be due to being fixedly coupled to the gear rod 1048, to facilitate substantially straight deployment in and out of the housing 1026.

Returning to FIG. 17B, the ends of the lock spring arms 1066, 1068 can move within the guide channels 1084, 1086 during translation of the handle 1002 and handle assembly 1024, as described in more detail in reference to FIGS. 18A-18F-2. The first link 1045 and second link 1047 can begin to collapse as the handle 1002 is pushed in the direction of arrow 1014. The first link 1044 and second link 1047 can begin to collapse as the handle 1002 is pushed in the direction of arrow 1014. The support panel 1050 can translate with the handle 1002 as the handle 1002 is pushed in the direction of the arrow 1014. The support panel 1050 can remain engaged with the coils 1114 of the constant force springs 1108, 1110 during movement thereof while the clips 1112 of the constant force springs 1108, 1110 remain coupled to the upper housing portion 1028 at the recessed openings 1104, 1106, which can cause the coils 1114 to uncoil to provide or maintain a force, such as a constant force, in the direction of arrow 1017.

FIG. 17C illustrates the handle device 1000 in the stowed configuration with the handle 1002 disposed inside the housing 1026. The support panel 1050, which can move with the handle 1002, can be disposed proximate the rear wall of the upper housing portion 1028 moving the coils 1114 of the constant force springs 1108, 1110 therewith, which can result in further uncoiling of the constant force springs 1108, 1110 as shown by the uncoiled portions 1115 of the constant force springs 1108, 1110. The constant force springs 1108, 1110 can continue to apply a biasing force on the handle 1002 and handle assembly 1024 in the direction of arrow 1017 but the engagement of the ends of the lock spring arms 1066, 1068 with the guide channels 1084, 1086 can maintain the handle device 1000 in the stowed configuration, as described in more detail in reference to FIGS. 18A-18F-2. As illustrated, the gears 1070, 1072 can remain meshed with the gear racks 1080, 1082 in the stowed configuration. The first link 1045 and second link 1047 can be collapsed (e.g., pivoted to positions adjacent and/or parallel to each other) with the handle 1002 stowed. The first link 1044 and second link 1047 can be collapsed (e.g., pivoted to positions adjacent and/or parallel to each other) with the handle 1002 stowed.

The user can deploy the handle 1002 from the stowed configuration by, once again, applying a force, e.g., a push force, in the direction of arrow 1014 that facilitates movement of the ends of the lock spring arms 1066, 1068 within the guide channels 1084, 1086 to allow the biasing force of the constant force springs 1108, 1110 in the direction of arrow 1017 to deploy the handle 1002, as described in more detail in reference to FIGS. 18A-18F-2. As described herein, the engagement between the gears 1070, 1072 and gear racks 1080, 1082 can prevent and/or at least reduce twisting or rotation of the handle assembly 1024 that may occur from the constant force springs 1108, 1110 applying unequal biasing forces on the handle assembly 1024, which can facilitate smooth and/or straight deployment. This can, in some variants, be due to the gears 1070, 1072 rotating in unison, as described herein.

Figure 18A:
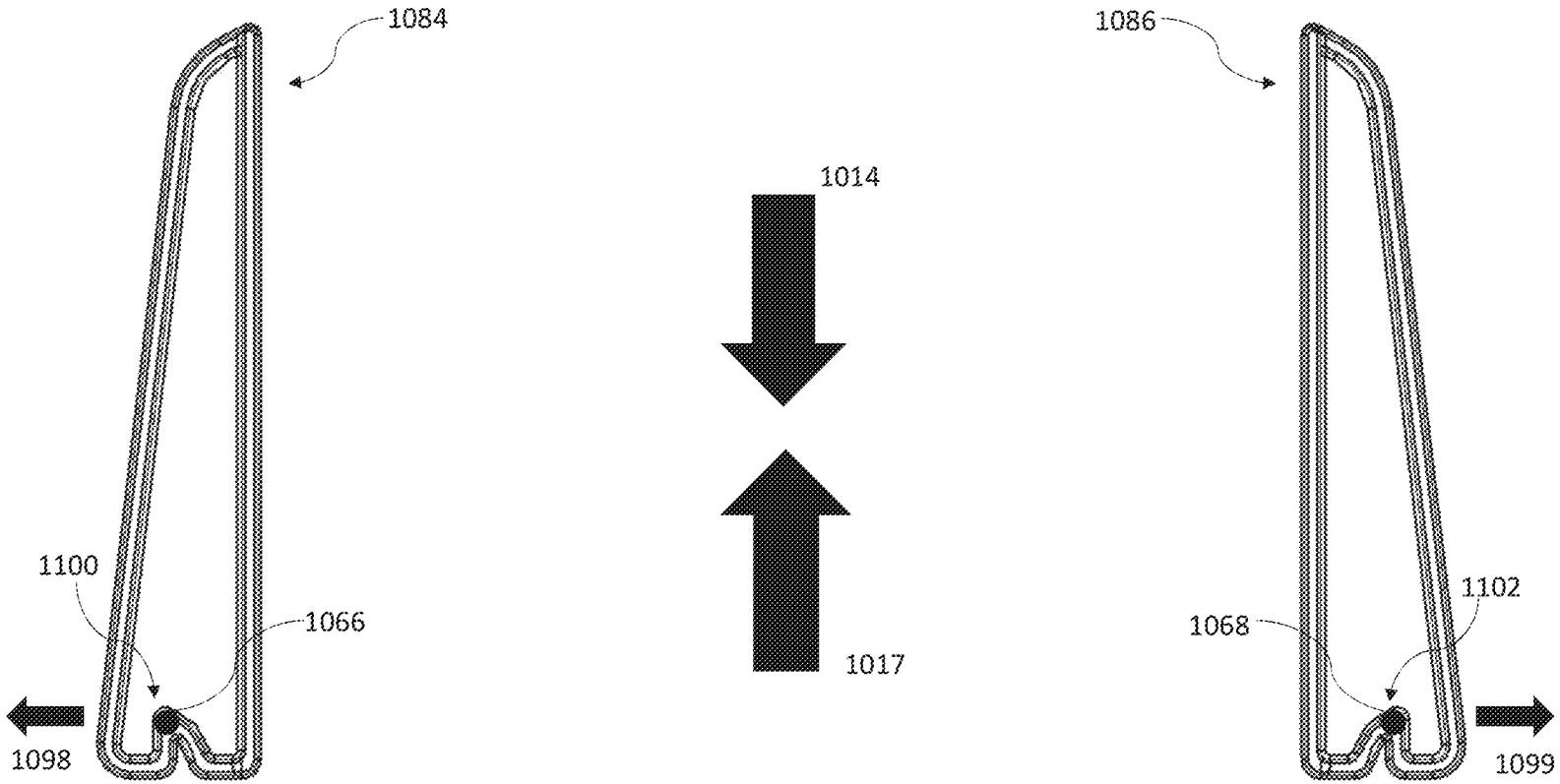
FIG. 18A illustrates ends of spring arms in guide channels in the stowed configuration.
Figure 18B:
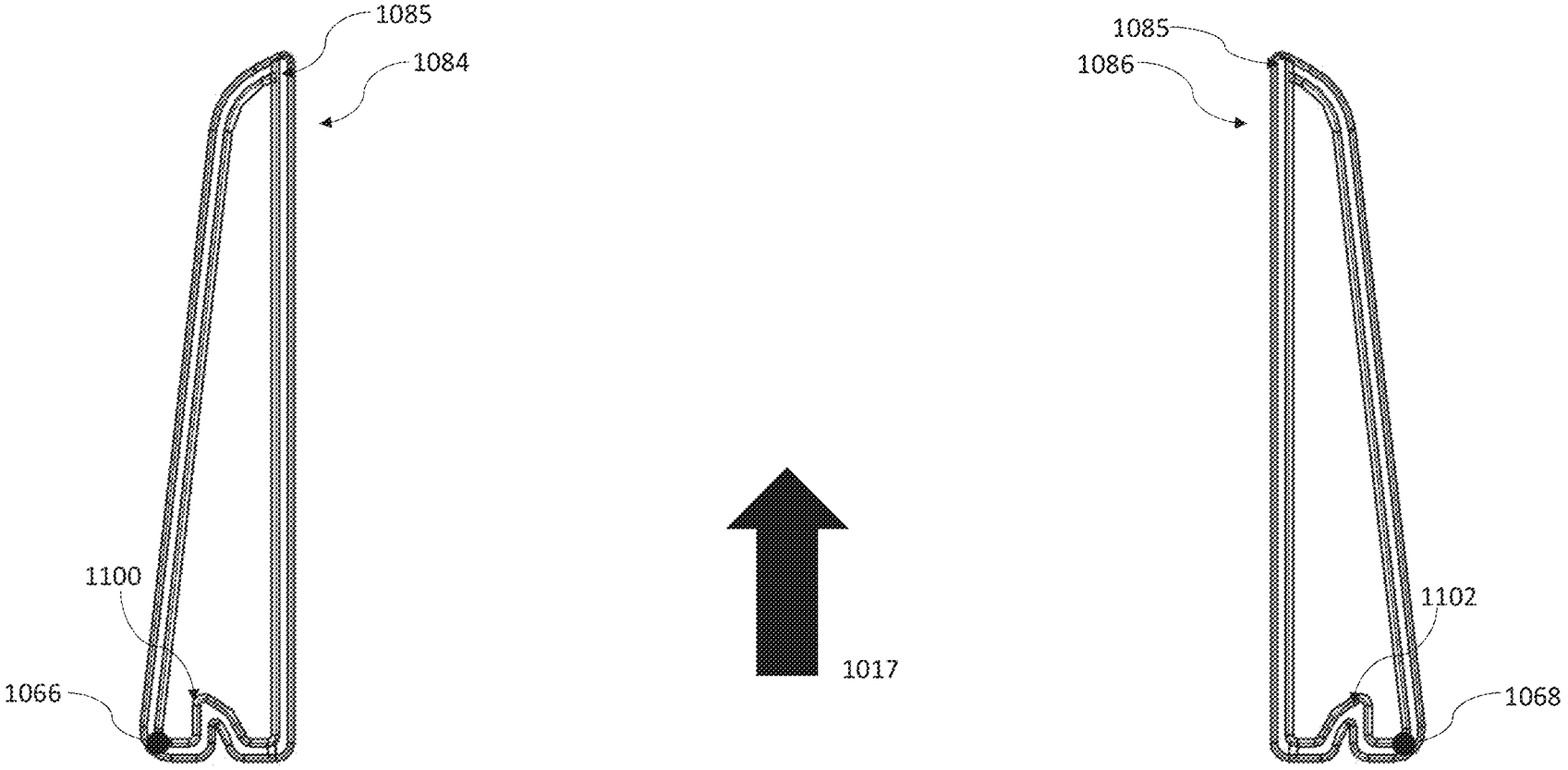
FIG. 18B illustrates ends of spring arms in guide channels in a transition configuration.

FIGS. 18A-18F-2 depict the movement of the ends of the lock spring arms 1066, 1068 within the guide channels 1084, 1086. FIG. 18A illustrates the ends of the lock spring arms 1066, 1068 within the guide channels 1084, 1086 with the handle device 1000 in the stowed configuration. The ends of the lock spring arms 1066, 1068 can be retained within bends 1100, 1102, also referred to as contours or turns, of the guide channels 1084, 1086. The lock spring arms 1066, 1068 can be biased outward such that the lock spring arm 1066 and lock spring arm 1068 are biased away from each other. Specifically, the lock spring arm 1066 can be biased in the direction of arrow 1098 and the lock spring arm 1068 can be biased in the direction of arrow 1099.

Figures 2, 18C:
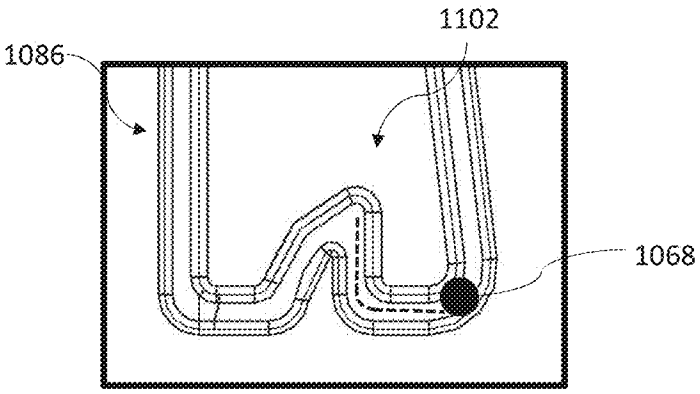
Figures 1, 18C:
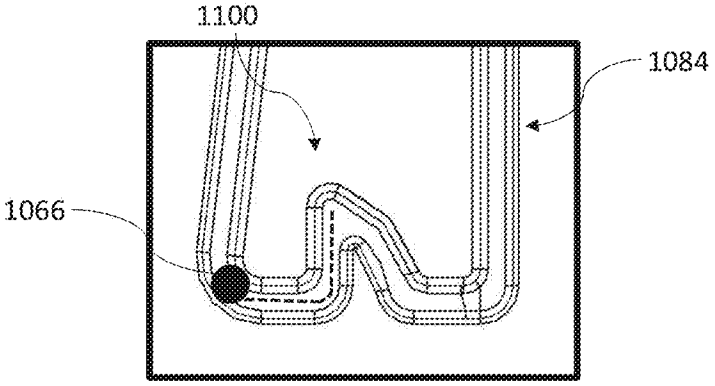

To place the handle device 1000 in the deployed configuration, the user can push the handle 1002 inward (e.g., into the housing 1026) in the direction of arrow 1014. The pushing force of the user, in combination with the bias of the lock spring arms 1066, 1068 can place the ends of the lock spring arms 1066, 1068 in the configuration shown in FIG. 18B. As illustrated in FIGS. 18C-1 and 18C-2, the pushing force of the user can move the ends of the lock spring arms 1066, 1068 into a position such that the bias of the lock spring arms 1066, 1068 can move the ends thereof outward (i.e., away from each other) to the positions shown in FIGS. 18B, 18C-1, and 18C-2 because outward movement of the ends of the lock spring arms 1066, 1068 is not obstructed by the guide channels 1084, 1086. The dashed lines in FIGS. 18C-1 and 18C-2 can indicate the travel path of the ends of the lock spring arms 1066, 1068 between the stowed configuration in FIG. 18A and the transitional configuration in FIG. 18B. As described herein, the handle device 1000 can include one or more springs, e.g., constant force springs 1108, 1110, that can bias the handle device 1000 toward the deployed configuration. Specifically, the one or more springs 1108, 1110 can apply a biasing force in the direction of arrow 1017 to move the handle device 1000 to the deployed configuration with the handle 1002 extending outside the housing 1026. With the ends of the lock spring arms 1066, 1068 in the bends 1100, 1102, the handle device 1000 can be maintained in the stowed configuration despite the handle device 1000 being biased by the springs 1108, 1110 to the deployed configuration. However, the user can overcome the biasing force of the one or more springs in the direction of arrow 1017 to enable the outward bias of the lock spring arms 1066, 1068 to move the ends thereof to the transitional positions illustrated in FIGS. 18B, 18C-1, and 18C-2.

With the ends of the lock spring arms 1066, 1068 in the positions illustrated in FIGS. 18B, 18C-1, and 18C-2, the handle device 1000 can be placed in the deployed configuration by the one or more constant force springs 1108, 1110 applying a force in the direction of arrow 1017 because the contours of the guide channels 1084, 1086 do not obstruct such movement. Accordingly, the ends of the lock spring arms 1066, 1068 can move to the positions within the guide channels 1084, 1086 illustrated in FIG. 18D which correspond to the handle device 1000 being in the deployed configuration. The guide channels 1084, 1086 can each include a stepped portion 1085, also referred to as an indented portion, depressed portion, lower-elevation portion, recessed portion, or slot, that is depressed or recessed relative to the adjacent portion of the guide channels 1084, 1086 such that the ends of the lock spring arms 1066, 1068 drop into the stepped portions 1085 upon movement to the positions shown in FIG. 18D. The outward biasing force of the lock spring arms 1066, 1068 can push the ends of the lock spring arms 1066, 1068 into the side walls of the stepped portions 1085. The side walls of the stepped portions 1085 can prevent movement of the ends of the lock spring arms 1066, 1068 back toward the positions illustrated in FIG. 18B or, stated differently, out of the stepped portions 1085.

Figure 18D:
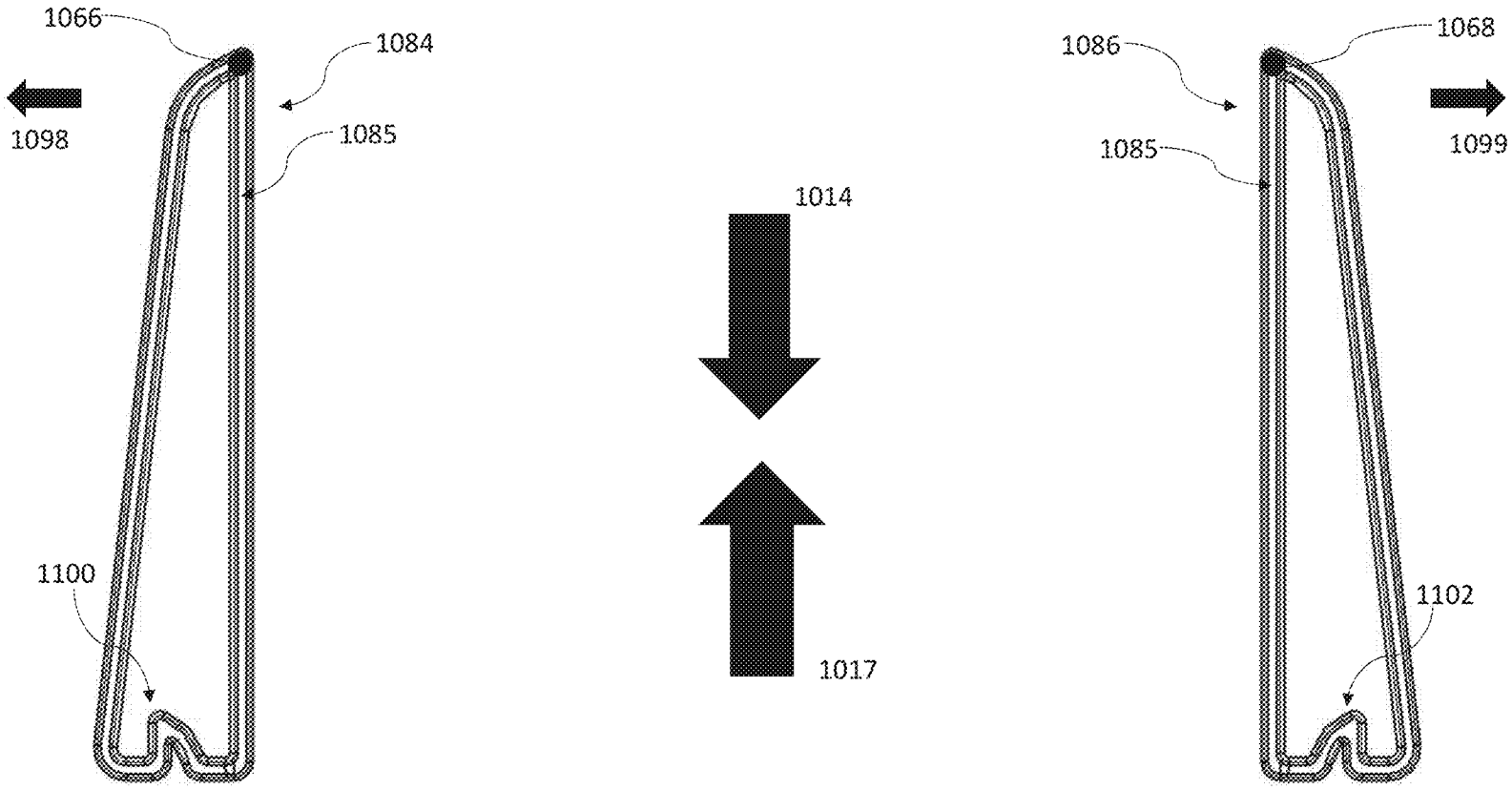
FIG. 18D illustrates ends of spring arms in guide channels in the deployed configuration.
Figure 18E:
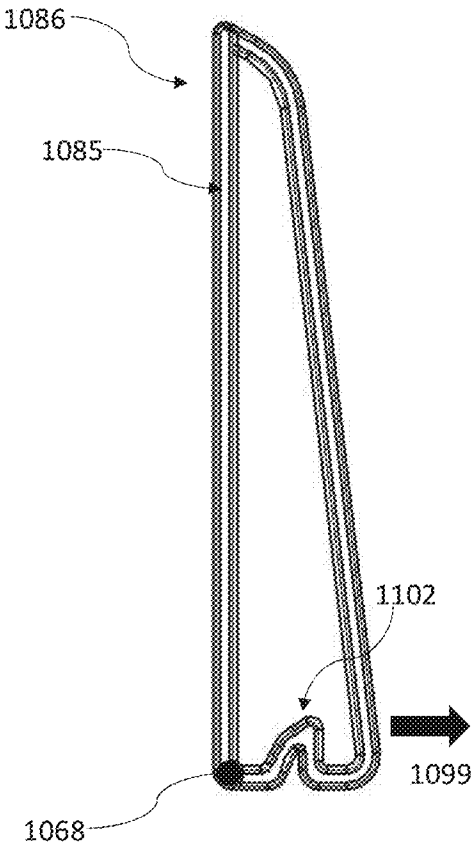
FIG. 18E illustrates ends of spring arms in guide channels in a transition configuration.
Figure 18E:
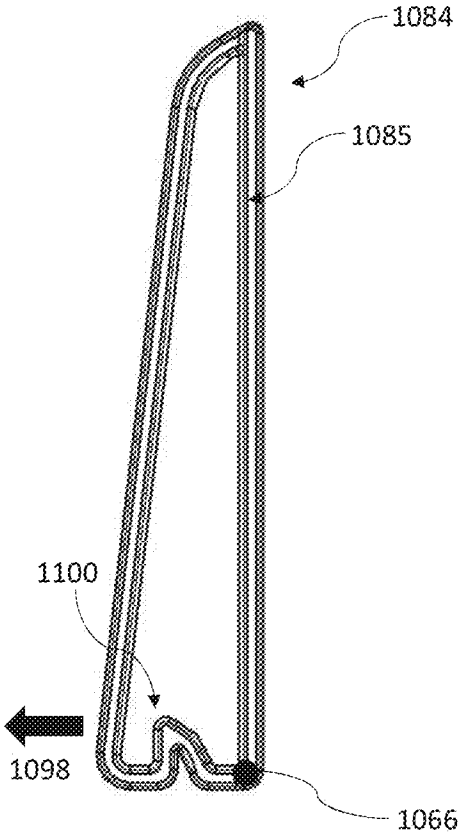
Figures 2, 18F:
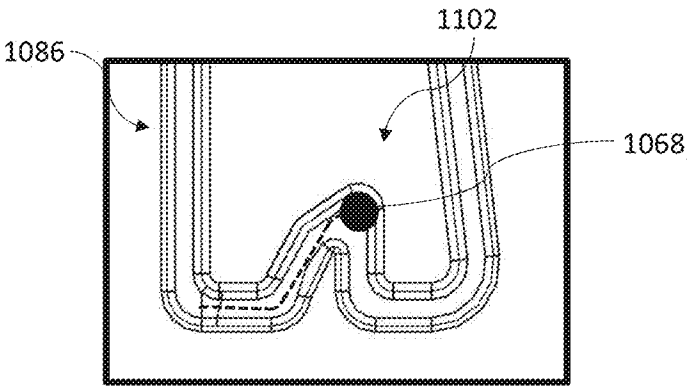
Figures 1, 18F:
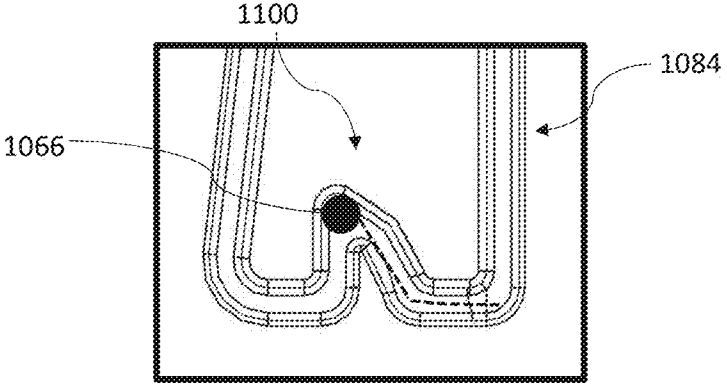

To place the handle device 1000 in the stowed configuration from the deployed configuration illustrated in FIG. 18D, the user can push the handle 1002 in the direction of arrow 1014, overcoming the force applied by the one or more constant force springs 1108, 1110 in the direction of arrow 1017, to move the ends of the lock spring arms 1066, 1068 to the transitional positions illustrated in FIG. 18E. The stepped portions 1085 can include a gradual incline in elevation between the location of the ends of the lock spring arms illustrated in FIG. 18D and the location of the ends of the lock spring arms 1066, 1068 illustrated in FIG. 18E. The stepped portions 1085 can end at the location of the ends of the lock spring arms 1066, 1068 illustrated in FIG. 18E such that the outward biasing forces of the lock spring arms 1066, 1068 can move the ends of the lock spring arms to the bends 1100, 1102. Outside the recesses of the stepped portions 1085, the outward biasing force of the lock spring arms 1066, 1068 can then be free to move the ends of lock spring arms 1066, 1068 outward in the direction of arrows 1098, 1099 such that the ends of lock spring arms 1066, 1068 are positioned in the bends 1100, 1102 as illustrated in FIG. 18A, which corresponds to the handle device 1000 being in the stowed configuration. With the ends of lock spring arms 1066, 1068 positioned in the bends 1100, 1102, the handle device 1000 is retained in the stowed configuration despite the one or more constant force springs 1108, 1110 applying a force in the direction of arrow 1017. FIGS. 18F-1 and 18F-2 depict, via dashed lines, the movement of the ends of the lock spring arms 1066, 1068 within the guide channels 1084, 1086 from the positions illustrated in FIG. 18E to the those illustrated in FIGS. 18A, 18F-1, and 18F-2, which correlate to the handle device 1000 being in the stowed configuration with the handle 1002 retained within the housing 1026.

Figure 19:
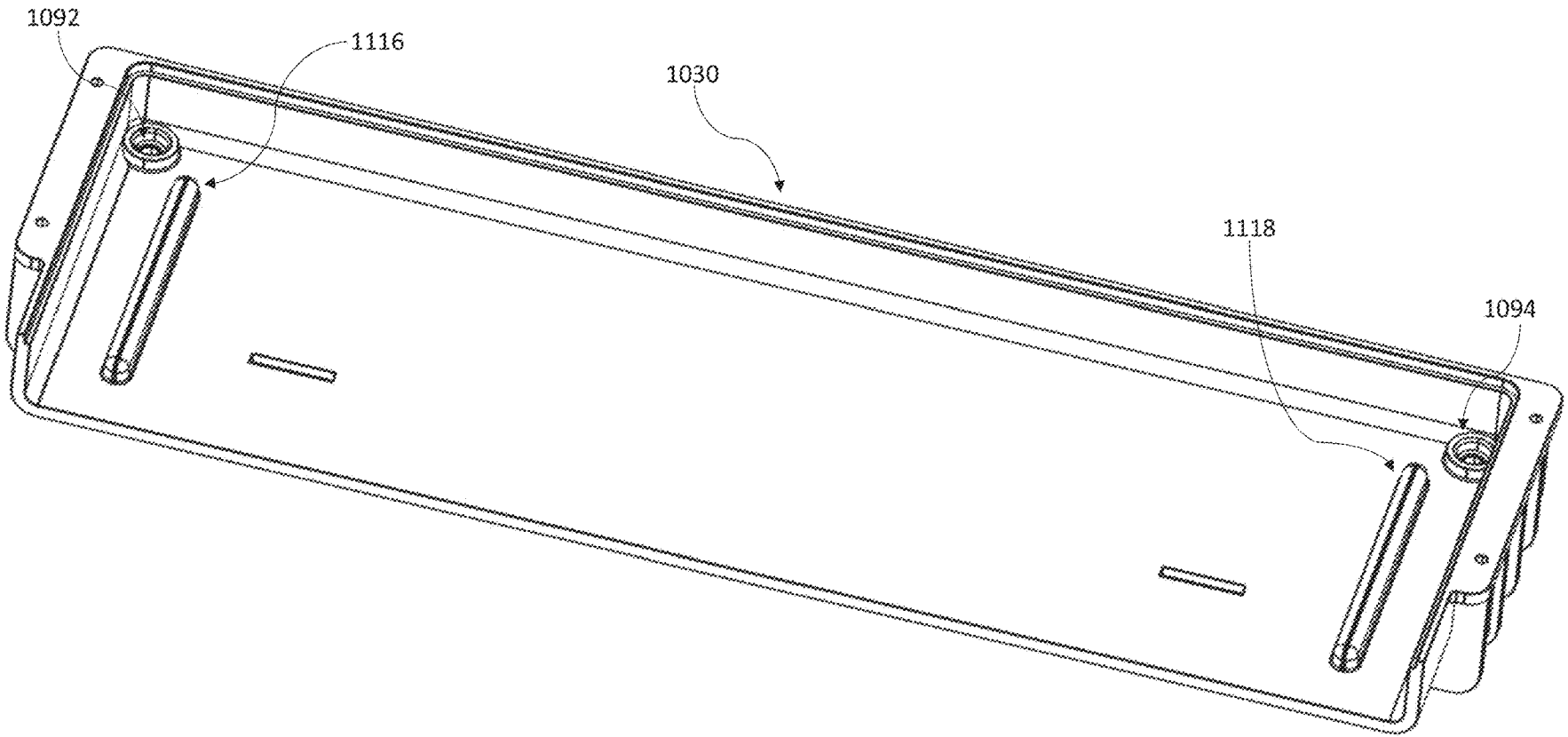
FIG. 19 illustrates an example lower housing portion.

FIG. 19 illustrates the lower housing portion 1030. As described elsewhere herein, the lower housing portion 1030 can include retainers 1092, 1094. The retainers 1092, 1094 can receive the pins 1074, 1075—rotatably coupling the first link 1044 and first link 1045 to the lower housing portion 1030. The retainers 1092, 1094 can be annular structures protruding from the lower housing portion 1030. The retainers 1092, 1094 can be formed in the lower housing portion 1030.

The lower housing portion 1030 can include protrusions 1116, 1118, also referred to as elongate protrusions, protuberances, or elongate protuberances. The protrusions 1116, 1118 can maneuver the lock mechanisms 1060, 1062, as described in reference to FIGS. 20A-21C, to maintain the handle 1002 in the deployed configuration and/or enable the handle 1002 to be stowed. The protrusions 1116, 1118 can be formed in the lower housing portion 1030. The protrusions 1116, 1118 can have rounded ends.

Figure 20A:
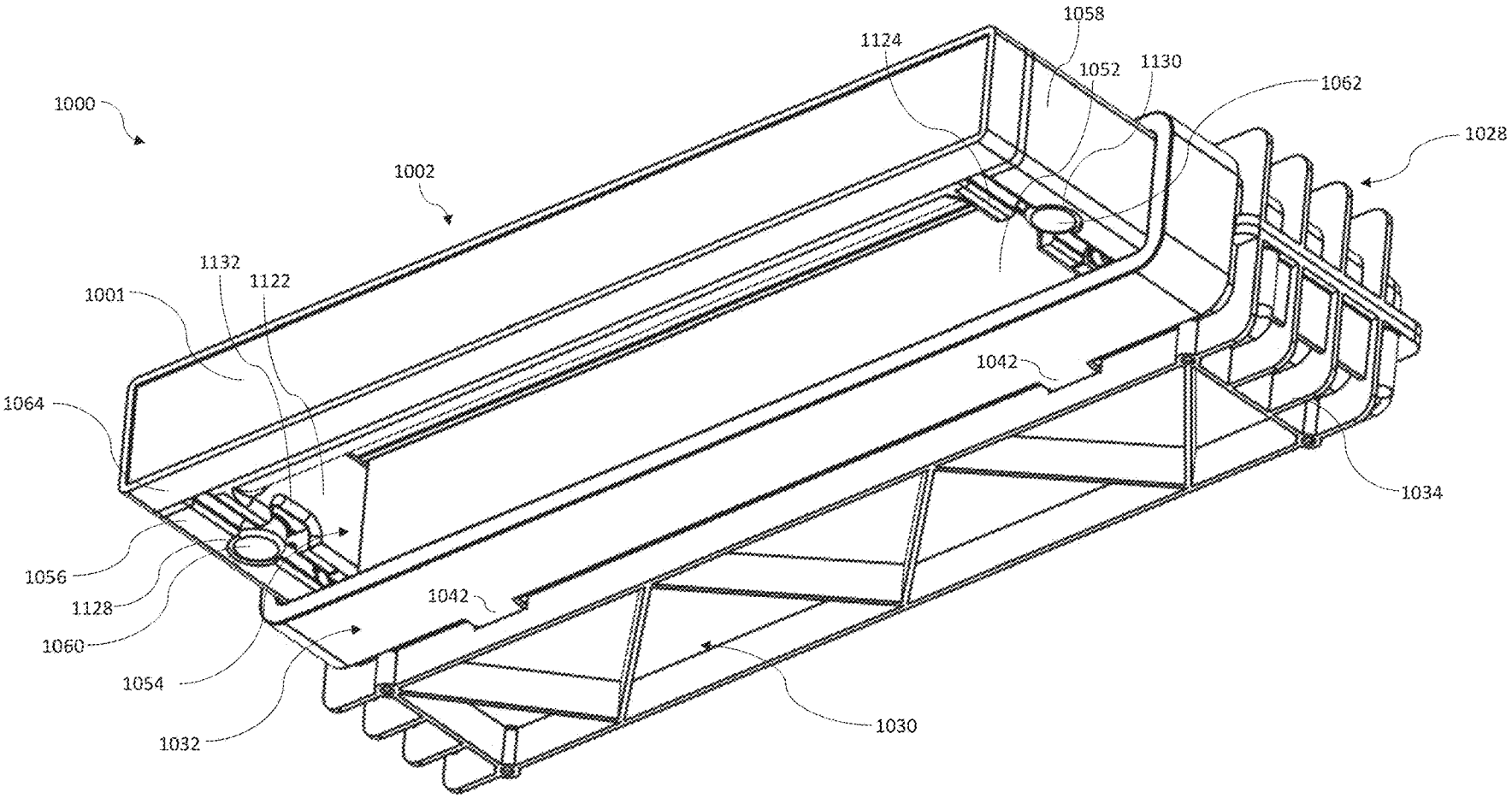
FIG. 20A illustrates a perspective view of the handle device.

FIG. 20A illustrates a bottom perspective view of the handle device 1000. As described elsewhere herein, the handle device 1000 can include lock mechanisms 1060, 1062 disposed in the lock housings 1056, 1058. In some variants, the arms 1122, 1124 of the handle frame 1054 can enclose the lock mechanisms 1060, 1062 within the lock housings 1056, 1058. The lock housings 1056, 1058 can respectively include openings 1128, 1130 through which the lock mechanisms 1060, 1062 may extend to enable the user to be able to access the lock mechanisms 1060, 1062. In some variants, the arms 1122, 1124 can include gaps 1132, which can enable the user to be able to access the lock mechanisms 1060, 1062. The lock mechanisms 1060, 1062 can retain the handle 1002 in the deployed position until manipulated. To stow the handle 1002, the user can manipulate the lock mechanisms 1060, 1062, which can include pushing them inward, to allow the handle 1002 to be pushed into the housing 1026. In some variants, only one lock mechanism is used. In some variants, the handle 1002 cannot be pushed into the stowed position without the user manipulating the lock mechanisms 1060, 1062, which can prevent the user's hand from being pinched between the handle 1002 and the wall 1003 and/or prevent unintentional movement of the handle 1002.

Figure 20B:
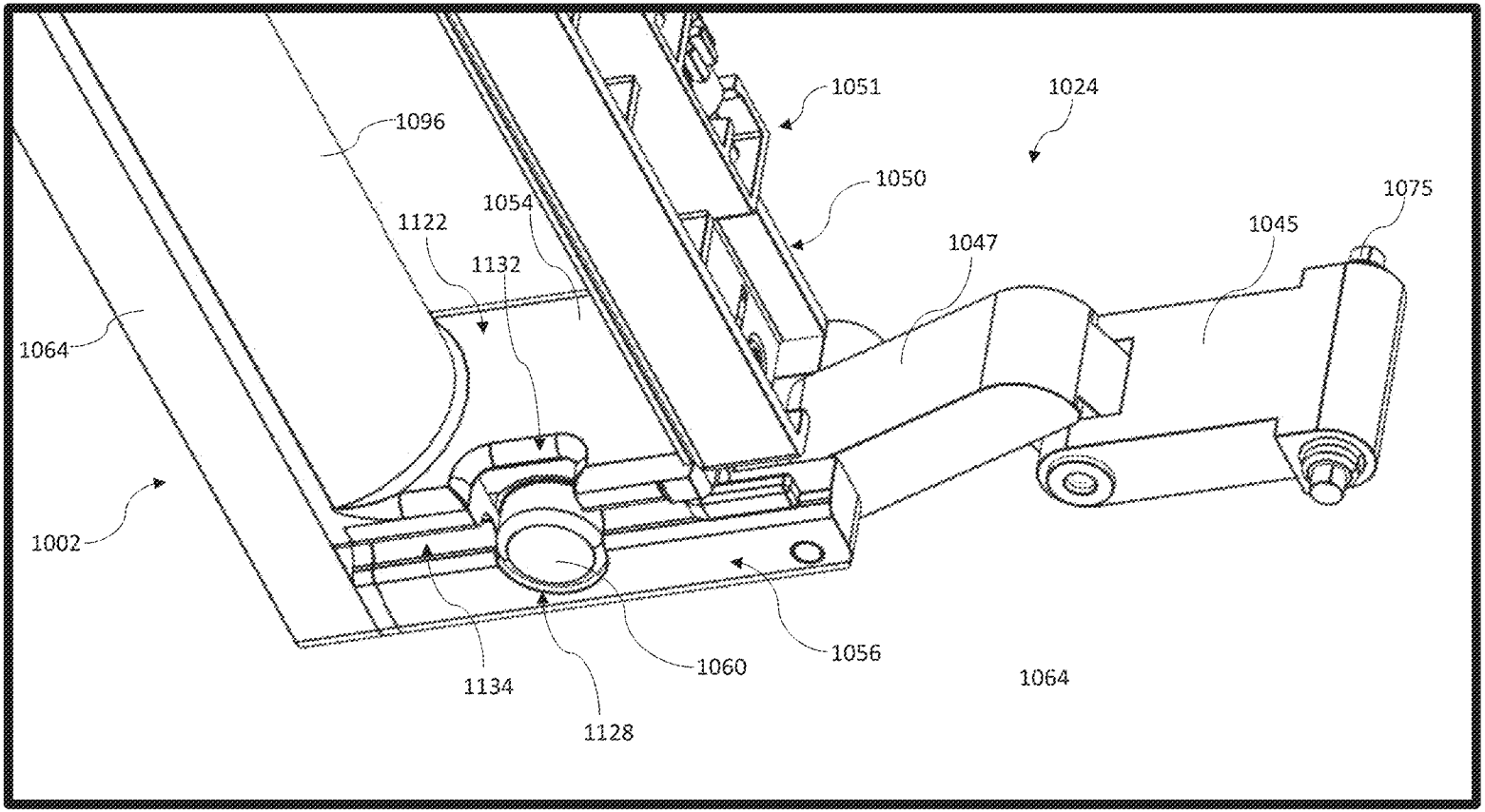
FIG. 20B illustrates an example lock housing and lock mechanism of the handle device.

FIG. 20B illustrates a bottom perspective view of the handle assembly 1024 decoupled from the housing 1026. As illustrated, the lock housing 1056 can include a groove 1134. In some variants, the lock housing 1058 can include a groove 1134 that is the same or similar to the groove 1134. The groove 1134 can enable the lock housing 1056 to pass over the protrusion 1118 as the handle device 1000 is moved between the stowed and deployed configurations.

Figure 20C:
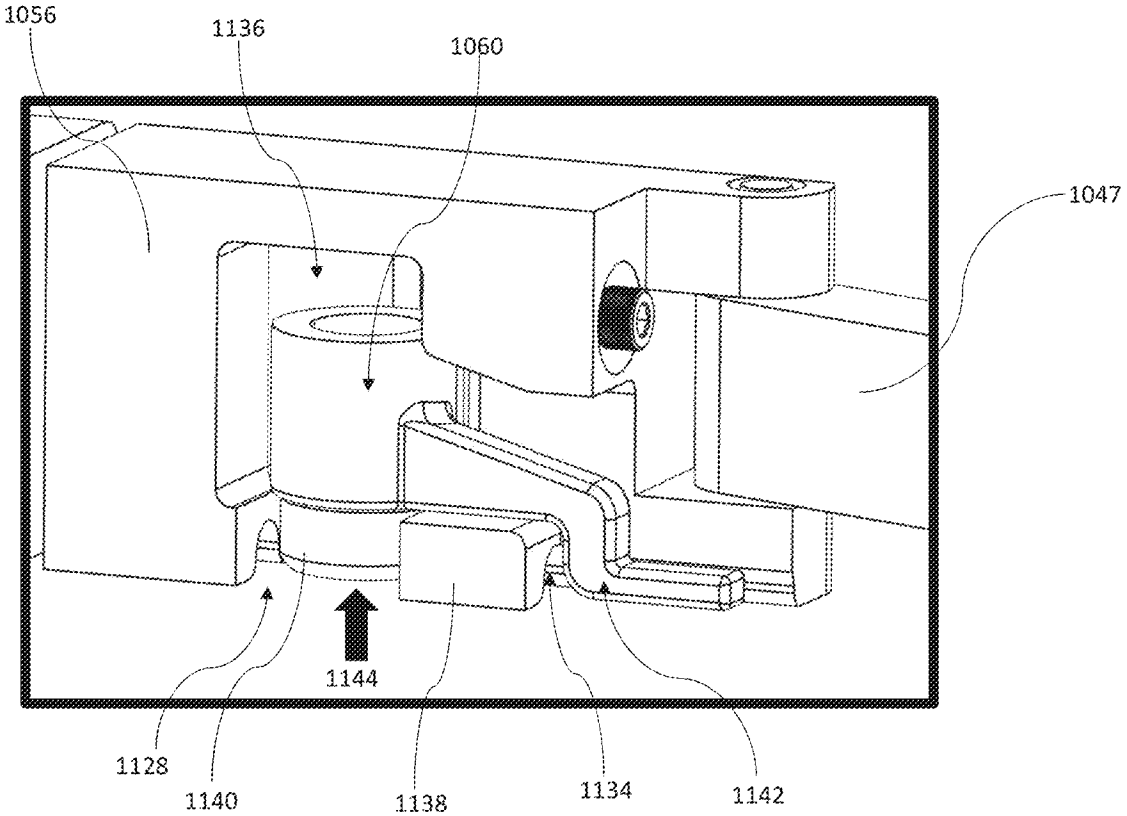
FIG. 20C illustrates the lock housing and lock mechanism of the handle device.

FIG. 20C illustrates a view of the lock housing 1058 with the arm 1122 decoupled therefrom. The lock housing 1058 can include a cavity 1136 that can receive the lock mechanism 1060 therein. The lock housing 1058 can include a support 1138, also referred to as a strut, bridge, or tab, that can retain the lock mechanism 1060 within the cavity 1136. The lock mechanism 1060 when positioned within the cavity 1136 can have an engagement portion or body 1140, also referred to as an engagement cylinder, cylinder, or button, that can extend through the opening 1128 enabling the user to contact the engagement portion 1140. The engagement portion 1140 can be a cylinder, prism, or other structure. The lock mechanism 1060 can include an arm 1142. The arm 1142 can contact the support 1138 when the lock mechanism 1060 is disposed within the cavity 1136 to suspend the lock mechanism 1060 therein. The arm 1142 can include one or more curves that position the arm 1142 around the support 1138. The arm 1142 can be disposed and/or extend into the groove 1134 of the lock housing 1058 in the deployed configuration. In use, the user can apply a force, e.g., push, the engagement portion 1140 in the direction of the arrow 1144, e.g., upward, raising the arm 1142 out of the groove 1134 such that the lock housing 1056 can slide over the protrusion 1118 as the handle 1002 is pushed into the housing 1026.

Figure 21A:
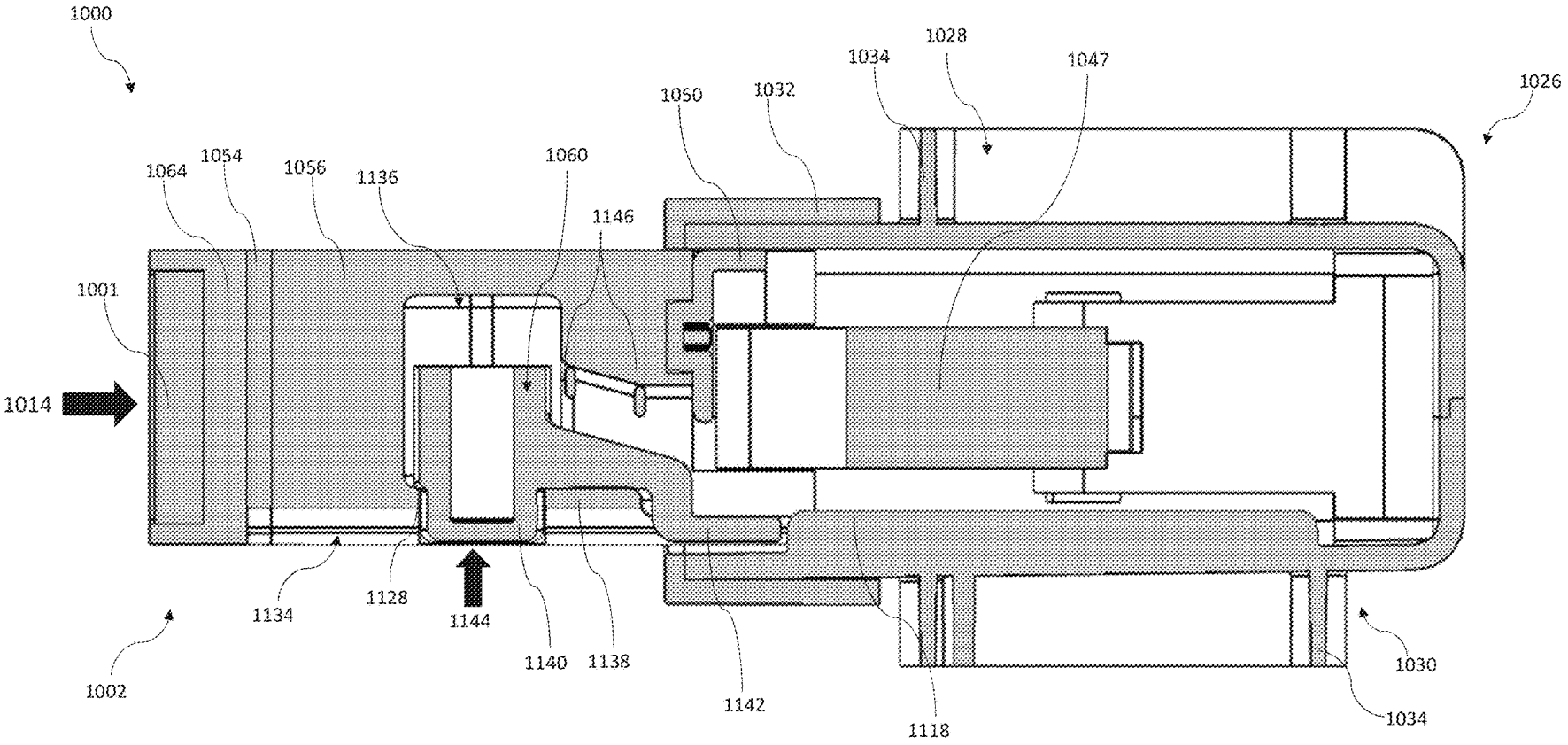
FIG. 21A illustrates a section view of the handle device in the deployed configuration.
Figure 21B:
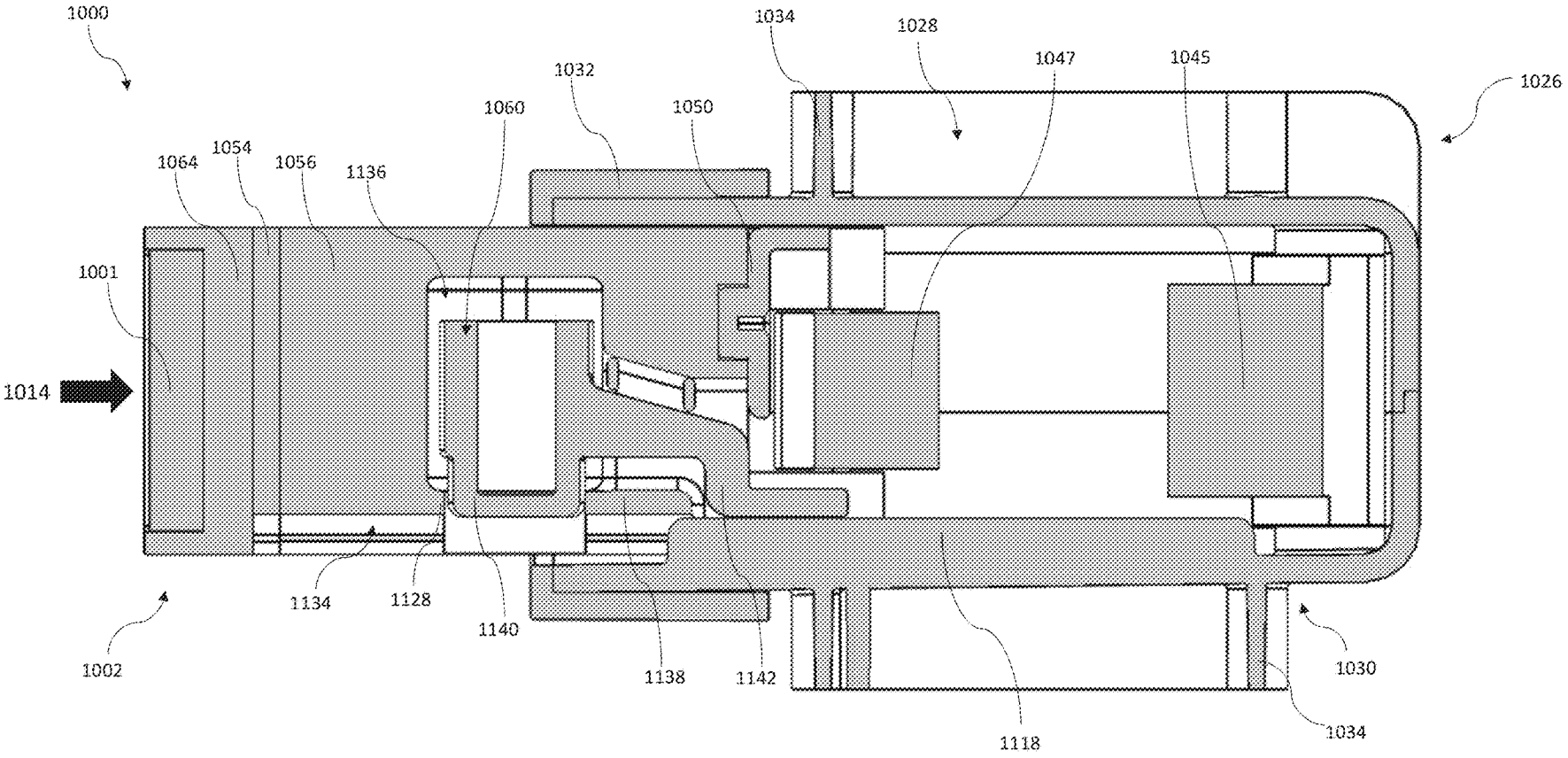
FIG. 21B illustrates a section view of the handle device in a transitional configuration.
Figure 21C:
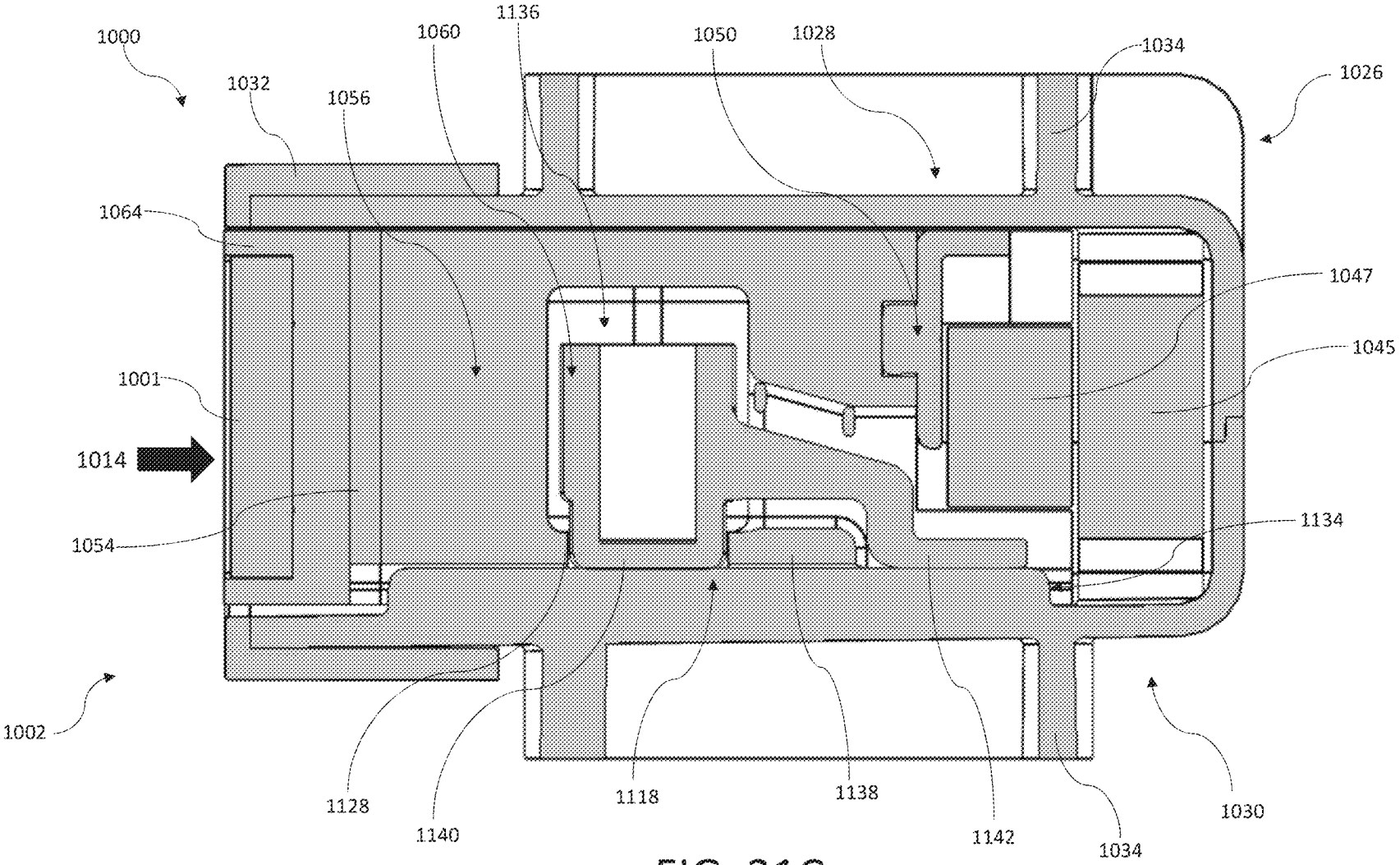
FIG. 21C illustrates a section view of the handle device in the stowed configuration.

FIGS. 21A-21C illustrate various sectional views of the lock housing 1056, lock mechanism 1060, protrusion 1118, and other components of the handle device 1000 in the deployed, transitional, and stowed configurations. FIG. 21A illustrates the handle device 1000 in the deployed configuration. As illustrated, the lock mechanism 1060 can be disposed within the cavity 1136 of the lock housing 1056. The lock mechanism 1060 can be supported by the support 1138 within the cavity 1136. The arm 1142 of the lock mechanism 1060 can be disposed in the groove 1134 of the lock housing 1056, which can prevent the protrusion 1118, also referred to as the elongate protrusion, from entering the groove 1134 and, as a result, the lock housing 1056 from being translated in the direction of arrow 1014. As in FIG. 20C, the engagement portion 1140 of the lock mechanism 1060 is extending through the opening 1128 of the lock housing 1056 such that the user can contact the engagement portion 1140.

To begin stowage of the handle 1002, the user can apply a force to the engagement portion 1140 of the lock mechanism 1060 in the direction of arrow 1144, moving the lock mechanism 1060 in the direction of arrow 1144 such that the arm 1142 is moved out of the groove 1134. With the arm 1142 out of the groove 1134, the user can apply a force to the handle 1002 in the direction of arrow 1014, pushing the handle 1002 into the housing 1026, as the lock housing 1056 is moved over the protrusion 1118 such that the protrusion 1118 is disposed in the groove 1134, as illustrated in FIG. 21B.

As the handle 1002 is pushed into the housing 1026 in the direction of arrow 1014, the arm 1142 can slide over the protrusion 1118 and, once the engagement portion 1140 passes over protrusion 1118, the engagement portion 1140 can slide over the protrusion 1118 as well, as illustrated in FIG. 21C. The handle 1002 can be pushed in the direction of arrow 1014 until the handle 1002 is placed in the stowed configuration as illustrated in FIG. 21C with the lock mechanism 1060 disposed on the protrusion 1118. The handle 1002 can be deployed, as described elsewhere herein, by the user, once again, pushing the 10002 in the direction of arrow 1014. The handle 1002 can be deployed via the biasing force of the constant force springs 1108, 1110 moving the handle 1002 to the transition configuration in FIG. 21B with the lock mechanism 1060 sliding over the protrusion 1118 and then to the deployed configuration in FIG. 21A. Gravity can position the engagement portion 1140 in the opening 1128 and/or arm 1142 in the groove 1134, locking the handle 1002 in the deployed configuration. In some variants, a spring can bias the lock mechanism 1060 toward a direction opposite the arrow 1144. For example, a spring can be place in the cavity 1136 to force the engagement portion 1140 in a direction opposite the arrow 1144. In some variants, the handle frame 1054, e.g., arm 1122, can include tabs 1146 that extend into the cavity 1136 to prevent excessive movement of the lock mechanism 1060 in a direction opposite the arrow 1144, as illustrated in FIG. 21A.

FIG. 22A-29 illustrate views of a handle device 2000 and various components thereof. The handle device 2000 can be incorporated in the same environment described elsewhere herein, which can include within a wall 1003. The handle device 2000 can include a swing action for the handle 1002 for deployment/stowage. The handle device 2000 may, in some variants, be suitable for narrow installation parameters, such as the annular pace of a tub wall, on a shelf surrounding a tub, on a door, on a bedframe, and/or other locations. The handle device 2000 can be relatively thin compared to other variations and involve fewer components to reduce cost.

Figure 22A:
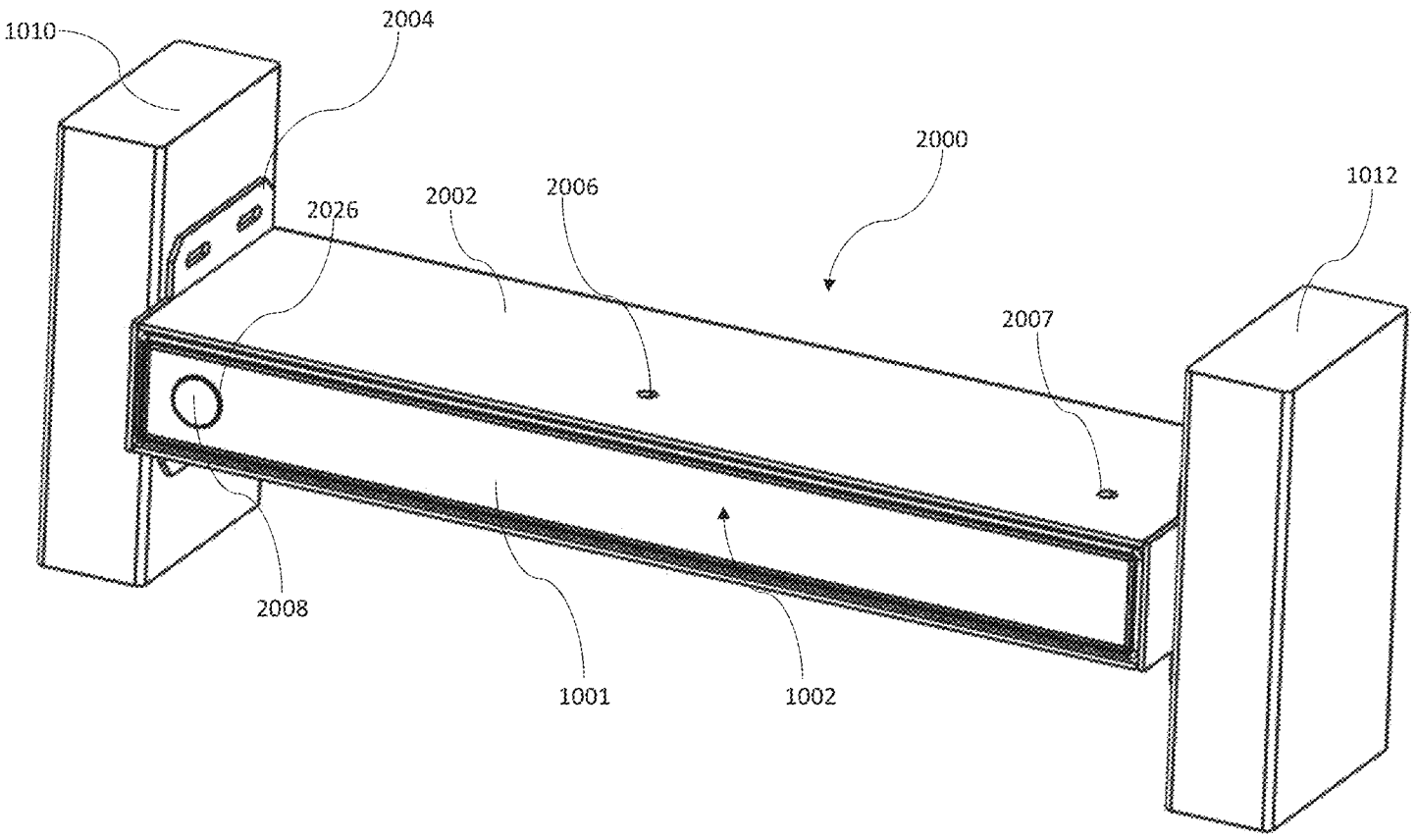
FIG. 22A illustrates an example handle device in the stowed configuration.

FIG. 22A illustrates the handle device 2000 in a stowed configuration. The handle device 2000 can be suspended between supports 1010, 1012. Specifically, the handle device 2000 can include brackets 2004, 2005, also referred to as mounts, that can be respectively coupled, via bolts, screws, fasteners, or the like, to the supports 1010, 1012. In the stowed configuration, a handle 1002 of the handle device 2000 can be housed within a housing 2002 while an exposed panel 1001 remains accessible to a user's touch. In the stowed configuration, the exposed panel 1001 can be flush with a surrounding wall and/or outer layer 1004, as described elsewhere herein to provide an aesthetically pleasing appearance. The exposed panel 1001 can be similar in appearance or even the same material as a surrounding wall and/or outer layer 1004 to assist in concealing the presence of the handle device 2000 to an observer. The exposed panel 1001 can have an hole 2026 through which a button 2008 can extend.

Figure 22B:
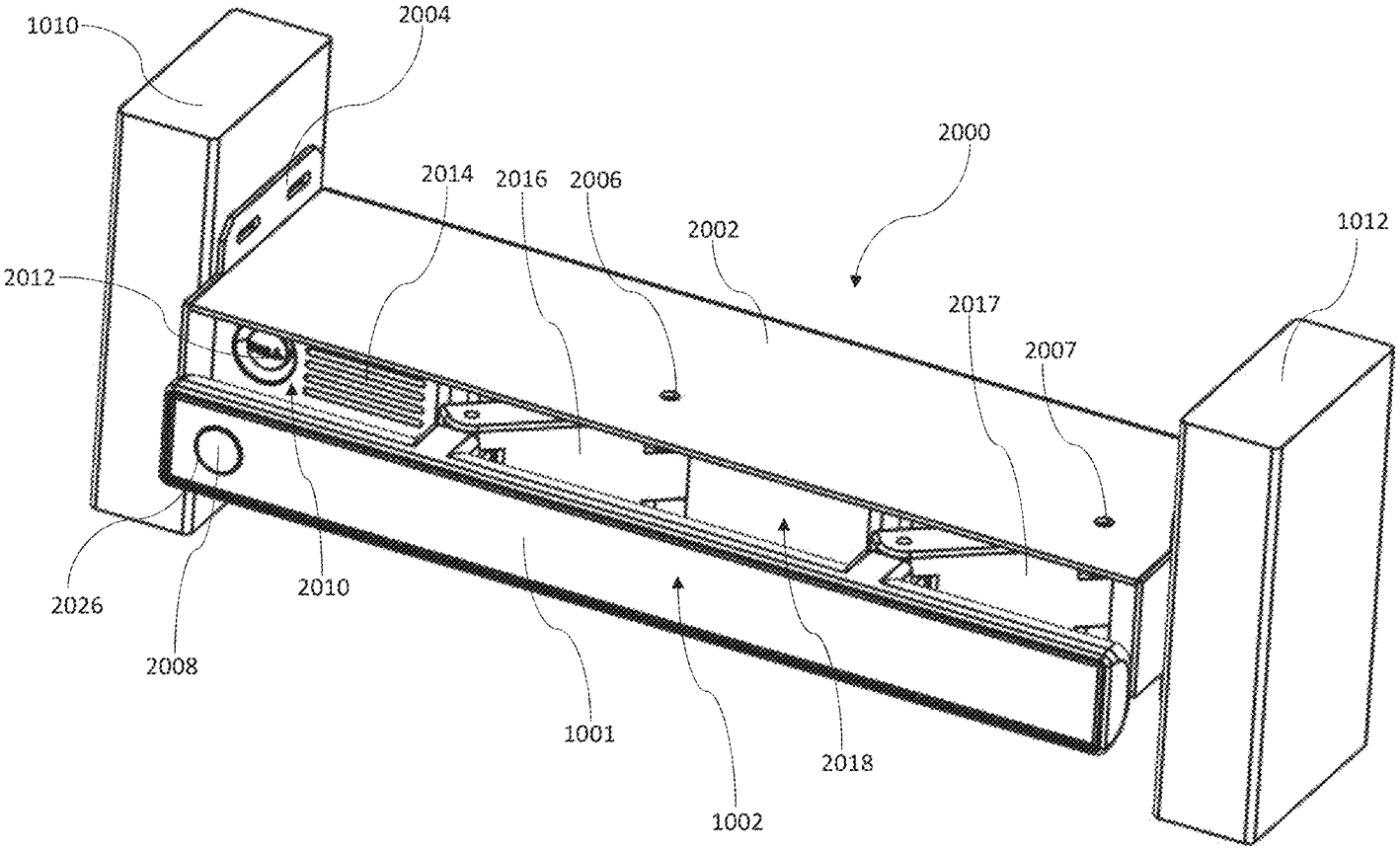
FIG. 22B illustrates the handle device in a transitional configuration.

To deploy the handle 1002 from within the housing 2002, the user can press the button 2008 releasing the handle 1002 to rotate out from within a cavity 2018 of the housing 2002, as illustrated in FIG. 22B. FIG. 22B illustrates the handle device 2000 in a transition configuration between the stowed configuration, illustrated in FIG. 22A, and a deployed configuration, illustrated in FIG. 22C. The handle device 2000 can include one or more springs that can facilitate automatic deployment upon release via pressing the button 2008. As illustrated in FIG. 22B, the handle 1002 can be rotatably coupled to a first link 2016 and second link 2017, also referred to as members, supports, struts, etc., that are each rotatably coupled to the housing 2002. In some variants, a pin can be respectively inserted through a joint connecting the handle 1002 to the first link 2016, handle 1002 to the second link 2017, first link 2016 to the housing 2002, and/or second link 2017 to the housing 2002. For example, a pin, or the like, can be inserted through a hole 2006 of the housing 2002 to rotatably couple the first link 2016 to the housing 2002 and/or a pin, or the like, can be inserted through a hole 2007 of the housing 2002 to rotatably couple the second link 2017 to the housing 2002. As illustrated, the first link 2016 and second link 2017 can pivot relative to the housing 2002 and out from the cavity 2018 of the housing 2002 to begin deployment.

The rotation of the handle 1002 out from the housing 2002 can expose an emergency communication unit 2010. The emergency communication unit 2010 can be used to contact an emergency contact in the event of an emergency, such as a fall of the user. The emergency communication unit 2010 can be activated to initiate an emergency response protocol and/or commanded to contact the emergency contact via manipulation of a user interface 2012, such as a button or switch. For example, the user may press or otherwise interact with the user interface 2012, such as a button, to initiate communication with an emergency contact, which can include initiating a call with an emergency service. The user may then communicate with (e.g., speak to and hear) the emergency contact via a speaker and/or microphone 2014. In some variants, a wearable device (e.g., pendant, bracelet, watch, etc.) can interact with the emergency communication unit 2010 to enable the user to contact an emergency contact, such as an emergency service, without interaction with the user interface 2012. The wearable device can be worn by the user such that the user can communicate with an emergency contact in the event of a fall or slip resulting in the user being out of reach of the emergency communication unit 2010. In some variants, the wearable device can detect if the user has fallen and automatically contact an emergency contact and/or begin an emergency response protocol. The wearable device can be an internet-of-things device (i.e., IoT device). The wearable device be connected to the emergency communication unit 2010 and/or a network via Wi-Fi, Bluetooth, Ethernet, 3G, 4G, 5G, and/or other wireless or wired communication methods. In some embodiments, the wearable device can have a speaker and microphone, allowing a user to speak to emergency contacts. The wearable device can include an integrated two way voice over internet protocol (VOIP) emergency call button.

Figure 22C:
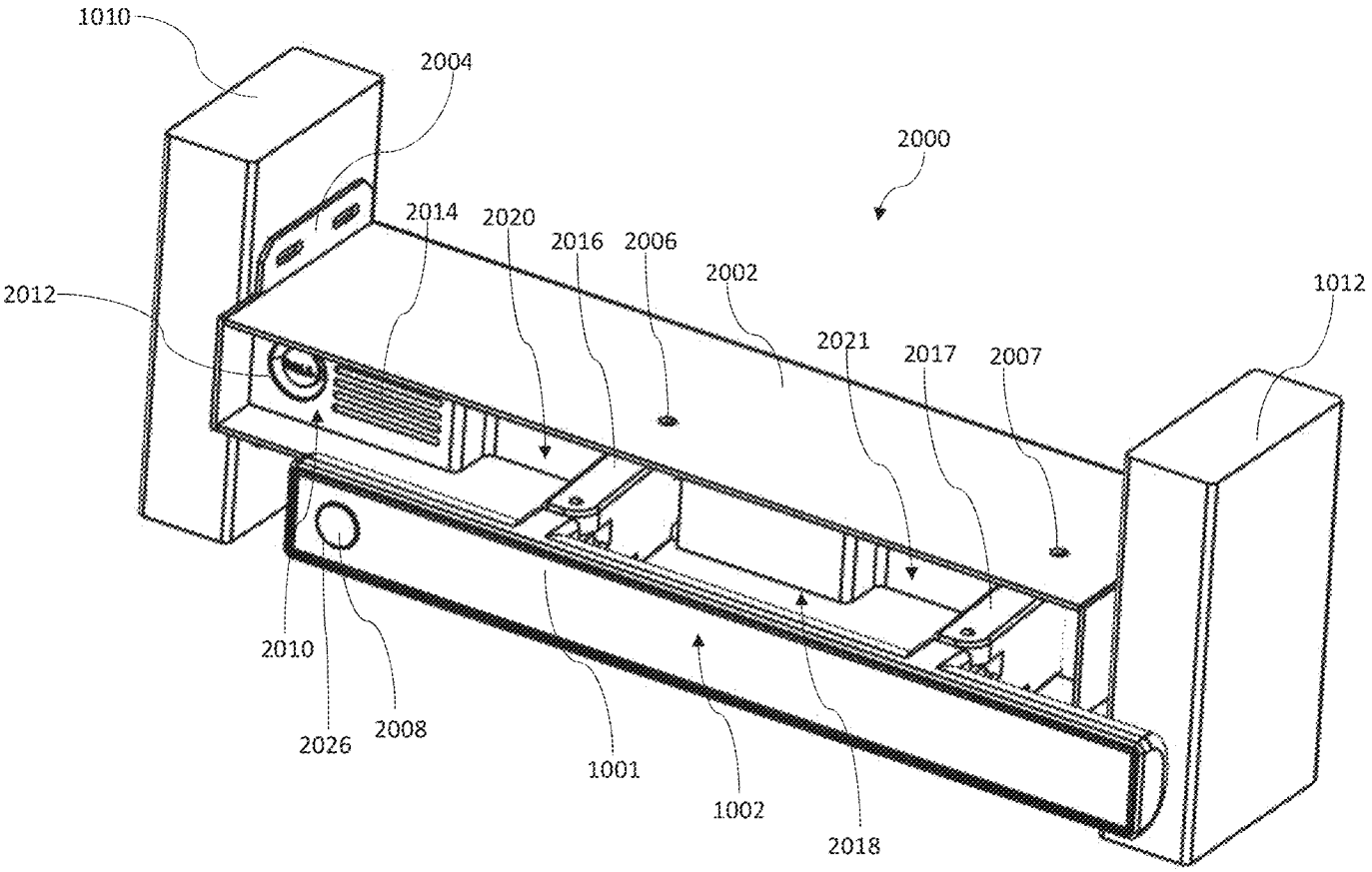
FIG. 22C illustrates the handle device in a deployed configuration.

FIG. 22C illustrates the handle device 2000 in the deployed configuration. In the deployed configuration, the handle 1002 can be spaced away from the housing 2002 and/or a surrounding wall, enabling the user to comfortably grasp the handle 1002 for support. The first link 2016 and second link 2017 can be arranged such that longitudinal lengths thereof are perpendicular to a surface, e.g., a wall, in which the handle device 2000 is incorporated. The first link 2016 and second link 2017 can be rotated to extend straight, e.g., perpendicularly relative to a longitudinal length of the housing 2002, in the deployed configuration. In the deployed configuration, the handle 1002 can be releasably locked to reduce the likelihood of unintentional stowage of the handle 1002.

Figure 22D:
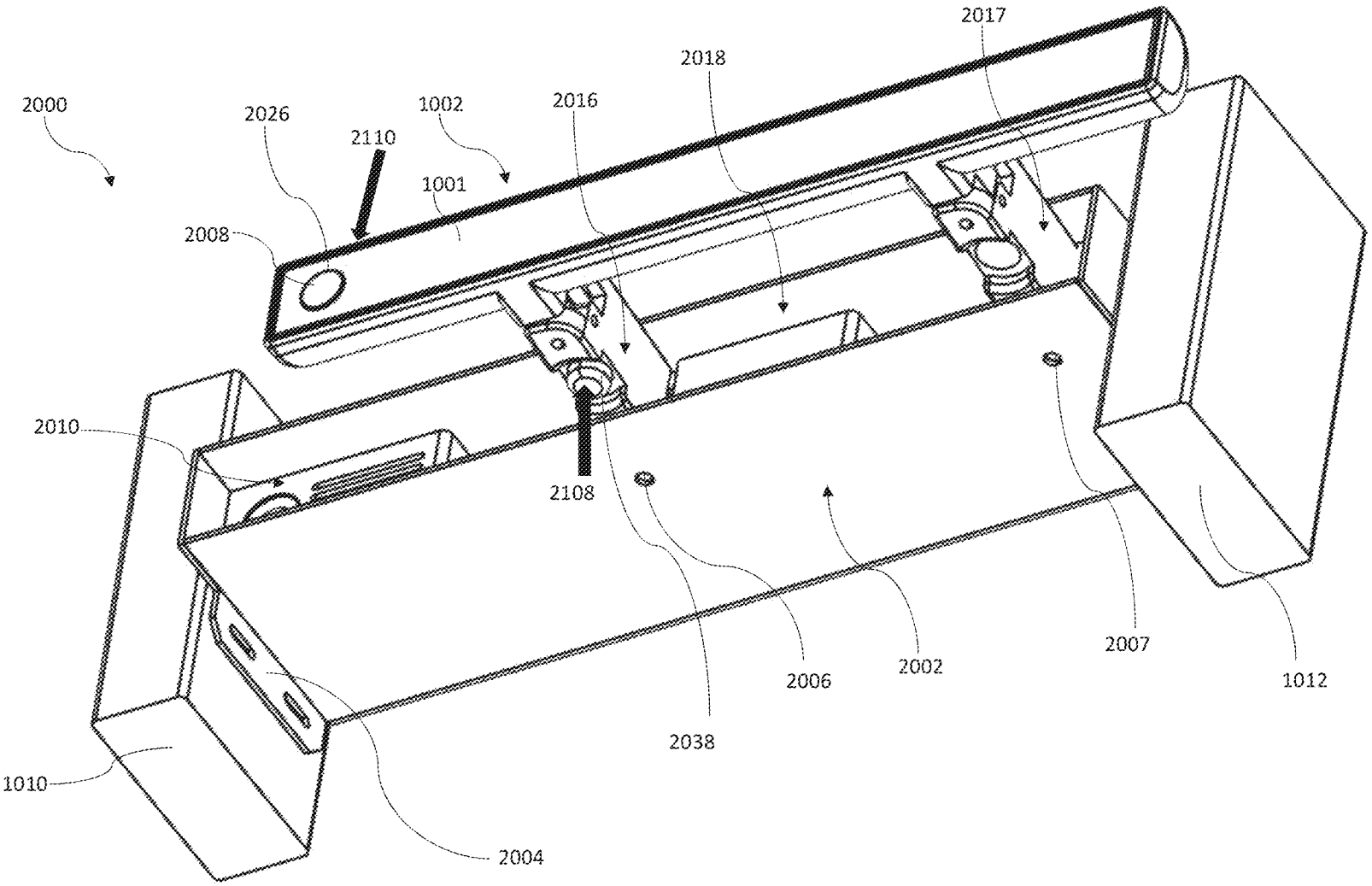
FIG. 22D illustrates the handle device in a deployed configuration.

As illustrated in FIG. 22D, the first link 2016 can include a deployment locking mechanism 2038 that locks the handle 1002, which can include the first link 2016, in the deployed configuration. To stow the handle 1002, the user can push the deployment locking mechanism 2038 in the direction of arrow 2108, unlocking the handle 1002 and/or first link 2016, and apply a force to the handle 1002 in the direction of arrow 2110 (e.g., inward toward the housing 2002). The handle 1002 can then be rotated in the direction of arrow 2110 toward placement in the cavity 2018 of the housing 2002. The first link 2016 and second link 2017 can be rotated in the direction of arrow 2110 toward respective stowage positions within a first recess 2020 and a second recess 2021, illustrated in FIG. 22C. The placement of the handle 1002 within the cavity 2018 can lock the handle 1002 within the cavity 2018 via at least the mechanism(s) described herein.

Figure 23:
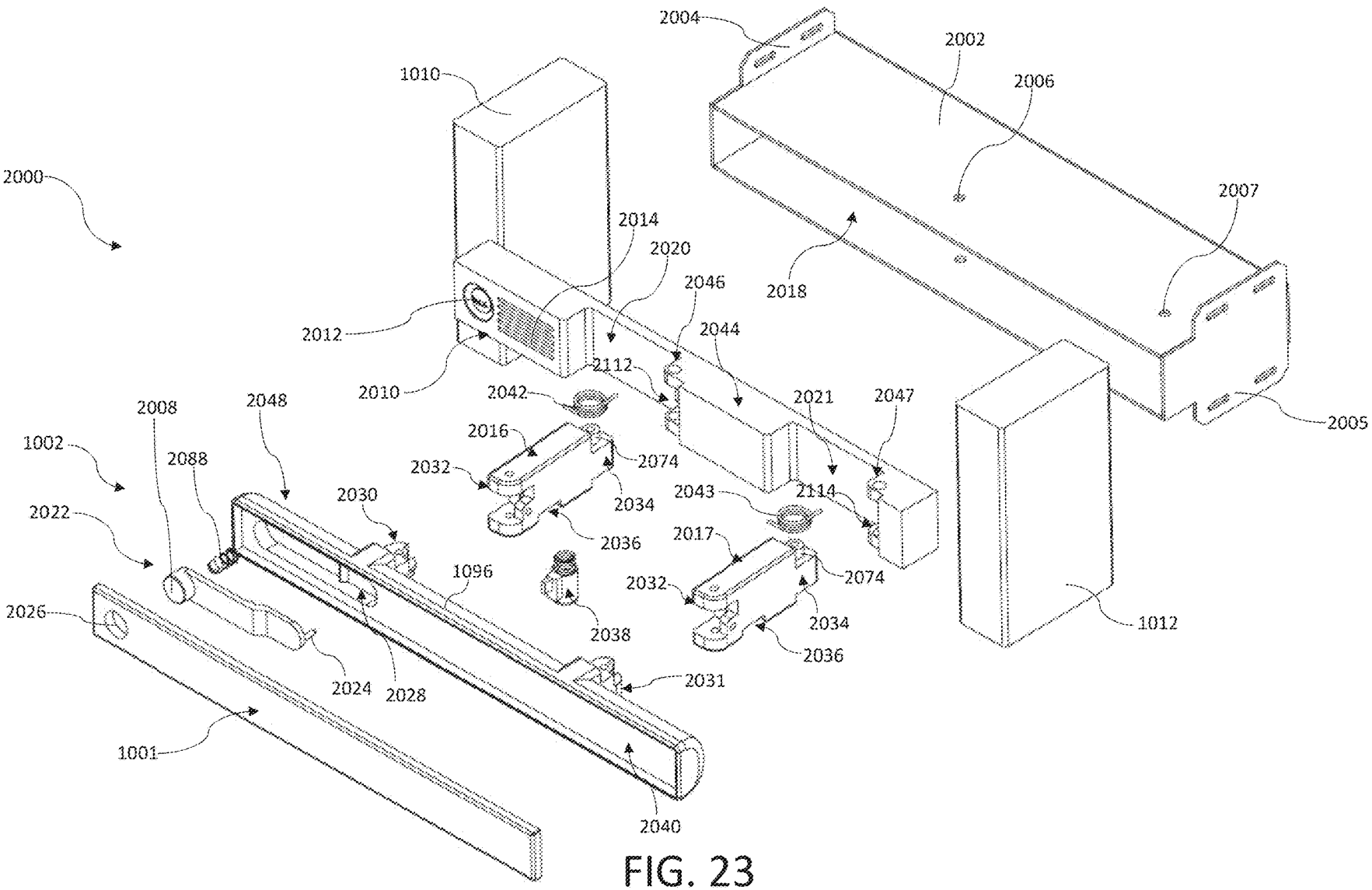
FIG. 23 illustrates an exploded view of the handle device.

FIG. 23 illustrates an exploded view of the handle device 2000. As illustrated, the handle 1002 can include a handle frame 2048, also referred to as a handle structure or support. The handle frame 2048 can include a recess 2028, also referred to as a receiving space, that can receive stowage locking mechanism 2022 that can lock and release the handle 1002 from the stowage position in the cavity 2018.

The stowage locking mechanism 2022 can include a button 2008 that can be manipulated by the user. The button 2008 can extend through a hole 2026 of the exposed panel 1001 that can be received within a recess 2040 of the handle frame 2048. The stowage locking mechanism 2022 can include a locking pin 2024, also referred to as an arm, that can be moved via manipulation of the button 2008 to lock and unlock the handle 1002 from the stowed position. The stowage locking mechanism 2022 can be biased by a spring 2088 that pushes the button 2008 through the hole 2026 of the exposed panel 1001 and the locking pin 2024 in a position that releasably locks the handle 1002 in the stowed configuration.

The handle 1002 can include an exposed panel 1001 as described elsewhere herein that can be exposed when the handle 1002 is in the stowed configuration. The exposed panel 1001 can be coupled to the handle frame 2048 within a recess 2040 thereof via a variety of techniques, which can include adhesive, bonding, screws, bolts, fasteners, and the like.

The handle frame 2048 can include a curved surface 1096 that can increase user comfort when grasping the handle 1002. The handle frame 2048 can include a first tab 2030 and/or a second tab 2031. The first tab 2030 can rotatably couple to the first link 2016 such that the first link 2016 can pivot. Specifically, a first end 2032 of the first link 2016 can rotatably couple to the first tab 2030, which can be via a pin. The second tab 2031 can rotatably couple to the second link 2017 such that the second link 2017 can pivot. Specifically, a first end 2032 of the second link 2017 can rotatably couple to the second tab 2031, which can be via a pin.

The first link 2016 and/or second link 2017 can each include a second end 2034 that can rotatably couple to a support housing 2044 of the housing 2002. Specifically, the second end 2034 of the first link 2016 can couple to a first interface 2046 of the support housing 2044, which can be via insertion of a pin through the hole 2006, and the second end 2034 of the second link 2017 can couple to a second interface 2047 of the support housing 2044, which can be via insertion of a pin through the hole 2007. The first link 2016 can include a torsion spring 2042 that can bias the first link 2016 toward the deployed configuration. The second link 2017 can include a torsion spring 2043 that can bias the second link 2017 toward the deployed configuration. Specifically, the second ends 2034 of each of the first link 2016 and second link 2017 can include a cylindrical structure 2074. The torsion spring 2042 can be positioned around the cylindrical structure 2074 of the first link 2016 and the torsion spring 2043 can be positioned around the cylindrical structure 2074 of the second link 2017. The torsion spring 2042 can engage with features of the support housing 2044, e.g., the surrounding walls of the first recess 2020, to bias the first link 2016 toward the deployed configuration. The torsion spring 2043 can engage with features of the support housing 2044, e.g., the surrounding walls of the 20241, to bias the second link 2017 toward the deployed configuration. In some variants, only one of the torsion spring 2042 or torsion spring 2043 is included in the handle device 2000.

The handle device 2000 can include a deployment locking mechanism 2038. The deployment locking mechanism 2038 can releasably lock the handle device 2000 in the deployed configuration. Specifically, the deployment locking mechanism 2038 can be inserted into a cavity 2036 of the first link 2016. The deployment locking mechanism 2038 can engage with features of the first tab 2030 to prevent the first link 2016 from pivoting with respect to the first tab 2030. The deployment locking mechanism 2038 can be disengaged from one or more features of the first tab 2030 to allow the handle 1002 to be stowed via application of a force, as described in reference to FIG. 22D. In some variants, the deployment locking mechanism 2038 can be inserted into a cavity 2036 of the second link 2017 and releasably engage with features of the second tab 2031.

The support housing 2044 can define the first recess 2020 and second recess 2021. The support housing 2044 can house the emergency communication unit 2010. The support housing 2044 can be positioned within the housing 2002 such that stowage of the handle 1002 within the cavity 2018 places the exposed panel 1001 substantially flush with a surrounding wall or surface.

Figure 24A:
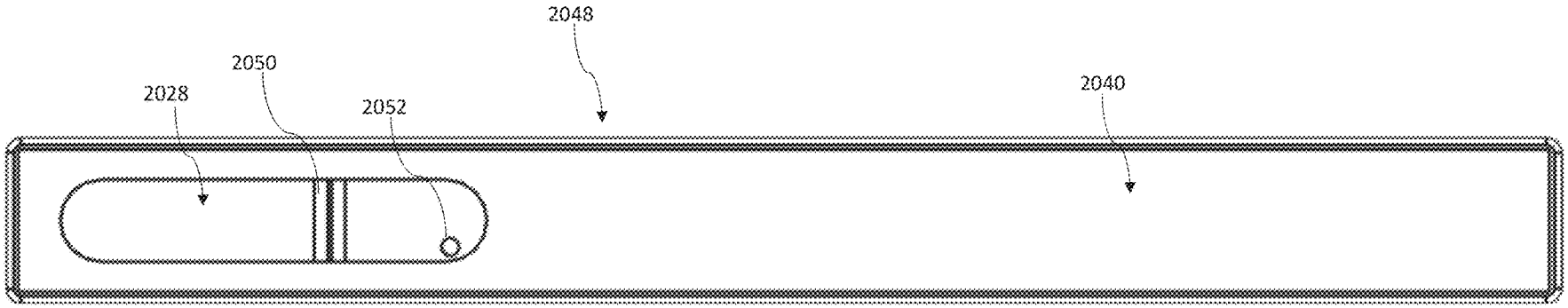
FIGS. 24A, 24B, and 24C illustrate views of the handle frame.
Figure 24B:
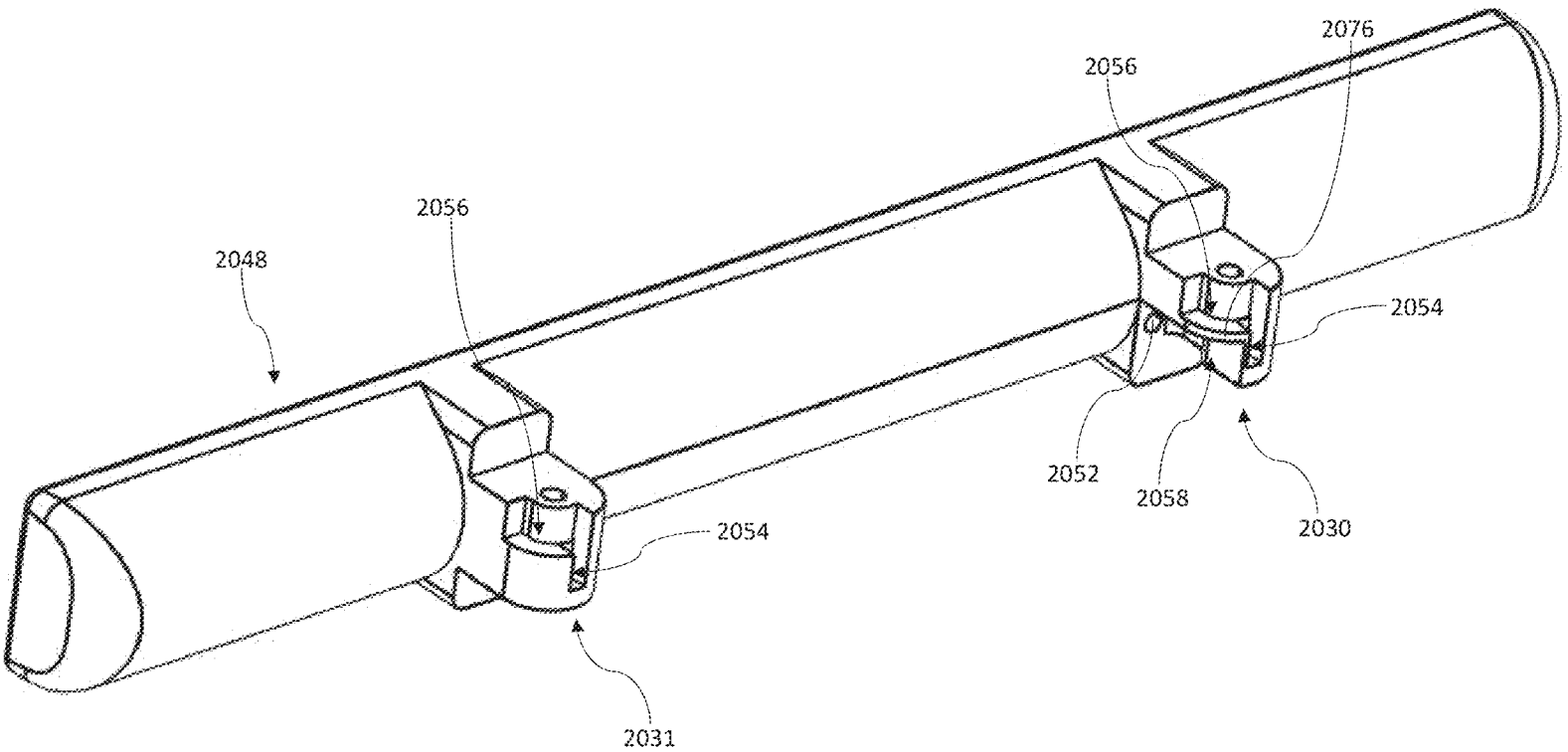
Figure 24C:
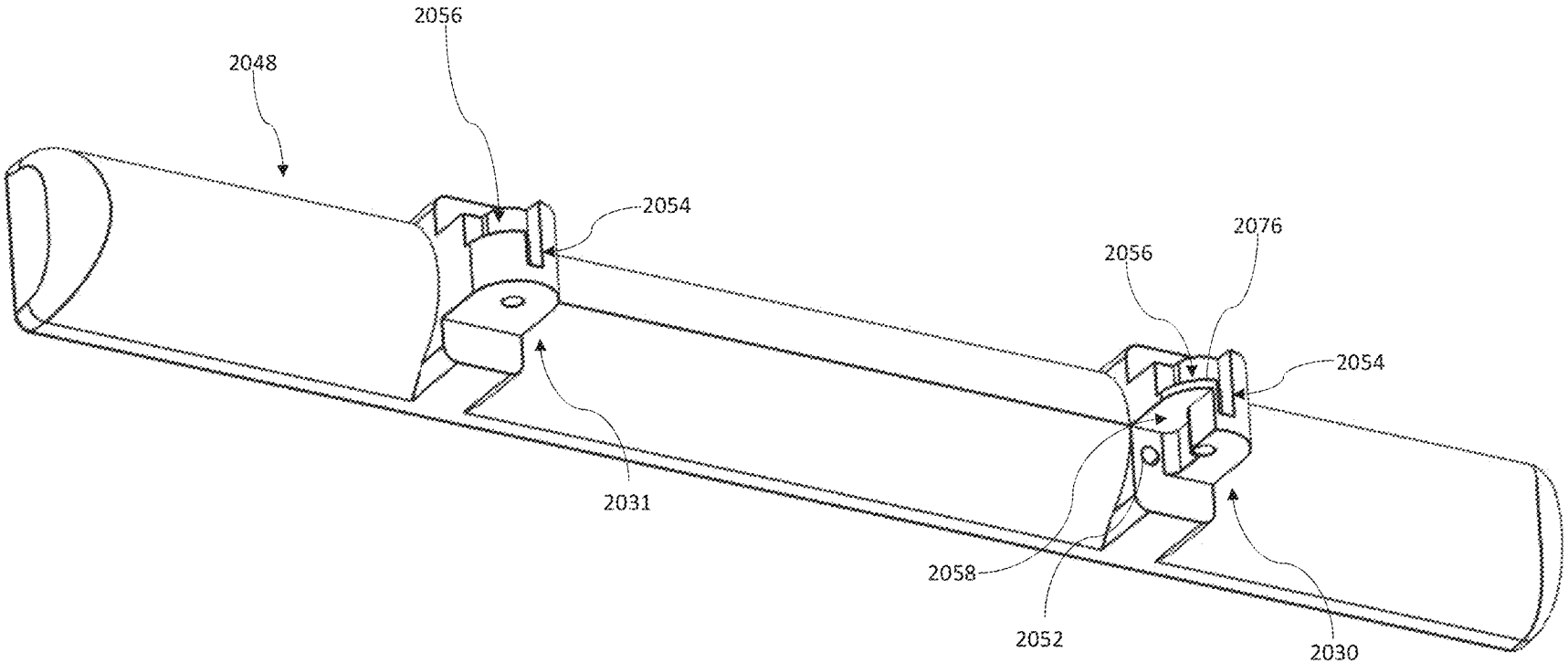

FIGS. 24A-24C illustrate the handle frame 2048. As illustrated in FIG. 24A, the handle frame 2048 can include a recess 2028 that can receive the stowage locking mechanism 2022, such that the stowage locking mechanism 2022 is disposed between the handle frame 2048 and the exposed panel 1001. The handle frame 2048 can include a fulcrum 2050 at which the stowage locking mechanism 2022 pivots such that pushing of the button 2008 causes insertion and removal (e.g., forward and backward) movement of the locking pin 2024 within a hole 2052. The hole 2052 can extend through the handle frame 2048 to engage with the first link 2016 as described herein to lock the first link 2016 and/or handle 1002 in the stowed configuration.

As illustrated in FIGS. 24B and 24C, the handle frame 2048 can include a first tab 2030 and/or second tab 2031. The first tab 2030 can couple with the first link 2016. The second tab 2031 can couple with the second link 2017. In some variants, the first tab 2030 and second tab 2031 can be the same. The first tab 2030 can include a slot 2054 that can receive a tab of the deployment locking mechanism 2038. The tab of the deployment locking mechanism 2038 can be positioned within the slot 2054 to lock relative rotation between the first tab 2030 and the first link 2016 such that the first link 2016 and/or handle 1002 are locked in the deployed configuration. A force can be applied to the deployment locking mechanism 2038, such as an upward force, such that the tab of the deployment locking mechanism 2038 is moved out of the slot 2054 and is free to move through an upper recess 2056, also referred to as a cutout, gap, channel, etc., as the first link 2016 pivots relative to the first tab 2030 to place the handle 1002 in the stowed configuration. The tab of the deployment locking mechanism 2038 can slide across a shelf 2076 of the first tab 2030 during movement between the deployed and stowed configurations. The first tab 2030 can include a lower recess 2058, also referred to as a cutout, gap, channel, etc. The lower recess 2058 can provide space for the first link 2016 to rotate relative to the first tab 2030. The shelf 2076 can separate the upper recess 2056 from the lower recess 2058. As described elsewhere herein, the locking pin 2024 can extend through the hole 2052 to engage with a portion of the first link 2016 that is positioned within the lower recess 2058 to lock the handle 1002 in the stowed configuration. The second tab 2031 can be the same as the second tab 2031. In some variants, the second tab 2031 does not include the lower recess 2058 and hole 2052.

Figure 25C:
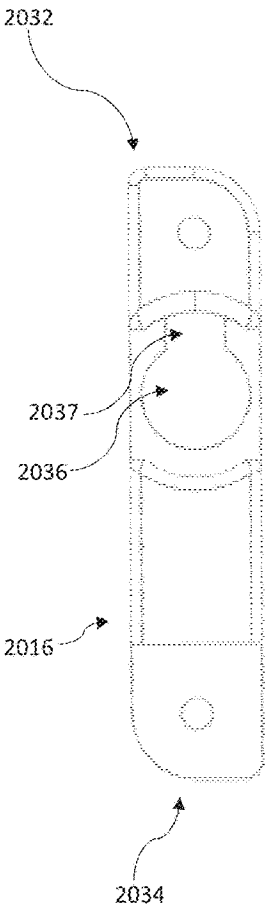
FIGS. 25A, 25B, and 25C illustrate views of an example link.
Figure 25B:
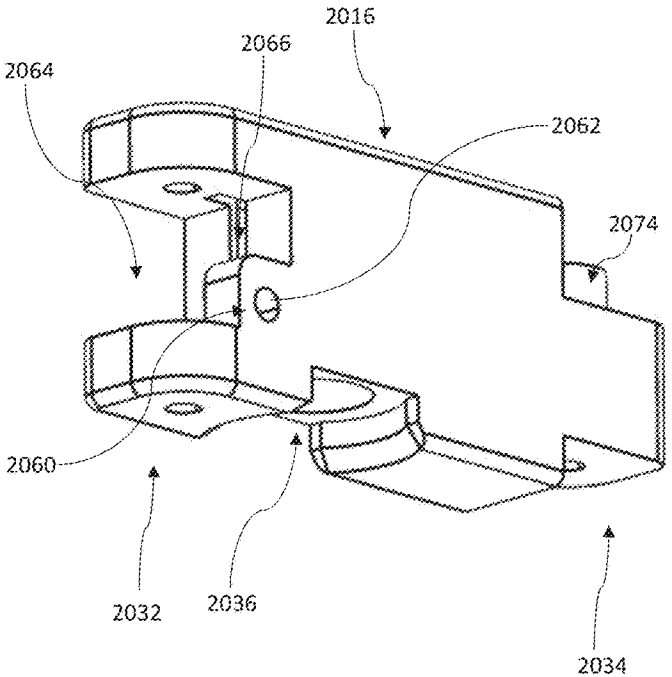
Figure 25A:
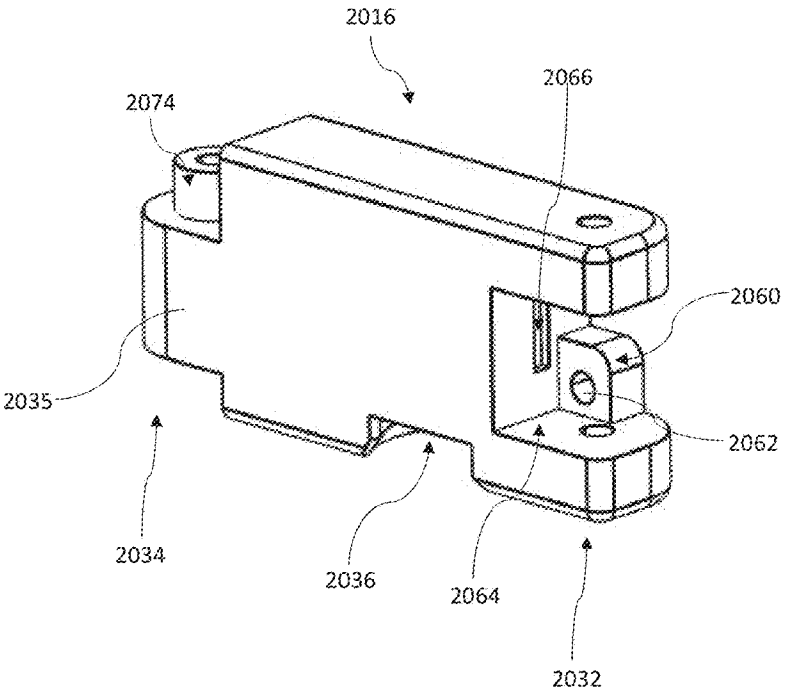

FIGS. 25A-25C illustrate the first link 2016. The first link 2016 can include a first end 2032 that can rotatably couple to the first tab 2030. The first end 2032 can include a receiving region 2064, also referred to as a gap, that can receive the first tab 2030. The first end 2032 can include a flange 2060, also referred to as a tab. The flange 2060 can be positioned within the receiving region 2064. The flange 2060 can include a hole 2062 that can be positioned coaxially with the hole 2052 such that the locking pin 2024 can extend into the hole 2062 to lock the first link 2016 in the deployed configuration, which also place the handle 1002 in the deployed configuration. As described herein, the button 2008 of the stowage locking mechanism 2022 can be pushed, causing the locking pin 2024 to be removed from the hole 2062 such that the first link 2016 can be rotated toward the stowed configuration by the user pushing on the handle 1002.

The first link 2016 can include a cavity 2036 to receive the deployment locking mechanism 2038. The first link 2016 can include a slot 2066, which can extend into the cavity 2036. The tab of the deployment locking mechanism 2038 can be moved within the slot 2066 to position the tab inside the slot 2054 of the first tab 2030, locking the first link 2016 in the deployed configuration, or moved out of the slot 2054 of the first tab 2030, allowing the tab to be rotated through the upper recess 2056 such that the first link 2016 can be placed in the stowed configuration. The cavity 2036 can include a recess 2037 that can receive an orienting protrusion of the deployment locking mechanism 2038.

The first link 2016 can include a second end 2034, which can be opposite the first end 2032. The second end 2034 can be rotatably coupled to the first interface 2046 of the support housing 2044. The second end 2034 can include a tab 2035. The tab 2035 can be positioned within a gap 2112 of the first interface 2046 to facilitate coupling, which can be via a pin. The second end 2034 can include a cylindrical structure 2074. As described elsewhere herein, a torsion spring 2042 can be positioned around the cylindrical structure 2074 to secure the torsion spring 2042 in place and position the torsion spring 2042 to engage features of the second end 2034 and first recess 2020 to bias the first link 2016 toward the deployed configuration.

The second link 2017 can be the same or similar to the first link 2016. The second link 2017 can include a second end 2034 that can be rotatably coupled to the second interface 2047. The second end 2034 can include a tab 2035. The tab 2035 can be positioned within a gap 2114 of the second interface 2047 to facilitate coupling, which can be via a pin. The second end 2034 can include a cylindrical structure 2074. As described elsewhere herein, a torsion spring 2043 can be positioned around the cylindrical structure 2074 to secure the torsion spring 2042 in place and position the torsion spring 2042 to engage features of the second end 2034 and first recess 2020 to bias the first link 2016 toward the deployed configuration.

Figure 26:
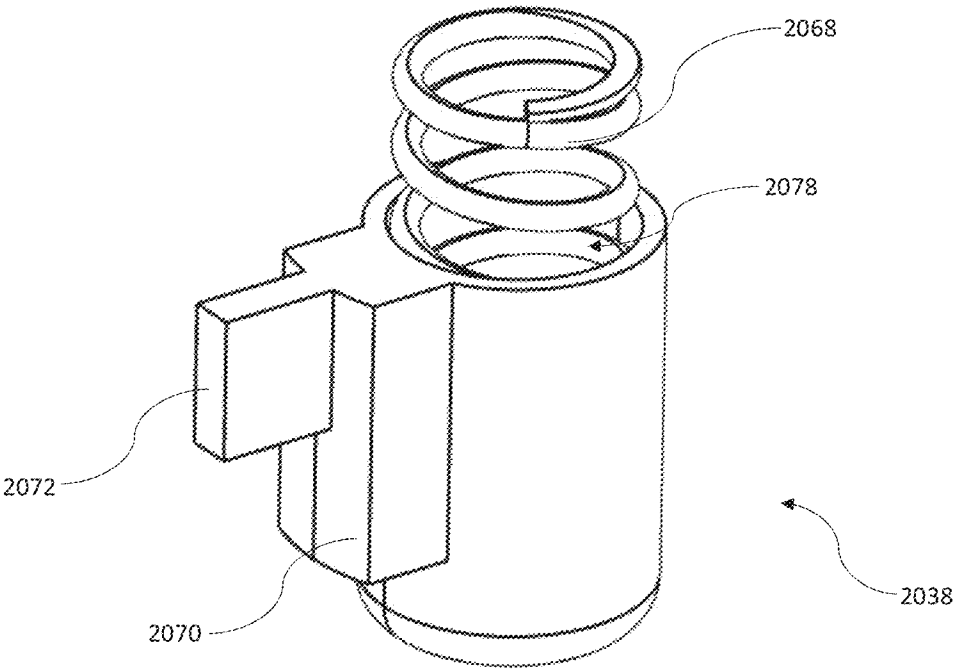
FIG. 26 illustrates an example deployment locking mechanism.

FIG. 26 illustrates a deployment locking mechanism 2038. The deployment locking mechanism 2038 can be a cylinder, prism, and/or other shape. The deployment locking mechanism 2038 can include a cavity 2078. The cavity 2078 can receive a spring 2068 to bias the deployment locking mechanism 2038 in a direction, which can provide for automatic locking of the handle 1002 in the stowed configuration. The deployment locking mechanism 2038 can include an orientation protrusion 2070, also referred to as a protrusion, protuberance, elongate guide, etc., which can move within the recess 2037 of the cavity 2036 of the first link 2016. The orientation protrusion 2070 can prevent excessive forces from being applied on the tab 2072. The deployment locking mechanism 2038 can include a tab 2072, also referred to as a flange, which can extend from the cavity 2036 of the first link via the slot 2066, such that the tab 2072 can be moved in and out of the slot 2054 of the first tab 2030.

Figure 27B:
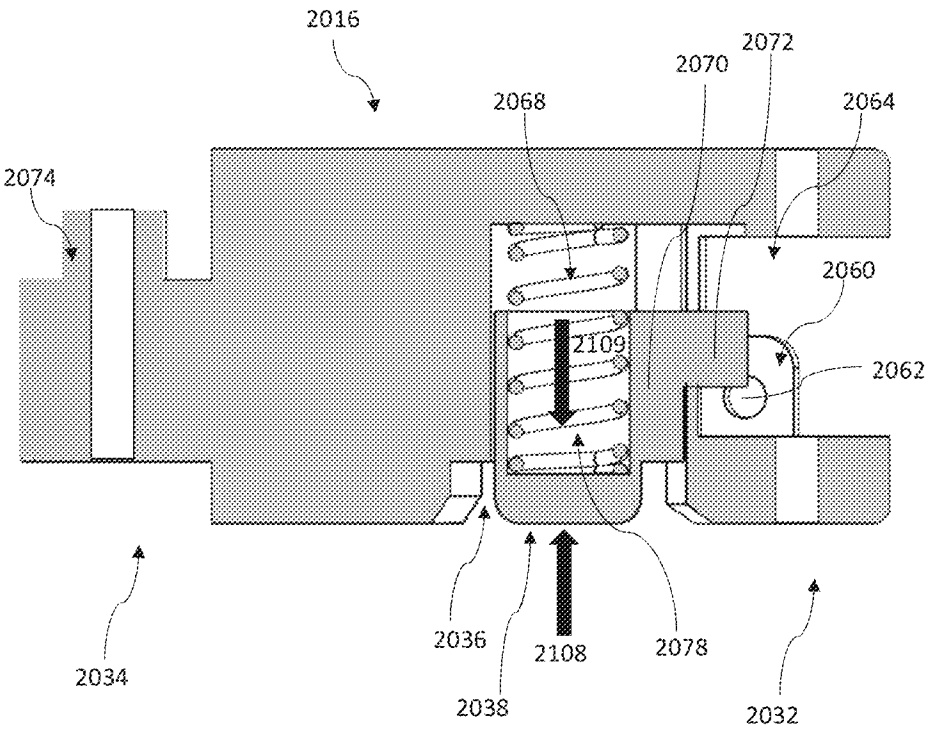
FIG. 27B illustrates a section view of the deployment locking mechanism within the link.
Figure 27A:
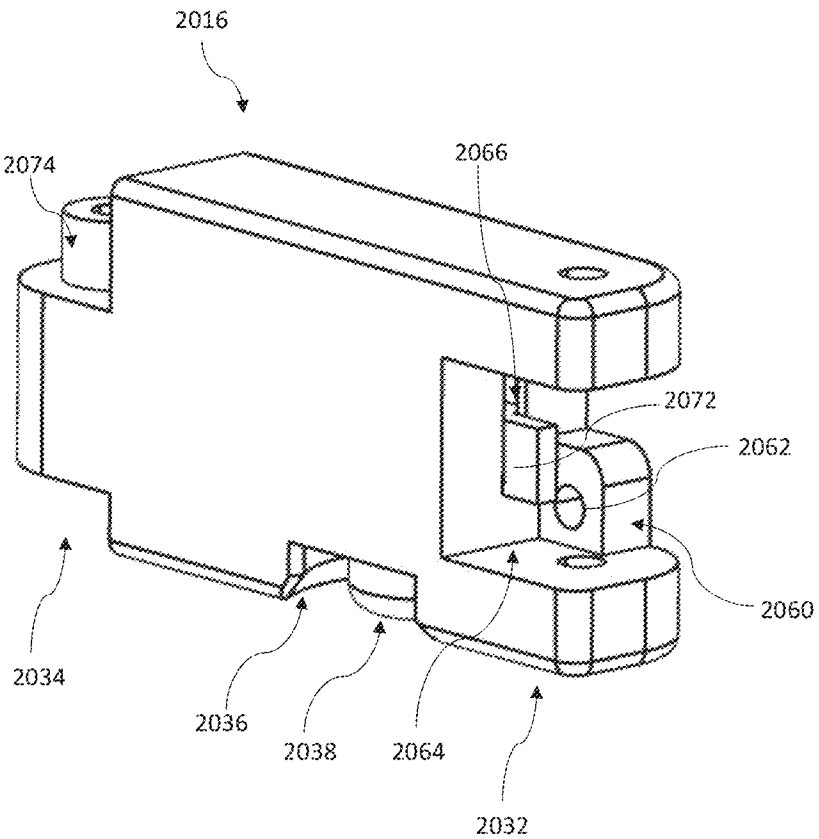
FIG. 27A illustrates the deployment locking mechanism within the link.

FIGS. 27A-27B illustrate the deployment locking mechanism 2038 within the cavity 2036 of the first link 2016. As illustrated, the deployment locking mechanism 2038 extends out of the cavity 2036 to be accessible by the user, such that the user can apply a force thereto. The tab 2072 of the deployment locking mechanism 2038 is disposed in the slot 2066 of the first link 2016. In use, the user can apply a force in the direction of arrow 2108, which can move the deployment locking mechanism 2038 in the direction of arrow 2108 within the cavity 2078 and the tab 2072 in the direction of arrow 2108 within the slot 2066 of the first link 2016. The spring 2068 can engage a surface of the first link 2016 to apply a biasing force in the direction of arrow 2109, which can bias the tab 2072 in the direction of arrow 2109 such that the deployment locking mechanism 2038 is biased toward the position illustrated in FIGS. 27A and 27B. The user may overcome the biasing force of the spring 2068 in the direction of arrow 2109 to move the deployment locking mechanism 2038 in the direction of arrow 2108.

Figure 27D:
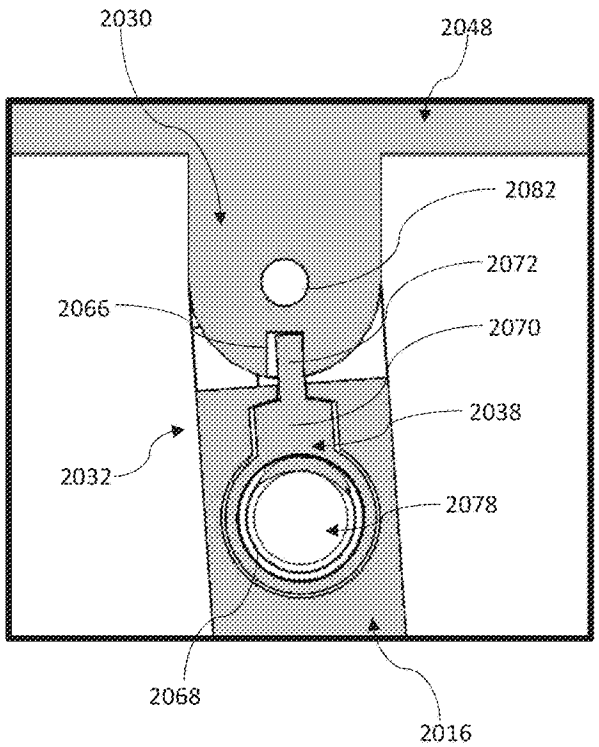
FIG. 27D illustrates a section view of the deployment locking mechanism within the link coupled to the handle frame in the locked deployed configuration.
Figure 27C:
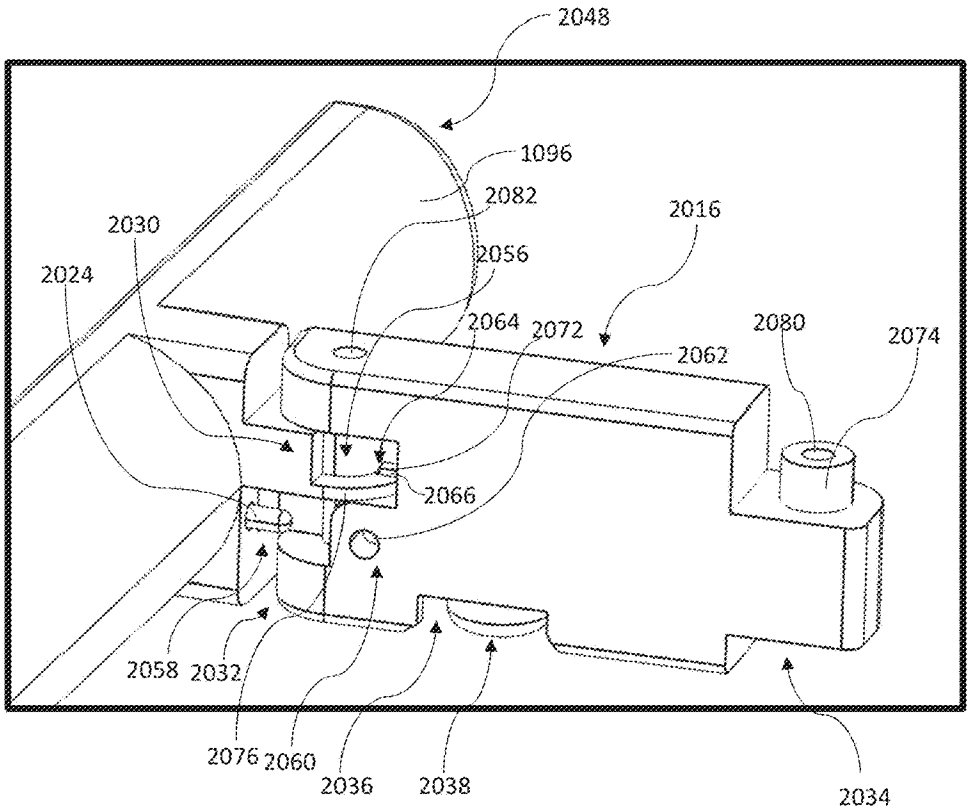
FIG. 27C illustrates the deployment locking mechanism within the link coupled to the handle frame in the locked deployed configuration.

FIGS. 27C and 27D illustrate the first link 2016 with the deployment locking mechanism 2038 disposed within the cavity 2036 and rotatably coupled to the first tab 2030 of the handle frame 2048 in a locked deployed configuration. As illustrated, the first tab 2030 is disposed within the receiving region 2064, also referred to as a gap, of the first end 2032 of the first link 2016. As described elsewhere herein, a pin can be inserted through a hole 2082, extending through the first end 2032 and first tab 2030, to rotatably couple the first link 2016 to the first tab 2030. As illustrated in FIG. 27C, the tab 2072 of the deployment locking mechanism 2038 is positioned within the slot 2066 of the first tab 2030, rotatably locking the first link 2016 to the first tab 2030 such that the handle 1002 is locked in the deployed configuration. The second end 2034 can also include a hole 2080, which can extend through the cylindrical structure 2074. The hole 2080 cab be coaxially aligned with the hole 2006 in the housing 2002 and hole in the first interface 2046 such that a pin can be inserted therethrough to rotatably couple the first link 2016 to the support housing 2044. The second link 2017 can be coupled to the support housing 2044 in a similar manner. FIG. 27D illustrates a section view showing the position of the tab 2072 of the deployment locking mechanism 2038 within the slot 2066 of the first tab 2030.

Figure 27F:
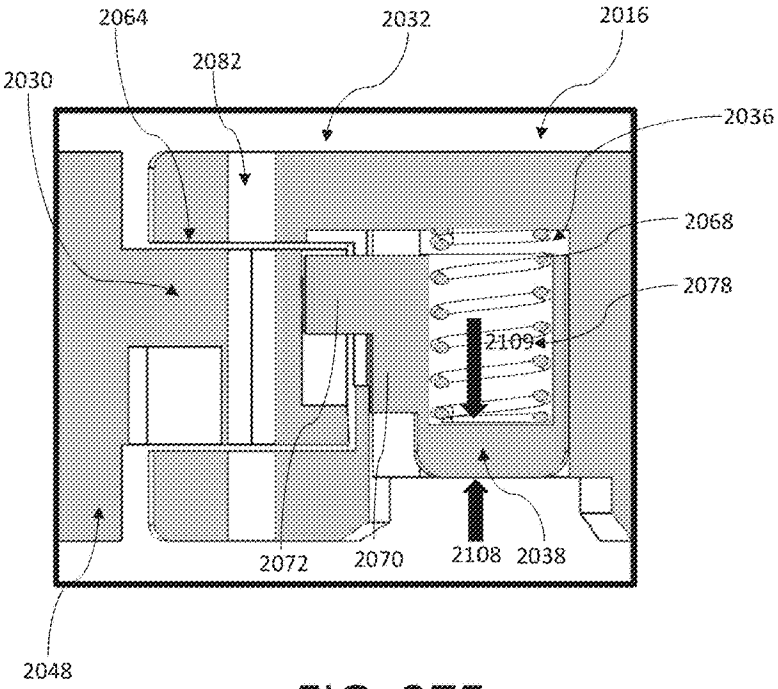
FIG. 27F illustrates a side section view of the deployment locking mechanism within the link coupled to the handle frame with a tab of the deployment locking mechanism moved out of the locking position.
Figure 27E:
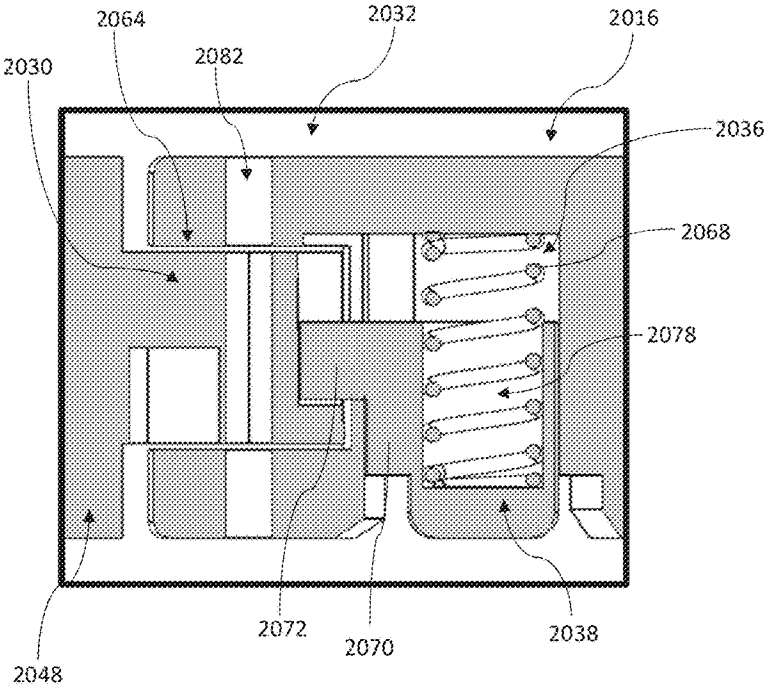
FIG. 27E illustrates a side section view of the deployment locking mechanism within the link coupled to the handle frame in the locked deployed configuration.

FIGS. 27E and 27F illustrate side section views of the deployment locking mechanism 2038 disposed within the cavity 203 and the first link 2016 rotatably coupled to the first tab 2030 of the handle frame 2048. FIG. 27E illustrates the deployment locking mechanism 2038 in a locked position. The deployment locking mechanism 2038 is biased by the spring 2068 toward the position wherein the tab 2072 is disposed within the slot 2066 of the first tab 2030. FIG. 27F illustrates the deployment locking mechanism 2038 in an unlocked positon. To move the deployment locking mechanism 2038 from the locked position in FIG. 27E to the unlocked position in FIG. 27F, the user can apply a force to the deployment locking mechanism 2038 in the direction of arrow 2108, which can move the deployment locking mechanism 2038 and tab 2072 in the direction of arrow 2108 such that the tab 2072 is moved out of the slot 2066 and is free to move through the upper recess 2056 of the first tab 2030. As described elsewhere herein, the spring 2068 can apply a biasing force in the direction of arrow 2109. Accordingly, the user can apply a force in the direction of arrow 2108 that overcomes the biasing force in the direction of arrow 2109 to move the deployment locking mechanism 2038 to enable the handle 1002 to be rotated from the deployed position to the stowed position.

Figure 27H:
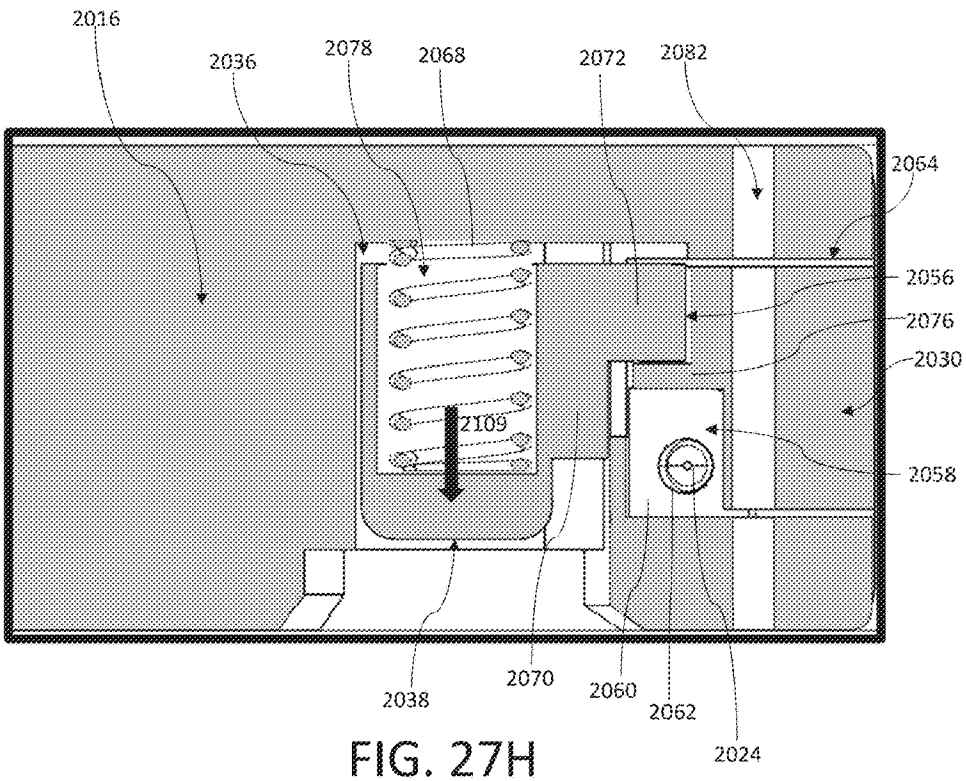
FIG. 27H illustrates a section view of the link locked in the stowed configuration.
Figure 27G:
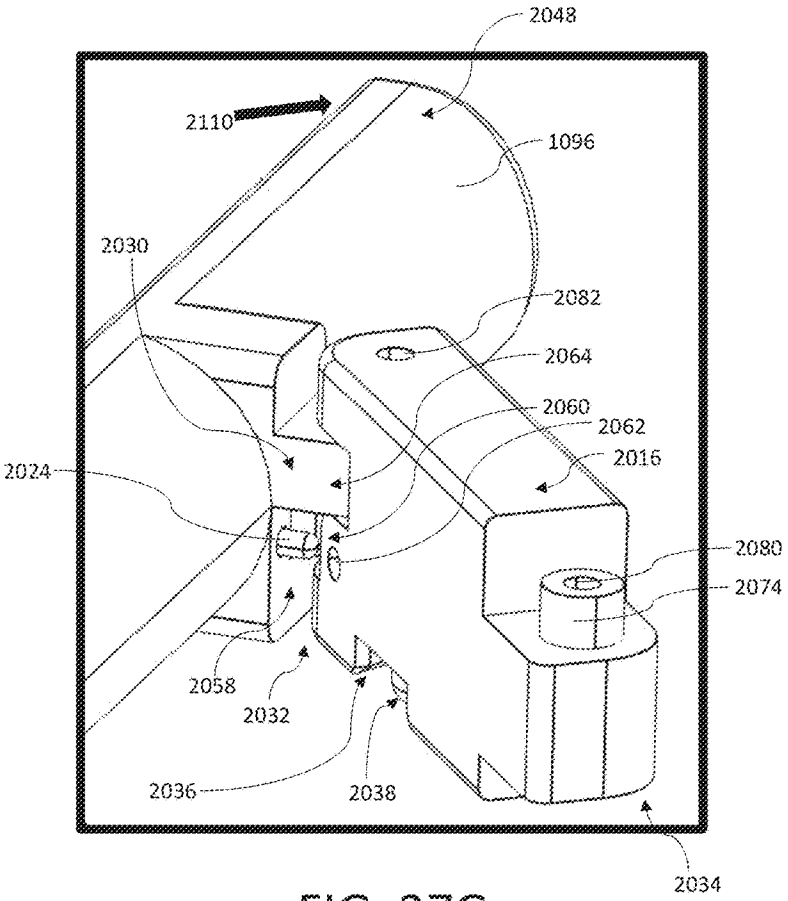
FIG. 27G illustrates the link with the deployment locking mechanism being rotated to the stowed configuration.

FIG. 27G illustrates the first link 2016 in a transition configuration, pivoting relative to the first tab 2030 toward the stowed position. As described elsewhere herein, the user can apply a force in the direction of arrow 2110 after applying a force to the deployment locking mechanism 2038 to rotate the handle 1002 toward the stowed configuration. The tab 2072 can move through the upper recess 2056 and over the shelf 2076 as the first link 2016 is rotated to the stowed configuration. The user can cease applying a force to the deployment locking mechanism 2038 after the tab 2072 is rotated over the shelf 2076. The shelf 2076 can support the tab 2072 in the unlocked position out of the slot 2066, as illustrated in FIG. 27H, despite the biasing force of the spring 2068. FIG. 27H illustrates a section view of the first link 2016 in the stowed configuration. As illustrated, the tab 2072 can contact the shelf 2076. The spring 2068 can continue to apply a force in the direction of arrow 2109 but the contact between the tab 2072 and the shelf 2076 can maintain the deployment locking mechanism 2038 in the position illustrated in FIG. 27H. As illustrated in FIG. 27H, the locking pin 2024 can be positioned within the hole 2062 of the flange 2060 of the first link 2016 in the stowed configuration, which can releasably lock the handle 1002 in the stowed configuration.

Figure 28:
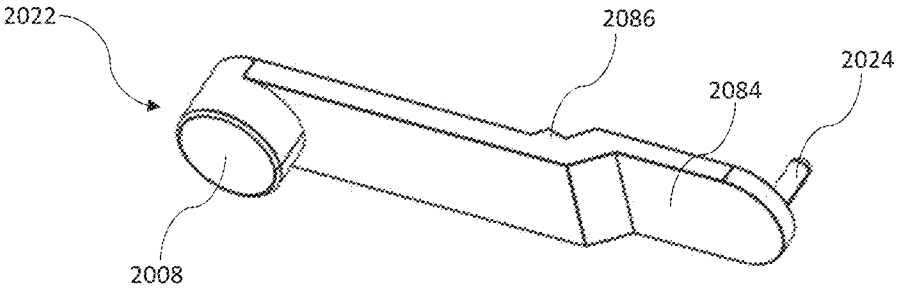
FIG. 28 illustrates an example stowage locking mechanism.

FIG. 28 illustrates the stowage locking mechanism 2022, also referred to as the lever, lever lock, actuator lock, actuator lever, stowage lock, stowage locking lever. The stowage locking mechanism 2022, as described elsewhere herein, can include a button 2008 that can be actuated, e.g., pressed, pushed, etc., by a user to move the locking pin 2024 in and out of the hole 2062 of the flange 2060 of the first link 2016. The stowage locking mechanism 2022 can include a retaining corner 2086. The stowage locking mechanism 2022 can include a stepped portion 2084.

Figure 29:
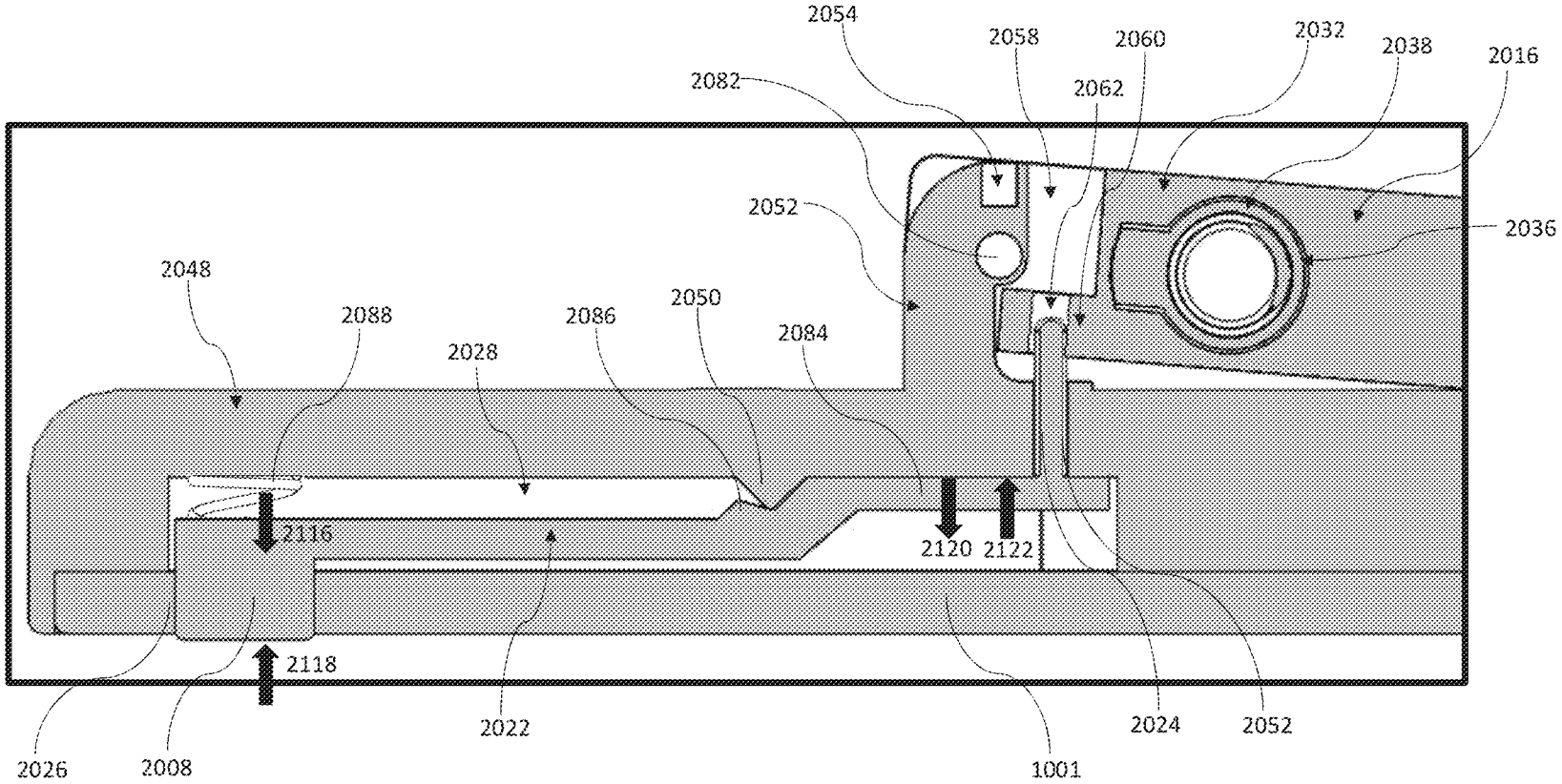
FIG. 29 illustrates a section view of the locking pin of the stowage locking mechanism in the locked position.

FIG. 29 illustrates a section view of the stowage locking mechanism 2022 with the locking pin 2024 positioned within the hole 2062 of the flange 2060 of the first link 2016, locking the handle 1002 in the stowed configuration. The stowage locking mechanism 2022 can be positioned within the recess 2028 of the handle frame 2048, which can be between the handle frame 2048 and the exposed panel 1001. The button 2008 can be biased by a spring 2088 through a hole 2026 of the exposed panel 1001 such that the button 2008 is accessible to the user. The retaining corner 2086 can interface with a fulcrum 2050, also referred to as a corner, point, or edge, such that the biasing force of the spring 2088 on the button 2008 in the direction of arrow 2116 can bias the locking pin 2024 in the direction of arrow 2122 which can place the locking pin 2024 in the hole 2062 of the flange 2060 of the first link 2016 in the stowed configuration. The biasing force of the spring 2088 in the direction of arrow 2116 can automatically place the locking pin 2024 in the hole 2026 of the flange 2060 as the user pushes the handle 1002 into the stowed configuration in the housing 1026 such that the handle 1002 is automatically locked in the stowed configuration upon placement therein.

To deploy the handle 1002, the user can overcome the biasing force of the spring 2088 by applying a force to the button 2008 in the direction of arrow 2118 such that the locking pin 2024 moves in the direction of arrow 2120, which can be facilitated by the fulcrum 2050 acting as a pivot point. The retaining corner 2086 can interface with the fulcrum 2050 to maintain the position of the stowage locking mechanism 2022 and/or facilitate smooth pivoting. When the user applies a force to the button 2008 in the direction of arrow 2118, the locking pin 2024 can move in the direction of arrow 2120 such that the locking pin 2024 is removed from the hole 2062 of the flange 2060 of the first link 2016—allowing the torsion spring 2042 and/or torsion spring 2043 to automatically deploy the handle 1002 to the deployed configuration. The locking pin 2024 can move within the hole 2052, as described herein.

Figure 30:
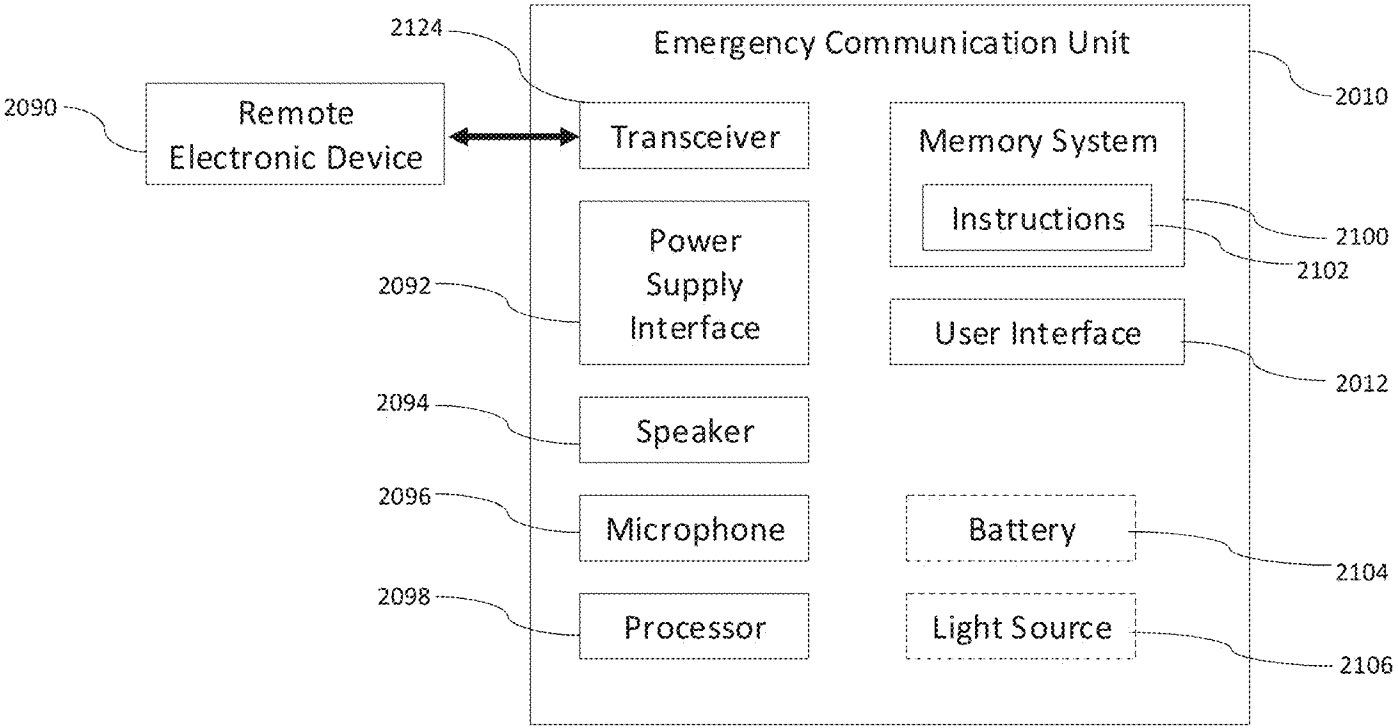
FIG. 30 illustrates an example emergency communication unit.

FIG. 30 schematically illustrates an emergency communication unit 2010. The emergency communication unit 2010 can be incorporated in any of the handle devices disclosed herein. The emergency communication unit 2010 can include a transceiver 2124 that can communicate with a remote electronic device 2090 to facilitate communication between a user and an emergency contact. The emergency communication unit 2010 can include a power supply interface 2092 that facilitates connection with a power supply to power the emergency communication unit 2010. In some variants, the emergency communication unit 2010 can include a battery 2104 that can power the emergency communication unit 2010 when a power supply is not available or active. The emergency communication unit 2010 can include a speaker 2094 that can emit sound enabling an emergency contact to audibly communicate with the user and/or emit an alarm. The emergency communication unit 2010 can include a microphone 2096 that can enable the user to speak to an emergency contract. The emergency communication unit 2010 can, in some variants, include a light source 2106 that can be activated in an emergency to provide light. The emergency communication unit 2010 can include a processor 2098 that can execute instructions 2102 stored on a memory system 2100 to perform the operations, tasks, and methods described herein. The incorporation of an emergency communication unit 2010 can enable a user to reach an emergency contact in an emergency when a phone or other communication device may not be accessible.

The handles and handle devices described herein can be made of a variety of materials, which can include metal (e.g., steel, aluminum), metal alloys, wood, polymers (e.g., plastic), glass (which could include metal reinforcing features, such as a center steel rod), and/or others. In some variants, the handles, housing, collar, and/or other features may include lights, such as an LED light channel, to help a user locate the handle and/or handle device. The handles and handle devices can be scaled up/down or made more or less robust depending on application, such as for use in cabinetry, heavy duty use, and/or for hanging objects.

In some variants, the handles and handle devices described herein can be incorporated into a drawer or other cabinetry fronts. For example, the handle device can form a front of the drawer. The handle device can include a mechanism that locks the drawer shut such that use of the handle device does not open the drawer. For example, the handle device can include deployable rods that can extend into surrounding features of the drawer, e.g., supporting structures below, above, or otherwise around. The deployable rods can be retracted to allow the drawer to be opened. The handle device can incorporate a second handle (e.g., smaller handle) coupled to a front of the handle of the handle device that can be used to open and close the drawer when the drawer is not locked shut by the deployable rods. Such an arrangement can be beneficial to persons in a seated position needing assistance to assume a standing position.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Terms of orientation used herein, such as "top," "bottom," "horizontal," "vertical," "longitudinal," "lateral," and "end" are used in the context of the illustrated embodiment. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular" or "cylindrical" or "semi-circular" or "semi-cylindrical" or any related or similar terms, are not required to conform strictly to the mathematical definitions of circles or cylinders or other structures, but can encompass structures that are reasonably close approximations.

The terms "approximately," "about," and "substantially" as used herein represent an amount close to the stated amount that still performs a desired function or achieves a desired result. For example, in some embodiments, as the context may permit, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may permit, the term "generally parallel" can refer to something that departs from exactly parallel by less than or equal to 20 degrees.

Although the handle devices, handle assemblies, systems, and/or methods have been disclosed in the context of certain embodiments and examples, the scope of this disclosure extends beyond the specifically disclosed embodiments to other alternative embodiments and/or uses of the embodiments and certain modifications and equivalents thereof. Various features and aspects of the disclosed embodiments can be combined with or substituted for one another in order to form varying modes of the conveyor. The scope of this disclosure should not be limited by the particular disclosed embodiments described herein.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Moreover, while operations may be depicted in the drawings or described in the specification in a particular order, such operations need not be performed in the particular order shown or in sequential order, and all operations need not be performed, to achieve the desirable results. Other operations that are not depicted or described can be incorporated in the example methods and processes. For example, one or more additional operations can be performed before, after, simultaneously, or between any of the described operations. Further, the operations may be rearranged or reordered in other implementations. Also, the separation of various system components in the implementations described above should not be understood as requiring such separation in all implementations. The described components and systems can generally be integrated together in a single product or packaged into multiple products. Additionally, other implementations are within the scope of this disclosure.

Some embodiments have been described in connection with the accompanying drawings. The figures are drawn to scale where appropriate, but such scale should not be interpreted as limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, any methods described herein may be practiced using any device suitable for performing the recited steps.

In summary, various embodiments and examples of handle devices, handle assemblies, systems, and/or methods have been disclosed. This disclosure expressly contemplates that various features and aspects of the disclosed embodiments can be combined with, or substituted for, one another. Accordingly, the scope of this disclosure should not be limited by the particular disclosed embodiments and examples described above, but should be determined only by a fair reading of the claims that follow.

What is claimed is:

1. A handle device movable from a stowed configuration to a deployed configuration for grasping by a user, the handle device comprising:

a handle configured to be grasped by a user, the handle configured to move between a stowed configuration and a deployed configuration, wherein in the stowed configuration, the handle is configured to be substantially flush with a surrounding wall, and in the deployed configuration, the handle is configured to protrude from the surrounding wall for the user to grasp the handle;

a handle housing configured to be positioned in the surrounding wall with the handle at least partially positioned in the handle housing, the handle housing comprising a first gear track, a second gear track, and an elongate protrusion on one or more walls of the handle housing, the first gear track positioned on a same wall of the one or more walls as the second gear track, the first gear track spaced from the second gear track on the same wall, wherein the handle is configured to move relative to the handle housing between the stowed and deployed configurations, wherein the first and second gear tracks extend on the same wall of the handle housing along a travel direction of the handle between the stowed and deployed configurations, and wherein the elongate protrusion extends along the travel direction on the one or more walls;

a gear shaft connected to the handle, the gear shaft comprising a first gear fixed to the gear shaft and a second gear fixed to the gear shaft, the first gear spaced from the second gear on the gear shaft, the first gear engaging the first gear track, the second gear engaging the second gear track, wherein the handle moving relative to the handle housing between the stowed and deployed configurations is configured to rotate the first and second gears via the first and second gear tracks moving along the travel direction and engaging the first and second gears, wherein the first and second gears are configured to rotate together a same arc length by being fixed to the gear shaft such that the first and second gears move the first and second gear tracks a same linear distance along the travel direction between the stowed and deployed configurations by the first and second gears rotating the same arc length to mitigate movement of the handle in directions other than along the travel direction relative to the handle housing;

a spring connected to the handle housing and configured to bias the handle to the deployed configuration; and a lock housing connected to the handle and configured to move with the handle between the stowed and deployed configurations, the lock housing comprising a groove extending in the travel direction, the groove configured to receive the elongate protrusion of the handle housing in the stowed configuration, the lock housing comprising a cavity having a locking mechanism positioned in the cavity, the locking mechanism comprising an engagement body configured to move in the cavity and an arm connected to the engagement body extending out of the cavity, the arm configured to block the elongate protrusion from entering the groove of the lock housing to inhibit movement of the elongate protrusion into the groove to lock the handle in the deployed configuration.

2. The handle device of claim 1, wherein the lock housing comprises an opening exposing the engagement body in the deployed configuration, and wherein the engagement body is configured to be moved in the cavity by the user through the opening to move the arm of the locking mechanism away from the groove such that the elongate protrusion is permitted to enter the groove, enabling the handle to be moved into the stowed configuration.

3. The handle device of claim 1, wherein the handle comprises a front recess configured to receive a panel having an appearance matching that of the surrounding wall.

4. The handle device of claim 1, further comprising a lock spring arm connected to the handle and configured to move with movement of the handle between the deployed and stowed configurations, wherein the handle housing comprises a guide channel configured to receive the lock spring arm, the guide channel comprising a contour configured to bias the lock spring arm in the contour to lock the handle in the stowed configuration.

5. The handle device of claim 4, wherein the lock spring arm is configured to be moved from the contour of the guide channel by pushing the handle into the handle housing from the stowed configuration such that the spring biases the handle to move into the deployed configuration.

6. The handle device of claim 1, further comprising a plurality of links pivotably coupled together and connected to the handle and the handle housing to support the handle relative to the handle housing, wherein the plurality of links are configured to expand with the handle in the deployed configuration and to collapse with the handle in the stowed configuration.

7. The handle device of claim 1, further comprising an emergency communication unit connected to the handle and configured to enable the user to contact an emergency contact.

8. The handle device of claim 1, wherein the handle device is configured to be disposed between two supports in the surrounding wall.

9. The handle device of claim 1, wherein the spring is a constant force spring.

10. The handle device of claim 1, wherein the handle comprises flanges having openings through which the gear shaft extends to position the gear shaft relative to the handle.

11. The handle device of claim 1, the first gear track and the second gear track are disposed on a first wall of the handle housing and the elongate protrusion is disposed on a second wall of the handle housing that is opposite the first wall.

12. A handle device comprising:

a handle configured to be grasped by a user, the handle being configured to translate between a stowed configuration that is substantially flush with a surrounding wall and a deployed configuration which allows for the user to grasp the handle;

a housing configured to house the handle in the housing in the stowed configuration, the housing comprising a gear rack and a guide channel, the guide channel comprising a contour configured to facilitate locking the handle in the stowed configuration;

a gear rod comprising a gear configured to engage with the gear rack, the gear rod being configured to rotate with movement of the handle between the stowed and deployed configurations with the gear remaining engaged with the gear rack;

a lock spring arm connected to the handle, wherein the guide channel is configured to move the lock spring arm within the guide channel with the movement of the handle between the stowed and deployed configurations; and a spring coupled to the housing and configured to bias the handle to the deployed configuration outside of the housing, wherein the guide channel is configured to move the lock spring arm into the contour of the guide channel with the handle in the stowed configuration to lock the handle in the stowed configuration, wherein the guide channel is configured to move the lock spring arm from the contour of the guide channel by the handle being moved further into the housing from the stowed configuration, and wherein the spring is configured to move the handle from within the housing with the lock spring arm moved out of the contour of the guide channel.

13. The handle device of claim 12, further comprising a locking mechanism comprising an engagement cylinder and arm, the locking mechanism configured to releasably lock the handle in the deployed configuration and move with movement of the handle between the stowed and deployed configurations.

14. The handle device of claim 13, wherein the housing comprises a protrusion, and wherein engagement between the arm of the locking mechanism and the protrusion locks the handle in the deployed configuration.

15. The handle device of claim 14, further comprising a lock housing having a cavity configured to house the locking mechanism, wherein the engagement cylinder of the locking mechanism is configured to be accessible to the user with the handle in the deployed configuration, and wherein a force applied to the engagement cylinder disengages the arm from the protrusion to allow the user to push the handle to the stowed configuration.

16. The handle device of claim 15, wherein the lock housing comprises a groove configured to receive the protrusion, and wherein the arm of the locking mechanism is configured to block the protrusion from entering the groove to lock the handle in the deployed configuration.

17. The handle device of claim 12, further comprising a plurality of links pivotably coupled together, the plurality of links coupling the housing to the handle, wherein the plurality of links are configured to expand with deployment of the handle.

18. A handle device comprising:

a handle configured to swing between a stowed configuration and a deployed configuration, wherein the handle is configured to be grasped in the deployed configuration;

a housing configured to house the handle in a stowed configuration;

a plurality of links rotatably coupled to the housing and the handle, the plurality of links configured to facilitate the handle being swung between the stowed and deployed configurations; and a stowage locking lever housed within the handle, the stowage locking lever comprising a button accessible to a user and a locking pin, the stowage locking lever configured to lock the handle in the stowed configuration by extending the locking pin into the one of the plurality of links, wherein the stowage locking lever is biased via a spring to position the locking pin into the one of the plurality of links, wherein the locking pin is configured to be removed from the one of the plurality of links via applying a force to the button such that the stowage locking lever moves to move the locking pin.

19. The handle device of claim 18, comprising a deployment locking mechanism configured to be inserted into a cavity of the one of the plurality of links, the deployment locking mechanism comprising cylindrical body and a tab extending therefrom, the tab configured to engage the housing to lock the handle in the deployed configuration, wherein the tab is configured to be disengaged from the housing via applying a force thereto such that the tab is translated within the cavity of the one of the plurality of links.

20. The handle device of claim 19, further comprising a torsion spring configured to bias the handle to the deployed configuration, the torsion spring coupled to the one of the plurality of links.

* * * * *